US006831625B2

(12) United States Patent
Matsushima et al.

(10) Patent No.: US 6,831,625 B2
(45) Date of Patent: Dec. 14, 2004

(54) LCD DRIVING CIRCUITRY WITH REDUCED NUMBER OF CONTROL SIGNALS

(75) Inventors: Yasuhiro Matsushima, Nara (JP); Sunao Etoh, Tenri (JP); Yutaka Takafuji, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 219 days.

(21) Appl. No.: 10/160,173

(22) Filed: Jun. 4, 2002

(65) Prior Publication Data

US 2002/0163493 A1 Nov. 7, 2002

Related U.S. Application Data

(62) Division of application No. 09/264,880, filed on Mar. 9, 1999, now Pat. No. 6,437,766.

(30) Foreign Application Priority Data

Mar. 30, 1998 (JP) ..... 10-084323
May 25, 1998 (JP) ..... 10-142417
Dec. 18, 1998 (JP) ..... 10-361610

(51) Int. Cl.[7] ..... G09G 3/28
(52) U.S. Cl. ..... 345/98; 345/100; 345/691
(58) Field of Search ..... 345/87–100, 204–213, 345/690–691

(56) References Cited

U.S. PATENT DOCUMENTS

| | | | |
|---|---|---|---|
| 5,818,412 | A | 10/1998 | Maekawa |
| 5,883,609 | A | 3/1999 | Asada et al. |
| 6,020,871 | A | 2/2000 | Asada |
| 6,181,312 | B1 | 1/2001 | Sekine |

FOREIGN PATENT DOCUMENTS

| | | |
|---|---|---|
| JP | 01-142796 | 6/1989 |
| JP | 03-287291 | 12/1991 |
| JP | 04-131822 | 5/1992 |
| JP | 05-216441 | 8/1993 |
| JP | 08-122748 | 5/1996 |
| JP | 08-146910 | 6/1996 |
| JP | 08-211852 | 8/1996 |
| JP | 2625389 | 4/1997 |
| JP | 2625390 | 4/1997 |
| JP | 09-152574 | 6/1997 |
| JP | 11-265169 | 9/1999 |
| JP | 11-296129 | 10/1999 |

OTHER PUBLICATIONS

U.S. patent application Ser. No. 09/264,880, filed Mar. 9, 1999.
Japanese Office Action dated Aug. 19, 2003 (with English translation).
Japanese Office Action dated May 13, 2003 (with English translation).

*Primary Examiner*—Amr Awad
(74) *Attorney, Agent, or Firm*—Nixon & Vanderhye P.C.

(57) ABSTRACT

A liquid crystal display device according to the present invention includes an active matrix array made up of switching elements provided at each intersection between a plurality of scanning lines and a plurality of signal lines, and a vertical drive circuit for driving the active matrix array, in which the vertical drive circuit includes: scanning circuits N in number (N being a positive integer), which receive a start pulse and output pulse signals, the respective scanning circuits sequentially shifting the pulse signal by one-half of a clock signal cycle each; AND gate circuits N×M in number (M being an integer no less than 2), each provided with a first control terminal and a second control terminal, every M adjacent AND gate circuits being connected together via the first control terminals thereof, which receive a signal from one of the N scanning circuits, and every Mth AND gate circuit being connected together via the second control terminals thereof, which receive one of M kinds of second control signal; and NAND gate circuits, each of which receives an output from one of the AND gate circuits and one of two kinds of third control signal outputted by a third control terminal.

28 Claims, 34 Drawing Sheets

LCD DRIVING CIRCUITRY WITH REDUCED NUMBER OF CONTROL SIGNALS

This application is a division of application Ser. No. 09/264,880, filed Mar. 9, 1999, now U.S. Pat. No. 6,437,766 the entire content of which is hereby incorporated by reference in this application.

FIELD OF THE INVENTION

The present invention relates to an active matrix liquid crystal display device made up of an active matrix array provided with switching elements at each intersection between a plurality of scanning lines and a plurality of signal lines, a vertical drive circuit for driving the scanning lines, and a horizontal drive circuit for driving the signal lines; and to a method of driving such a liquid crystal display device.

BACKGROUND OF THE INVENTION

Recent years have seen increasing demand for liquid crystal display devices which are compatible with personal computers or work stations, televisions, etc. having different video frequencies, numbers of pixels, and scanning methods.

In order for a single liquid crystal display device to achieve compatibility with a variety of sources such as the foregoing personal computers or workstations, televisions, etc., the liquid crystal display device must perform a variety of scanning methods, such as interlace driving, two-line simultaneous driving, non-interlace driving, etc., as will be explained below.

For compatibility with the foregoing personal computers or workstations, sequential scanning must be performed, in which lines are scanned sequentially, regardless of whether they are odd-numbered or even-numbered lines. For compatibility with existing televisions or hi-vision televisions, on the other hand, interlace scanning must be performed, in which the pixels of odd-numbered lines are sequentially scanned during an odd-number field, and the pixels of even-numbered lines are sequentially scanned during an even-number field.

Further, there are also cases when two-line simultaneous scanning is performed, in which, when scanning an odd-numbered line during the odd-number field, the next even-numbered line is also scanned and the same signal is written therein, and when scanning an even-numbered line during the even-number field, the next odd-numbered line is also scanned and the same signal is written therein. Thus liquid crystal display devices compatible with this scanning method are also called for.

Further, liquid crystal display devices are called for which are capable of each of the foregoing scanning methods, and also of enlarged display, movement, black display writing, bi-directional scanning, etc.

Again, with the aim of reducing the size and cost of liquid crystal display devices, research is also in progress to develop techniques for integrating peripheral drive circuits onto the same substrate with the liquid crystal display device. Peripheral drive circuits are divided into a vertical drive circuit, which scans the gates of thin film transistors (TFTs) making up an active matrix array, and a horizontal drive circuit, which supplies video signals to pixels.

This type of liquid crystal display device is disclosed in, for example, Japanese Unexamined Patent Publication No. 8-122747/1996 (Tokukaihei 8-122747). The following will explain this conventional liquid crystal display device.

The foregoing conventional liquid crystal display device, as shown in FIG. 31, includes an active matrix array 201 made up of TFTs, one provided at each intersection between scanning lines and signal lines, a vertical drive circuit 202 for driving the scanning lines, and a horizontal drive circuit 203 for driving the signal lines. In this conventional liquid crystal display device, there are 1,024 scanning lines.

In the foregoing conventional liquid crystal display device, as shown in the Figure, the vertical drive circuit 202 is made up of 256 scanning circuits 204-1 through 204-257 having a half-bit structure (hereinafter referred to as "half-bit scanning circuits"), which sequentially shift a pulse signal inputted from an input terminal a or an input terminal b in synchronization with a clock signal; NAND gate circuits 205-1 through 205-1024, which receive signals P1, P2, . . . , P256 outputted by the half-bit scanning circuits 204-1 through 204-257 and control signals G1, G2, . . . , G8; and output buffers 206, which receive signals outputted by the NAND gate circuits 205-1 through 205-1024.

In the foregoing conventional liquid crystal display device, four NAND gate circuits 205 are connected to each half-bit scanning circuit 204-1 through 204-257, and every eight adjacent NAND gate circuits 205 receive different respective control signals G1 through G8.

Further, each of the half-bit scanning circuits 204-1 through 204-257 is capable of bi-directional scanning. Accordingly, a pulse signal is inputted from the input terminal a when scanning in one direction, and from the input terminal b when scanning in the other direction.

The half-bit scanning circuits 204-1 through 204-257 are circuits driven by two clock signals of different respective phase. Consequently, the number of driving signals necessary to drive the half-bit scanning circuits 204-1 through 204-257, including the pulse signal inputted when scanning in the other direction, are two clock signals and two input signals, or a total of four signals. Further, when the control signals G1 through G8 for the NAND gate circuits 205-1 through 205-1024 are included, the total number of driving signals inputted to the vertical drive circuit 202 is 12 signals. This number of signals does not change even when the number of scanning lines exceeds 1,024.

FIG. 32 shows one example of a driving method for the conventional liquid crystal display device shown in FIG. 31. The following will explain, with reference to FIG. 32, a method of driving the conventional liquid crystal display device shown in FIG. 31.

First, as shown in FIG. 32, a clock signal CLK having a clock cycle of 8T (T being a scanning line selection period) and an input pulse signal VSTa from the input terminal a having a pulse width of 8T are sent to the half-bit scanning circuits 204-1 through 204-257 with the timings shown in the Figure, and thus the input pulse signal VSTa is sequentially shifted in synchronization with the clock signal CLK.

Consequently, the signals P1 through P256 outputted by the respective half-bit scanning circuits 204-1 through 204-257, as shown in the Figure, are pulse signals having a pulse width of 8T and phases sequentially shifted 4T each.

Meanwhile, as the control signals G1 through G8, pulse signals having a pulse width of T, a pulse cycle of 8T, and phases sequentially shifted T each are sent to the NAND gate circuits 205-1 through 205-1024 with the timings shown in the Figure. As a result, signals GP1 through GP1024 outputted by the respective output buffer circuits 206 are pulse signals having a pulse width of T and phases sequentially shifted T each.

The foregoing driving method explains signals used in sequential scanning.

Further, there is also a demand for liquid crystal display devices which are freely capable of enlarged display of images having fewer pixels than the liquid crystal display device. Such liquid crystal display devices are usually realized by modifying the structure of the vertical drive circuit or the driving method.

Further, when displaying an image having fewer pixels than the liquid crystal display device, in order to show black display in unused areas above, below, to the right, and to the left of the area used for liquid crystal display, it is necessary to perform writing of black display to the pixels of the unused areas during a blanking period.

Further, in liquid crystal projector devices, which in recent years are seeing increased use as large-screen displays, presentation displays, etc., it is necessary for one of the three liquid crystal panels corresponding to R, G, and B to reverse its display using a mirror, because of differences in reflection of light transmitted through the liquid crystal display device and in the number of times the light is refracted. In addition, there is a demand for flexible liquid crystal display devices capable of both front and rear projection, and of both floor mounting and ceiling suspension. For these reasons, the scanning circuits provided in both the vertical and horizontal drive circuits must be capable of bi-directional scanning.

One example of a horizontal drive circuit in a conventional liquid crystal display device is the horizontal drive circuit in the liquid crystal display device disclosed in Japanese Unexamined Patent Publication No. 8-122748/1996 (Tokukaihei 8-122748).

The following will explain in detail specific examples of a liquid crystal display device and a driving method disclosed in the foregoing publication. As shown in FIG. 33, this conventional liquid crystal display device includes an active matrix array 301 made up of TFTs provided at each intersection between scanning lines and signal lines, a vertical drive circuit 302 for driving the scanning lines, and a horizontal drive circuit 303 for driving the signal lines. As shown in the Figure, the horizontal drive circuit 303 includes a horizontal scanning circuit 304 and sample holding switches 308, which are controlled by signals outputted by the horizontal scanning circuit 304. Here, control terminals of every 16 adjacent sample holding switches 308 are connected together, and input terminals of every 16th sample holding switch 308 are connected together. By inputting video signals S1 through S16, developed into 16 phases, to the input terminals of each group of 16 adjacent sample holding switches 308, 16 video signals are successively written via each group of 16 adjacent sample holding switches 308 selected in succession. Sample holding capacitances 309 hold a video signal written into a data bus line, and are holding capacitances for writing the held voltage into the pixels.

In this example of the foregoing conventional structure, there are 1,280 signal lines, and video signals developed into 16 phases are inputted. In this case, as shown in FIG. 33, a horizontal scanning circuit 304 of 80 bits is needed.

In the foregoing conventional liquid crystal display device, as shown in FIG. 33, the horizontal scanning circuit 304 is made up of 20 scanning circuits 305-1 through 305-21 having a half-bit structure (hereinafter referred to as "half-bit scanning circuits"), which sequentially shift a pulse signal inputted from an input terminal 310 in synchronization with a clock signal; NAND gate circuits 801-1 through 801-80, which receive signals P1, P2, . . . , P20 outputted by the half-bit scanning circuits 305-1 through 305-21 and control signals D1 through D8; and inverse output buffers 802-1 through 802-80, which receive signals outputted by the NAND gate circuits 801-1 through 801-80.

Four NAND gate circuits 801 are connected to and receive the output of each half-bit scanning circuit 305-1 through 305-21, and every eight adjacent NAND gate circuits 801 receive different respective control signals D1 through D8.

Further, each of the half-bit scanning circuits 305-1 through 305-21 is capable of bi-directional scanning. Accordingly, a pulse signal is inputted from the input terminal 310 when scanning in one direction, and from the input terminal 311 when scanning in the other direction.

The half-bit scanning circuits 305-1 through 305-21 are circuits driven by two clock signals of different respective phases. Accordingly, the number of driving signals necessary to drive the half-bit scanning circuits 305-1 through 305-21, including the pulse signal inputted when scanning in the other direction, are two clock signals and two input signals, or a total of four signals. Further, when the control signals D1 through D8 for the NAND gate circuits 801-1 through 801-80 are included, the total number of driving signals inputted to the horizontal scanning circuit 304 is 12 signals.

The foregoing conventional example is structured so that there are 20 half-bit scanning circuits, and so that the output of each half-bit scanning circuit is sent to four NAND gate circuits. However, it is also possible to use a structure of 10 half-bit scanning circuits, the output of each of which is sent to eight NAND gate circuits.

FIG. 34 shows a method of driving the foregoing conventional liquid crystal display device, showing one example of a driving method for writing video signals into data bus lines using the liquid crystal display device shown in FIG. 33. The following will explain this conventional driving method with reference to FIG. 34.

First, a clock signal CLK having a clock cycle of 8T (T being a sample holding switch sampling period) and an input pulse signal VSTa from the input terminal 310 having a pulse width of 8T are sent to the half-bit scanning circuits 305-1 through 305-21 with the timings shown in FIG. 34, and thus the input pulse signal VSTa is sequentially shifted in synchronization with the clock signal CLK. Consequently, signals P1 through P20 outputted by the respective half-bit scanning circuits 305-1 through 305-21, as shown in the Figure, are pulse signals having a pulse width of 8T and phases sequentially shifted 4T each. The scanning circuits are generally driven using two clock signals of different respective phases.

Meanwhile, as the control signals D1 through D8, pulse signals having a pulse width of T and a pulse cycle of 8T are sent to the NAND gate circuits 801-1 through 801-80 with the timings shown in the Figure. As a result, signals SP1 through SP80 outputted by the respective NAND gate circuits 801-1 through 801-80 are sampling pulses having a pulse width of T and phases sequentially shifted T each. The 16 adjacent sample holding switches 308 sampled by one of the sampling pulses SP1 through SP80 sample the 16 phases of parallel data signals S1 through S16 at the timings t1, t2, t3, . . . , t80, when the sampling pulse drops (as shown in the Figure), thus writing video signals into the data bus lines.

By means of the driving method explained above, the video signals can be written into the data bus lines.

In the foregoing conventional example, since each of the outputs P1 through P20 from the scanning circuits is sent to four NAND gate circuits, there are eight control signals, but if, for example, eight NAND gate circuits were connected to the output P1, 16 control signals would be necessary.

The more logic gate circuits connected to each output from the scanning circuits, the more control signals necessary. These control signals must be produced by an external circuit. With the foregoing conventional liquid crystal display device and driving method, among the driving signals inputted to the drive circuit, eight are control signals, and these control signals must be produced by an external circuit.

Further, each control signal requires one line for conducting the control signal from an input pad to the interior of the drive circuit. In the foregoing example, eight lines are required for conducting the control signals from the input pad to the interior of the drive circuit. Consequently, the surface area needed for these lines is increased, and since the input pad for input of the control signals is provided on the substrate, the surface area needed for the pad is also increased. Accordingly, the surface area of a glass substrate required for one liquid crystal device is increased, which reduces the number of liquid crystal panels which can be run from a common glass substrate.

Another problem is that increase in the number of input pads is one cause of reduced production efficiency when connecting the pads to an external flexible substrate.

SUMMARY OF THE INVENTION

It is an object of the present invention to provide a liquid crystal display device and a driving method therefor which use a small number of driving signals for operating the liquid crystal display device, and which are capable of improving production efficiency.

In order to attain the foregoing object, a liquid crystal display device according to the present invention includes an active matrix array made up of switching elements provided at each intersection between a plurality of scanning lines and a plurality of signal lines, and driving means for driving the active matrix array, in which the driving means include:

scanning circuits N in number (N being a positive integer), which receive a start pulse, and which output respective pulse signals sequentially shifted by one-half of a clock signal cycle for each scanning circuit;

first logic gate circuits N×M in number (M being an integer no less than 2), each provided with a first control terminal and a second control terminal, every M adjacent first logic gate circuits being connected together via the first control terminals thereof, which receive a signal from one of the N scanning circuits, and every Mth first logic gate circuit being connected together via the second control terminals thereof, which receive one of M kinds of second control signal;

second logic gate circuits, each of which receives an output from one of the first logic gate circuits and, via a third control terminal, one of two kinds of third control signal.

In the liquid crystal display device structured as above, the control signals inputted into the driving means are the start pulse and the clock signal inputted into the first of the N scanning circuits (N being a positive integer), the M kinds of second control signal inputted into the N×M first logic gate circuits, and the two kinds of third control signal sent to the second logic gate circuits.

In the conventional structure, since a different kind of signal was sent to every 2Mth first logic gate circuit, at least 2M control lines were necessary for input to the first logic gate circuits. This increased the number of control lines for input to the driving means, which increased the surface area used for input pads, and since the control lines themselves had to be conducted to the driving means, the surface area devoted thereto in the circuit layout was also increased.

In contrast, with the liquid crystal display device according to the present invention, structured as above, the second control terminals of every Mth first logic gate circuit are connected together. For this reason, the number of second control signals required are M kinds, or half as many as conventionally.

Further, lines are dispersed between the first and second logic gate circuits, thus preventing concentration of control lines.

In other words, by reducing the number of control terminals, the surface area devoted to the drive circuit and to input pads can be reduced, and accordingly, when running a plurality of liquid crystal display devices from a common substrate, more elements can fit on one substrate, thus increasing the number of panels.

Further, since the surface area devoted to the drive circuit and input pads is reduced, the size of the peripheral area surrounding the display section of the liquid crystal display device is reduced, and installation in a personal computer, etc. is facilitated.

In addition, by increasing the number of outputs from each scanning circuit to the logic gate circuits so that the output of each scanning circuit is inputted into a plurality of logic gate circuits, the number of scanning circuits can be reduced. Particularly in high-definition liquid crystal display devices, layout of each scanning circuit within the small pixel pitch is difficult, but with the foregoing structure according to the present invention, layout can be simplified.

As a result, it is possible to provide a liquid crystal display device which is operated by a small number of driving signals, and which is capable of improving production efficiency.

The foregoing driving means may be a vertical drive circuit for driving the foregoing plurality of scanning lines.

Alternatively, the foregoing driving means may be a horizontal drive circuit, which may include sample holding switches.

The liquid crystal display device according to the present invention may be driven using sequential scanning, interlace scanning, or two-line simultaneous scanning.

Additional objects, features, and strengths of the present invention will be made clear by the description below. Further, the advantages of the present invention will be evident from the following explanation in reference to the drawings.

DESCRIPTION OF THE EMBODIMENTS

[First Embodiment]

Figure 1:
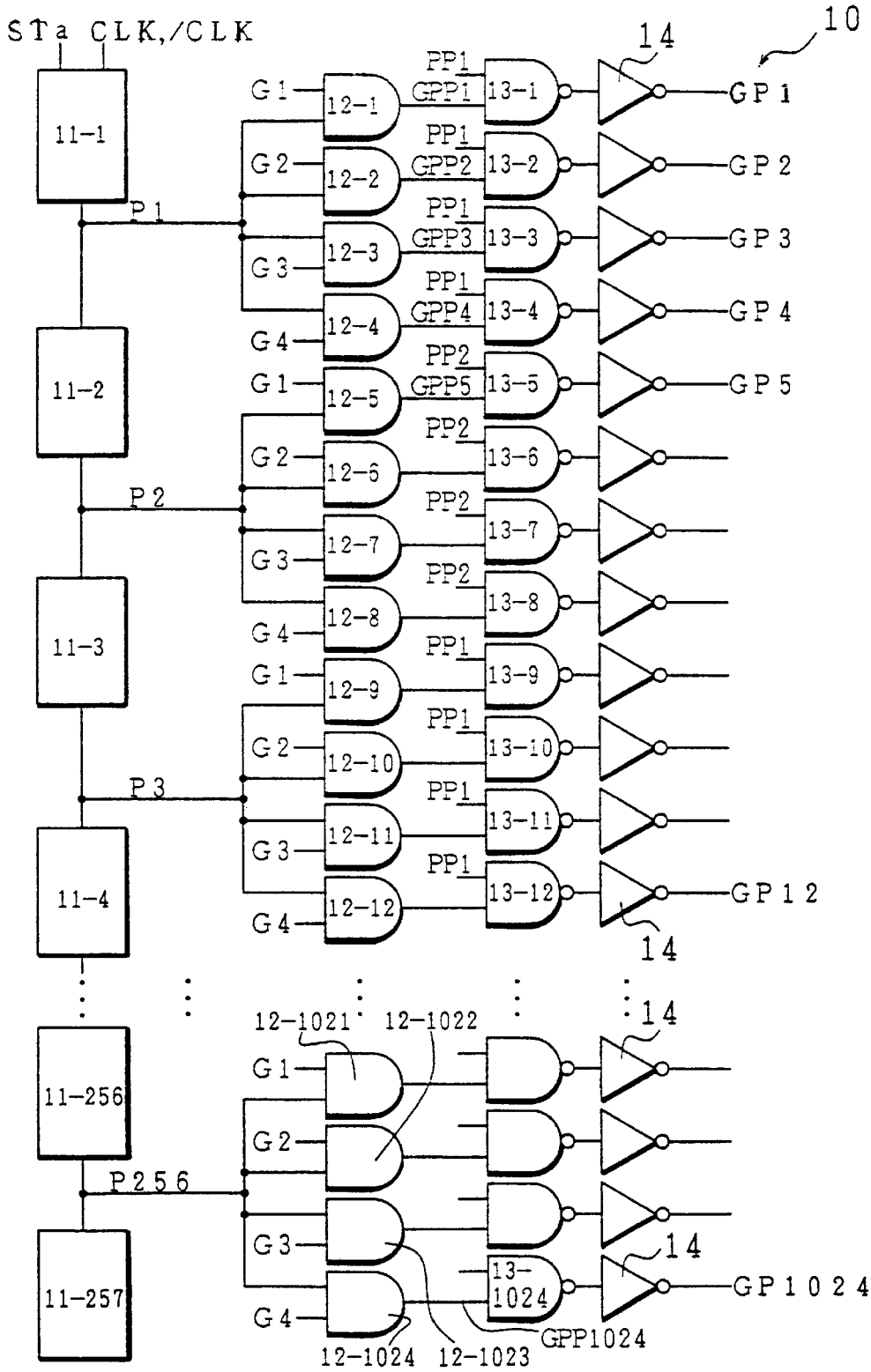
FIG. 1 is a block diagram showing the structure of a vertical drive circuit of a liquid crystal display device according to one embodiment of the present invention.
Figure 2:
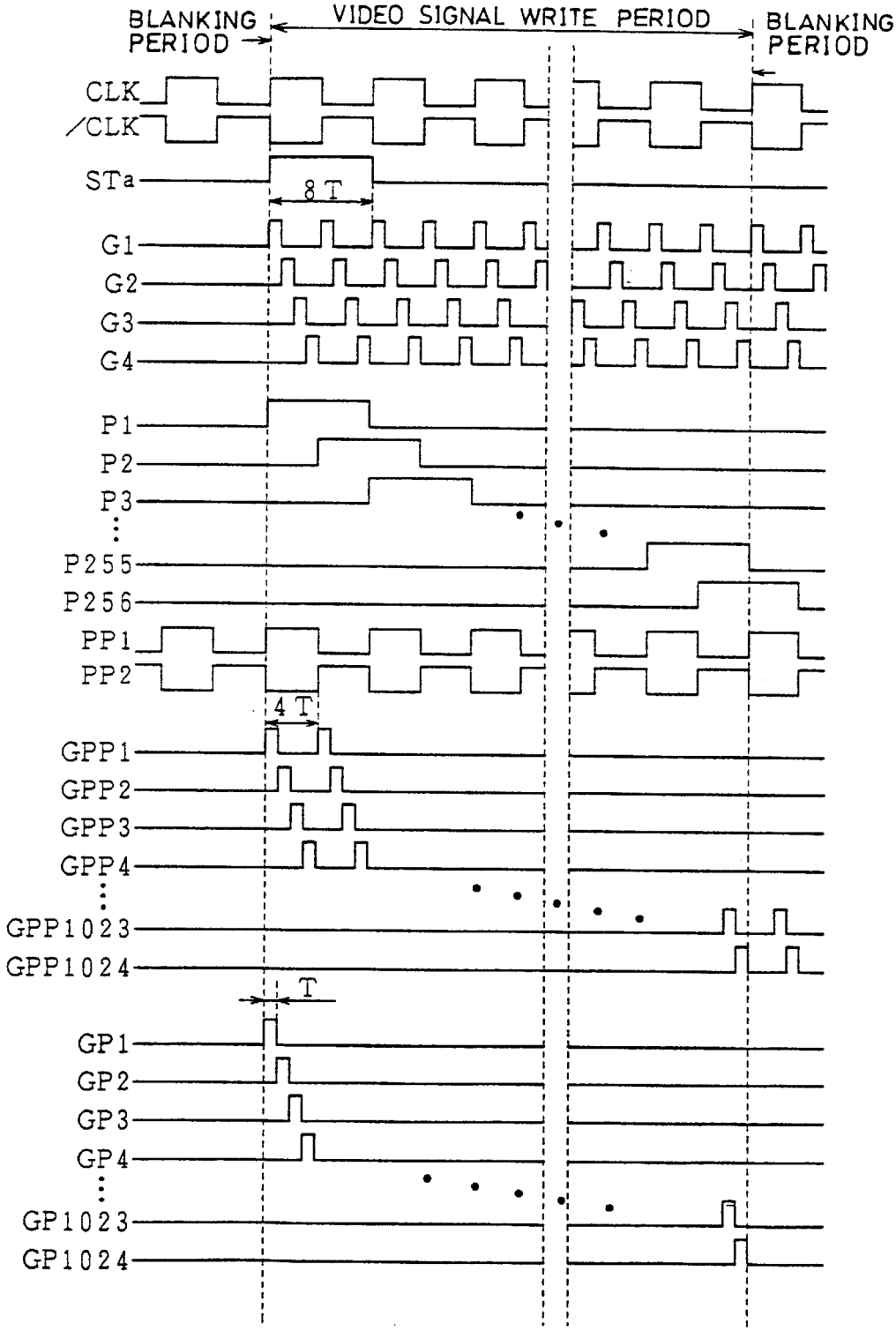
FIG. 2 is a timing chart showing a driving method for the foregoing vertical drive circuit.
Figure 3:
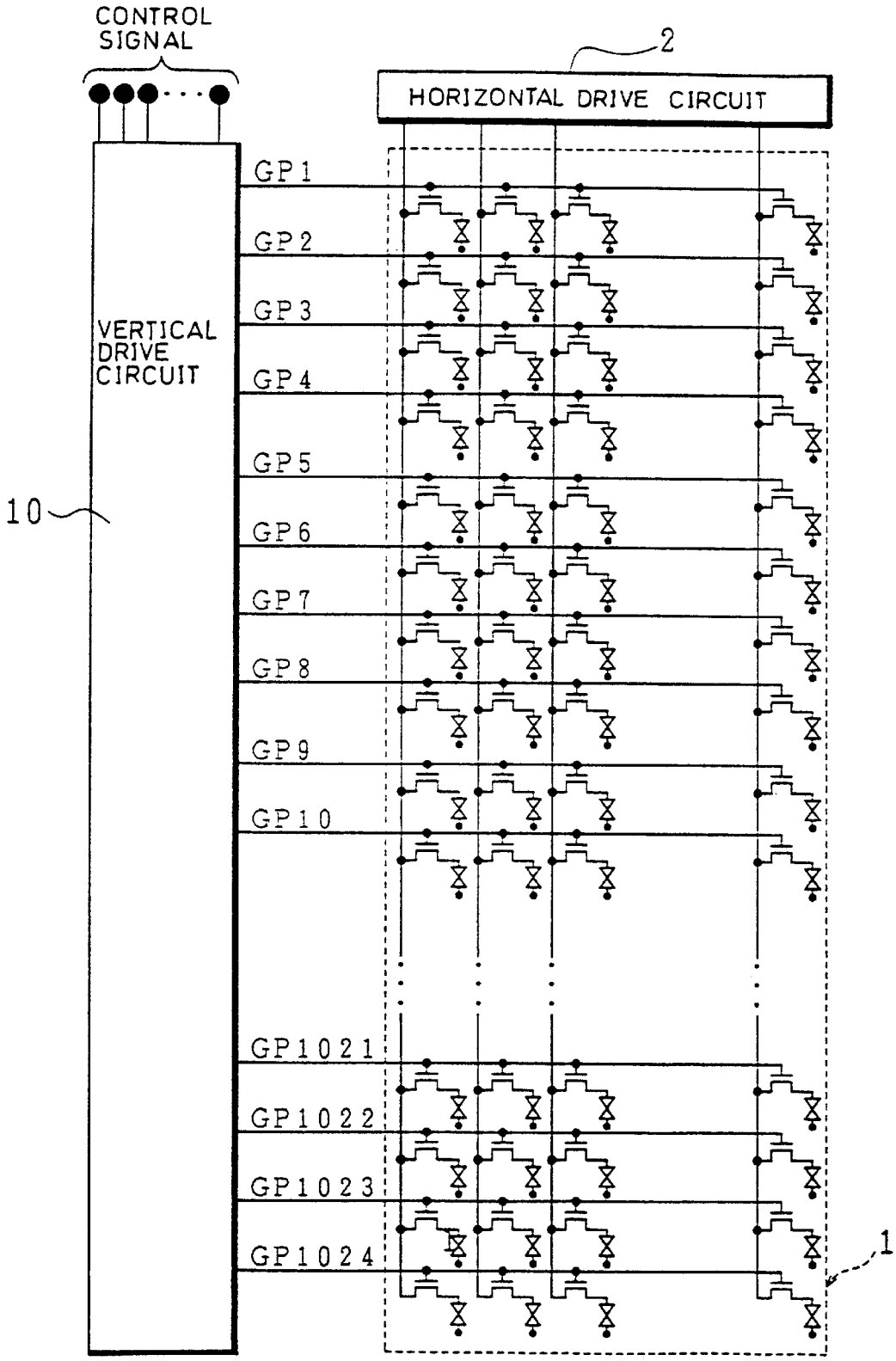
FIG. 3 is a drawing showing-the overall structure of the foregoing liquid crystal display device.

The following will explain one embodiment of the present invention with reference to FIGS. 1 through 3.

In the present embodiment, the liquid crystal display device used is of the active matrix type. As shown in FIG. 3, this liquid crystal display device includes an active matrix array 1 made up of TFTs (switching elements) provided at each intersection between scanning lines and signal lines, a horizontal drive circuit 2 for driving the signal lines, and a vertical drive circuit 10 for driving the scanning lines. In the liquid crystal display device according to the present embodiment, there are 1,024 scanning lines, but the number of scanning lines is not necessarily limited to this.

As shown in FIG. 1, the vertical drive circuit 10 (driving means) of the foregoing liquid crystal display device is made up of a plurality of scanning circuits 11-1 through 11-257 having a half-bit structure (hereinafter referred to as "half-bit scanning circuits"), each of which sequentially shifts a start pulse STa by one-half pulse in synchronization with a clock signal CLK; AND gate circuits 12-1 through 12-1024 (first logic gate circuits), which receive signals P1, P2, . . . , P256 outputted by the half-bit scanning circuits 11-1 through 11-257; NAND gate circuits 13-1 through 13-1024 (second logic gate circuits), which receive signals GPP1, GPP2, . . . , GPP1024 outputted by the AND gate circuits 12-1 through 12-1024; and output buffers 14, which receive signals outputted by the NAND gate circuits 13-1 through 13-1024, and which output signals GP1, GP2, . . . , GP1024. In the present embodiment, each NAND gate circuit 13-1 through 13-1024 and the output buffer 14 connected thereto collectively make up each second logic gate circuit.

There are 256 half-bit scanning circuits 11-1 through 11-257 (here, N=256, N being a positive integer) plus an additional scanning circuit 11-257. The final half-bit scanning circuit 11-257 functions as a terminating set, and output is not retrieved therefrom.

To the half-bit scanning circuit 11-1 are inputted the start pulse STa, the clock signal CLK, and an inverted clock signal/CLK.

Each of the AND gate circuits 12-1 through 12-1024 is provided with a first control terminal and a second control terminal as input terminals.

The first control terminals of every four (here, M=4, M being an integer no less than 2) adjacent AND gate circuits 12-1 through 12-1024 are connected together, and each group of four interconnected first control terminals is connected to an output terminal of one of the half-bit scanning circuits 11-1 through 11-256. As a result, each of the signals P1, P2, . . . , P256 outputted by the half-bit scanning circuits 11-1 through 11-256, respectively, is sent to four adjacent AND gate circuits 12-1 through 12-1024, through the first control terminals thereof.

There are 1,024, or 256×4 (N×M) AND gate circuits 12-1 through 12-1024. Thus they correspond to the 1,024 scanning lines.

Further, the second control terminal of each AND gate circuit 12-1 through 12-1024 receives an external second control signal G1, G2, G3, or G4.

In other words, the second control terminals of M AND gate circuits 12-1 through 12-1024 generally receive M kinds of signal, and since M=4 in the present embodiment, every four adjacent AND gate circuits 12-1 through 12-1024 receive the second control signals G1, G2, G3, and G4, respectively. In other words, every fourth AND gate circuit 12-1 through 12-1024 receives the same second control signal. Further, the second control terminals receiving the second control signal G1 are connected together, those receiving the second control signal G2 are connected together, those receiving the second control signal G3 are connected together, and those receiving the second control signal G4 are connected together.

The NAND gate circuits 13-1 through 13-1024 receive signals GPP1, GPP2, . . . , GPP1024 outputted by the AND gate circuits 12-1 through 12-1024, respectively, and each also receives one of two third control signals PP1 and PP2.

In the present embodiment, the third control signals PP1 and PP2 are sent to alternating groups of four adjacent NAND gate circuits 13-1 through 13-1024. In other words, the first four adjacent NAND gate circuits 13-1 through 13-4 receive the third control signal PP1, and the second four adjacent NAND gate circuits 13-5 through 13-8 receive the third control signal PP2. The next four adjacent NAND gate circuits 13-9 through 13-12 receive the third control signal PP1, and the next four adjacent NAND gate circuits 13-13 through 13-16 receive the third control signal PP2. Thereafter, groups of four adjacent NAND gate circuits 13 receiving the third control signal PP1 alternate with groups of four adjacent NAND gate circuits 13 receiving the third control signal PP2.

Signals outputted by the NAND gate circuits 13-1 through 13-1024 are inverted by the output buffer circuits 14 and outputted to the respective scanning lines as signals GP1, GP2, . . . , GP1024.

Figure 31:
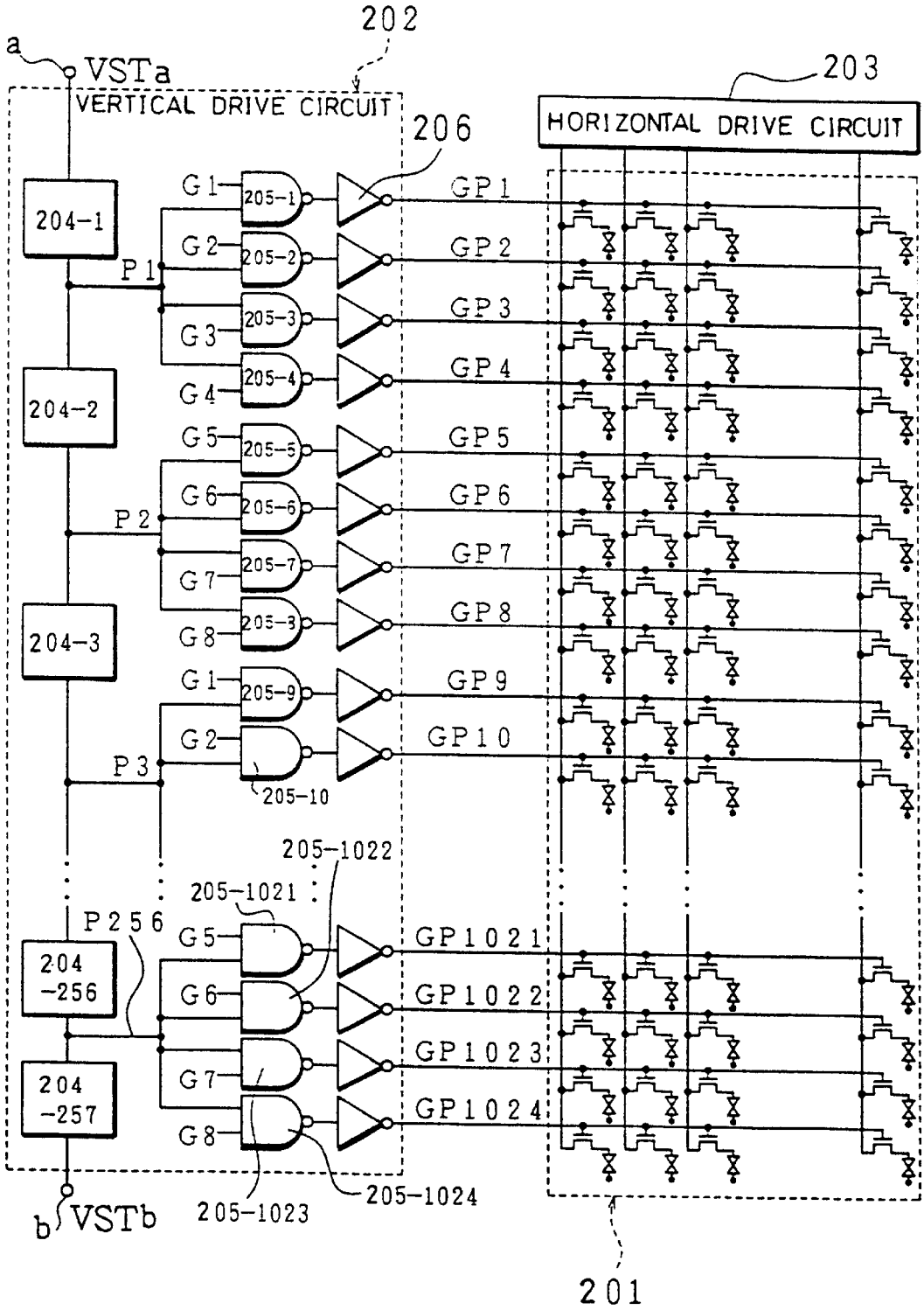
FIG. 31 (Prior Art)
FIG. 31 is a drawing showing the overall structure of a conventional liquid crystal display device.
Figure 32:
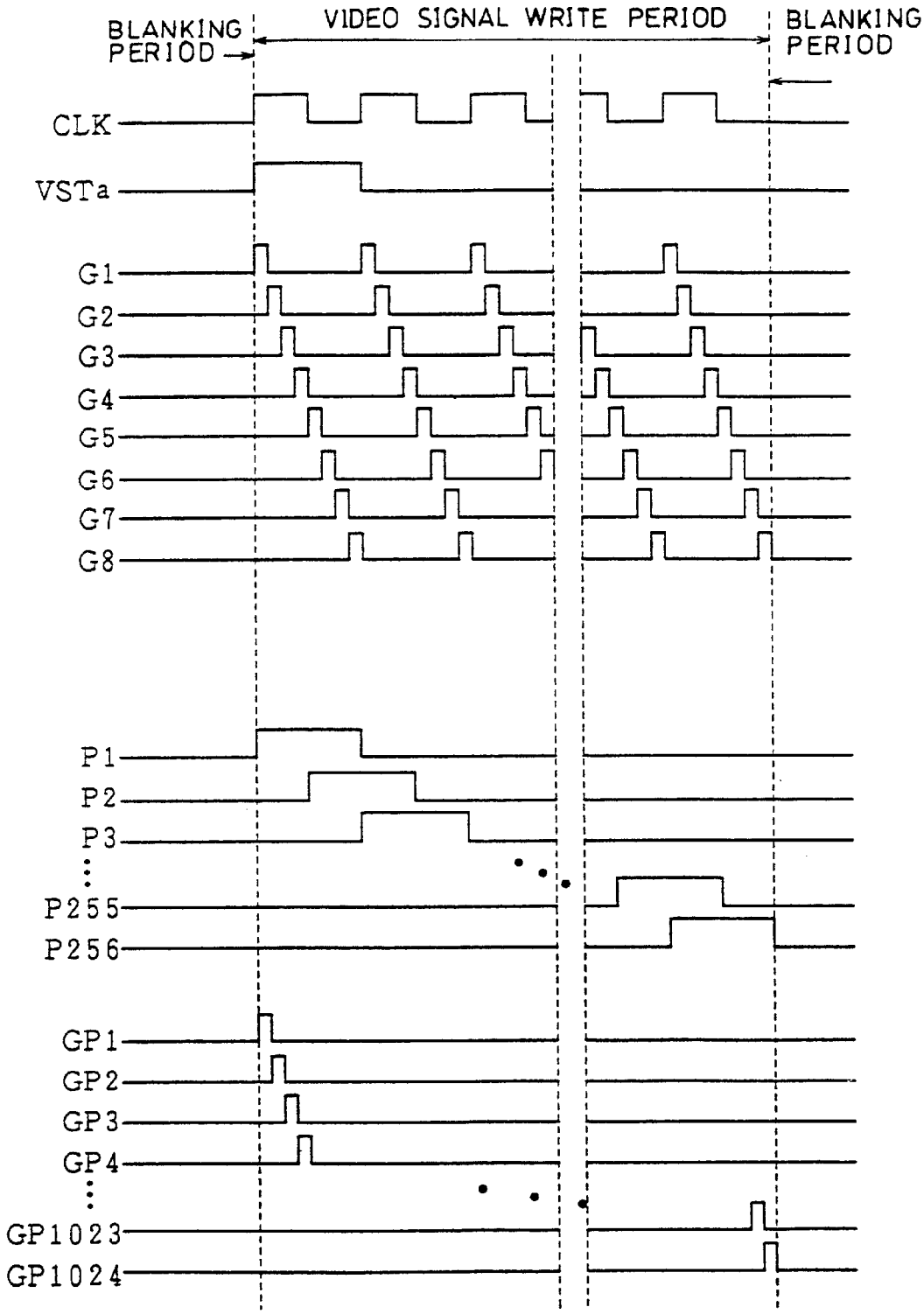
FIG. 32 (Prior Art)
FIG. 32 is a timing chart showing a driving method for a vertical drive circuit of the foregoing conventional liquid crystal display device.

In other words, in the vertical drive circuit 10, by replacing the NAND gate circuits 205-1 through 205-1024 shown in FIG. 31 with a combination of the AND gate circuits 12-1 through 12-1024 and the NAND gate circuits 13-1 through 13-1024, the number of control signals for the AND gate circuits 12-1 through 12-1024 can be reduced to half as many as conventionally. Incidentally, the present embodiment uses a combination of the AND gate circuits 12-1 through 12-1024 and the NAND gate circuits 13-1 through 13-1024, but there is no limitation to this structure. Any circuit structure may be used which fulfills an equivalent function. For example, a structure may be used in which inverted pulses outputted by the half-bit scanning circuits 11-1 through 11-257 and inverted control signals are sent to NOR gate circuits. This also holds true for the other embodiments to be discussed below.

A driving method for the liquid crystal display device structured as above is explained in the timing chart in FIG. 2, which shows sequential scanning. Sequential scanning is a method in which the lines are scanned sequentially, regardless of whether they are odd-numbered or even-numbered lines.

First, if T is a scanning line selection period, a start pulse STa having a pulse width of 8T and a clock signal CLK and an inverse clock signal/CLK each having a cycle of 8T are inputted to the half-bit scanning circuits 11-1 through 11-257. As a result, the half-bit scanning circuits 11-1 through 11-257 produce signals P1 through P256.

At this time, in the present embodiment, four second control signals G1 through G4, shown in the Figure, are used as control signals for the AND gate circuits 12-1 through 12-1024. Accordingly, there are only half as many of these control signals as in the conventional structure.

Incidentally, in the present embodiment, as shown in the Figure, pulses of the second control signals G1 through G4 are also produced during a blanking period immediately following the video signal write period, but there is no limitation to this; these pulses need not be produced during the blanking period.

After receiving the signals P1 through P256 and the second control signals G1 through G4, two output pulses appear in each of the signals GPP1 through GPP1024 outputted by the AND gate circuits 12-1 through 12-1024, as shown in the Figure. These two output pulses are sent to the NAND gate circuits 13-1 through 13-1024. At this time, a third control signal PP1 is sent to the NAND gate circuits 13-1 through 13-4, 13-9 through 13-12, . . . , which receive the output of the odd-numbered half-bit scanning circuits 11-1, 11-3, 11-5 . . . , and a third control signal PP2 is sent to the NAND gate circuits 13-5 through 13-8, 13-13 through 13-16, . . . , which receive the output of the even-numbered half-bit scanning circuits 11-2, 11-4, 11-6. . . .

As the third control signal PP1, the clock signal CLK inputted into the half-bit scanning circuits 11-1 through 11-257 may be used, and as the third control signal PP2, the inverted clock signal/CLK may be used. For this reason, there is no need to produce further control signals, nor to provide further input terminals for input of external signals.

In this way, the respective signals outputted by the NAND gate circuits 13-1 through 13-1024 and the respective signals GP1 through GP1024 outputted by the output buffer circuits 14 include pulses having a pulse width of T and phases sequentially shifted by T each. Thus each scanning line can be scanned in sequence.

By means of the signals GP1, GP2, . . . , GP1024 outputted by the vertical drive circuit 10, and signals outputted by the horizontal drive circuit 2 to the respective signal lines, an ON/OFF signal can be supplied to the TFT provided at each intersection of the scanning lines and signal lines of the active matrix array 1, and thus display can be performed in each pixel of the screen of the liquid crystal display device.

As a result, reduction of the number of signal lines can contribute to reduction of the size and cost of the liquid crystal display device.

In this way, with the liquid crystal display device and driving method according to the present embodiment, when the 256 half-bit scanning circuits 11-1 through 11-257 of the vertical drive circuit 10 receive the start pulse STa, the half-bit scanning circuits 11-1 through 11-257 output the signals P1, P2, . . . , P256, which are pulse signals having phases sequentially shifted by one-half of the cycle of the clock signal CLK, which is (2×4×T).

These pulse signals are sent to the first control terminals of the AND gate circuits 12-1 through 12-1024, which are (256×4) in number.

Here, of the (256×4=1,024) AND gate circuits 12-1 through 12-1024, the first control terminals of every four adjacent AND gate circuits 12-1 through 12-1024 are connected together. Thus the pulse signal outputted by each of the half-bit scanning circuits 11-1 through 11-257 is sent to four AND gate circuits 12-1 through 12-4, 12-5 through 12-8, . . . , 12-1021 through 12-1024.

Further, the second control terminals of every four adjacent AND gate circuits 12-1 through 12-1024 receive different respective second control signals G1 through G4 as second inputs. Each of the second control signals G1 through G4 is made up of pulses having a cycle of 4T and a pulse width of T.

Consequently, each of the AND gate circuits 12-1 through 12-1024 produces two pulses having a pulse width of T, produced ((4−1)×T) apart from each other.

Next, each of the NAND gate circuits 13-1 through 13-1024 receives the foregoing two pulses and one of two third control signals PP1 and PP2, and then the NAND gate circuits 13-1 through 13-1024 and the output buffers 14 output signals having a pulse width of T.

Accordingly, by sending these signals of pulse width T to the scanning lines in sequence, in combination with signals sent to the signal lines by the horizontal drive circuit 2, each TFT of the active matrix array 1 can be ON/OFF controlled, thus performing display in each pixel of the screen of the liquid crystal display device.

In the conventional structure, since different signals were sent to every 8 (=2×4) NAND gate circuits 205-1 through 205-1024 (see FIG. 31), at least 8 (=2×4) control lines were necessary for the NAND gate circuits 205-1 through 205-1024. This increased the number of control lines for input to the vertical drive circuit 202, which increased the surface area used for input pads, and since the control lines themselves had to be conducted to the vertical drive circuit 202, the surface area devoted thereto in the circuit layout was also increased.

However, in the present embodiment, the control signals inputted to the vertical drive circuit 10 are the start pulse STa, the clock signal CLK, and the inverted clock signal/CLK inputted to the first half-bit scanning circuit 11-1; the four second control signals G1 through G4 sent to the 1,024 (=256×4) AND gate circuits 12-1 through 12-1024; and the two third control signals PP1 and PP2 sent to the NAND gate circuits 13-1 through 13-1024. In other words, the second control terminals of every fourth AND gate circuit 12-1 through 12-1024 are connected together. For this reason, there are four kinds of second control terminal, or half as many as conventionally.

Further, lines are dispersed between the AND gate circuits 12-1 through 12-1024 and the NAND gate circuits 13-1 through 13-1024, thus preventing concentration of control lines.

In other words, by reducing the number of control terminals, the surface area devoted to the vertical drive circuit 10 and to input pads is reduced, and accordingly, when running a plurality of liquid crystal display devices from a common substrate, more elements can fit on one substrate, thus increasing the number of non-defective panels.

Further, since the surface area devoted to the vertical drive circuit 10 and input pads is reduced, the size of the peripheral area surrounding the display section of the liquid crystal display device is reduced, and installation in a personal computer, etc. is facilitated.

In addition, by sending the output from each half-bit scanning circuit 11-1 through 11-257 to four AND gate circuits 12-1 through 12-4, 12-5 through 8, . . . , 12-1021 through 12-1024, it is possible to use fewer half-bit scanning circuits 11-1 through 11-257 than the required number of scanning lines (1,024). Particularly in high-definition liquid crystal display devices, layout of each scanning circuit within the small pixel pitch is difficult, but in the present embodiment, layout is simplified.

In particular, in the present embodiment, since M=4, thus requiring four inputs for the AND gate circuits 12-1 through 12-1024, it is easy to lay out each of the half-bit scanning circuits 11-1 through 11-257 within the pitch of four pixels.

As a result, it is possible to provide a liquid crystal display device which is operated by a small number of driving signals, and which is capable of improving production efficiency.

Further, in the present embodiment, the clock signal CLK and the inverted clock signal/CLK are used for the third control signals PP1 and PP2. For this reason, there is no need to input further control signals to the vertical drive circuit 10 as the third control signals PP1 and PP2.

In the conventional structure, the number of control lines for input to the vertical drive circuit 202 was increased, which increased the surface area used for input pads, and since the control lines themselves had to be conducted to the vertical drive circuit 202, the surface area devoted thereto in the circuit layout was also increased. However, in the present embodiment, this can be prevented by using existing control lines.

Accordingly, it is possible to provide a liquid crystal display device and a driving method therefor which use a small number of driving signals, and which are capable of improving production efficiency.

[Second Embodiment]

Figure 4:
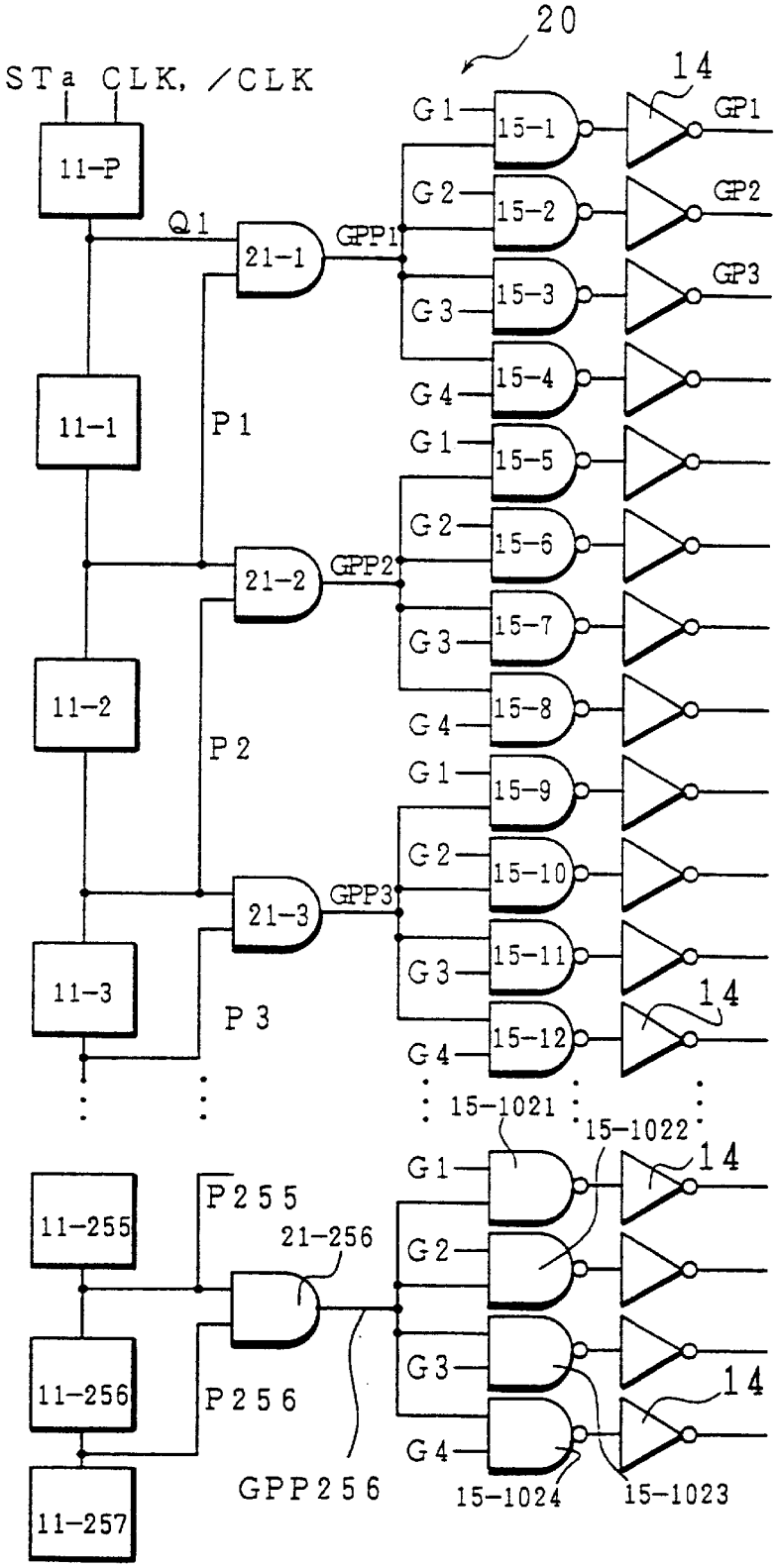
FIG. 4 is a block diagram showing the structure of a vertical drive circuit of a liquid crystal display device according to another embodiment of the present invention.
Figure 5:
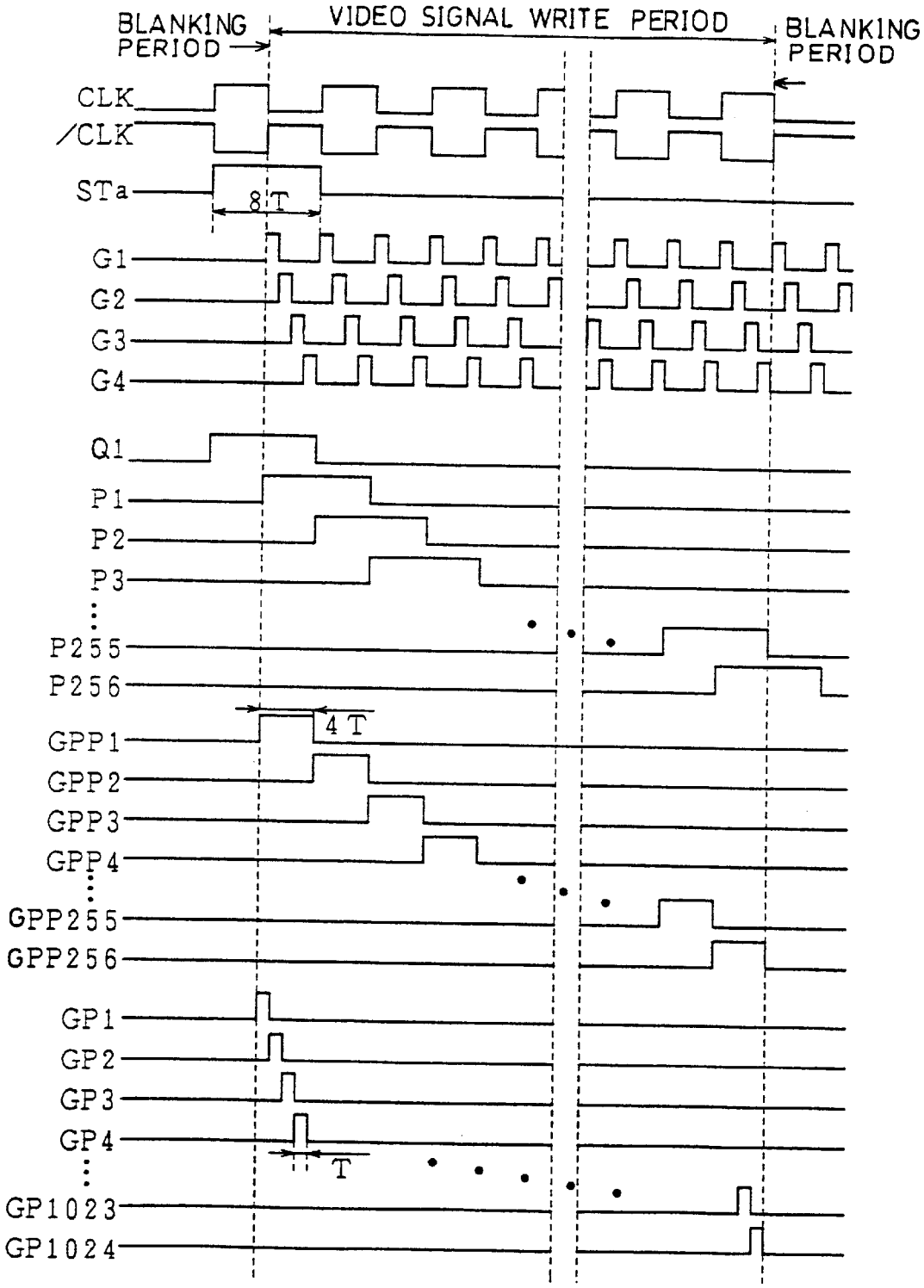
FIG. 5 is a timing chart showing a driving method for the foregoing vertical drive circuit.

The following will explain another embodiment of the present invention with reference to FIGS. 4 and 5. For ease of explanation, members having the same functions as those shown in the drawings pertaining to the first embodiment above will be given the same reference symbols, and explanation thereof will be omitted here.

As shown in FIG. 4, a vertical drive circuit 20 of a liquid crystal display device according to the present embodiment is made up of half-bit scanning circuits 11-P and 11-1 through 11-257, which sequentially shift a start pulse STa by one-half pulse each in synchronization with a clock signal CLK; AND gate circuits 21-1 through 21-256 (fourth logic gate circuits), each of which receives a pair of signals Q1 and P1, P1 and P2, . . . , P255 and P256 outputted by the half-bit scanning circuits 11-P and 11-1 through 11-257; NAND gate circuits 15-1 through 15-1024 (third logic gate circuits), which receive signals GPP1, GPP2, . . . , GPP256 outputted by the AND gate circuits 21-1 through 21-256, and second control signals G1, G2, G3, and G4; and output buffers 14, which receive signals outputted by the NAND gate circuits 15-1 through 15-1024, and which output signals GP1, GP2, . . . , GP1024.

In the present embodiment, each NAND gate circuit 15-1 through 15-1024 and the output buffer 14 connected thereto collectively make up each third logic gate circuit.

Further, the AND gate circuits 21-1 through 21-256, each of which receives pulses outputted by two adjacent half-bit scanning circuits 11-1 through 11-257, function as pulse width reducing means, which reduce the respective pulse widths of the pulses outputted by the half-bit scanning circuits 11-1 through 11-257.

A characteristic feature of the vertical drive circuit 20 is that, by providing the AND gate circuits 21-1 through 21-256 between the half-bit scanning circuits 11-P and 11-1 through 11-257 and the NAND gate circuits 15-1 through 15-1024, the number of second control signals can be reduced to the four second control signals G1 through G4, half as many as conventionally.

Further, each AND gate circuit 21-1 through 21-256 receives signals outputted by two adjacent half-bit scanning circuits 11-P and 11-1 through 11-257. Since the AND gate circuits 21-1 through 21-256 must provide 256 output signals, an extra half-bit scanning circuit 11-P is provided before the half-bit scanning circuit 11-1. Incidentally, the extra half-bit scanning circuit 11-P may instead be provided after the half-bit scanning circuit 11-257.

A driving method for the liquid crystal display device structured as above is explained in the timing chart in FIG. 5, which shows sequential scanning.

First, if T is a scanning line selection period, a start pulse STa having a pulse width of 8T and a clock signal CLK and an inverse clock signal/CLK each having a cycle of 8T are inputted to the half-bit scanning circuits 11-P and 11-1 through 11-257.

As a result, the half-bit scanning circuits 11-P and 11-1 through 11-257 produce signals Q1 and P1 through P256. Then, the signals Q1 and P1, P1 and P2, . . . , P255 and P256 outputted by each pair of adjacent half-bit scanning circuits 11-P and 11-1 through 11-257 are sent to one of the AND gate circuits 21-1 through 21-256, and the AND gate circuits 21-1 through 21-256 output signals GPP1, GPP2, . . . , GPP256 having a pulse width of 4T, which is half of that of the pulses outputted by the half-bit scanning circuits 11-P and 11-1 through 11-257.

Next, the signals GPP1 through GPP256 are sent to the NAND gate circuits 15-1 through 15-1024, and, as control signals for the NAND gate circuits 15-1 through 15-1024, four second control signals G1 through G4, shown in the Figure, are used. Accordingly, there are only half as many of these control signals as in the conventional structure.

In this way, the respective signals outputted by the NAND gate circuits 15-1 through 15-1024 and the respective signals GP1 through GP1024 outputted by the output buffer circuits 14 include pulses having a pulse width of T and phases sequentially shifted by T each. Thus each scanning line can be scanned in sequence.

As a result, reduction of the number of signal lines can contribute to reduction of the size and cost of the liquid crystal display device.

In this way, with the liquid crystal display device and driving method according to the present embodiment, when the extra half-bit scanning circuit 11-P and the 256 half-bit scanning circuits 11-1 through 11-257 of the vertical drive circuit 20 receive the start pulse STa, the half-bit scanning circuits 11-P and 11-1 through 11-257 output the signals Q1, P1, P2, . . . , P256, which are pulse signals having phases sequentially shifted by one-half of the cycle of the clock signal CLK, which is (2×4×T).

These pulse signals are sent to the AND gate circuits 21-1 through 21-256 (pulse width reducing means), which reduce the pulse width of the pulse signals from the half-bit scanning circuits 11-P and 11-1 through 11-257, thereby producing pulses with a pulse width of 4T.

The pulses outputted by the AND gate circuits 21-1 through 21-256 are sent to the first control terminals of the (256×4=1,024) NAND gate circuits 15-1 through 15-1024.

Here, of the (256×4=1,024) NAND gate circuits 15-1 through 15-1024, the first control terminals of every four adjacent NAND gate circuits 15-1 through 15-1024 are connected together. Thus the pulse outputted by each AND gate circuit 21-1 through 21-256 is sent to four NAND gate circuits 15-1 through 15-4, 15-5 through 15-8, 15-1021 through 15-1024.

Further, the second control terminals of every four adjacent NAND gate circuits 15-1 through 15-1024 receive different respective second control signals G1 through G4 as second inputs. The second control signals G1 through G4 are made up of pulses having a cycle of 4T and a pulse width of T.

Consequently, the NAND gate circuits 15-1 through 15-1024 and the output buffers 14 output signals having a pulse width of T.

Accordingly, by sending these signals of pulse width T to the scanning lines in sequence, in combination with signals sent to the signal lines by the horizontal drive circuit 2, each TFT of the active matrix array 1 can be ON/OFF controlled, thus performing display in each pixel of the screen of the liquid crystal display device.

In the conventional structure, since different signals were sent to every 8 (=2×4) NAND gate circuits 205-1 through 205-1024 (see FIG. 31), at least 8 (=2×4) control lines were necessary for the NAND gate circuits 205-1 through 205-1024. This increased the number of control lines for input to the vertical drive circuit 202, which increased the surface area used for input pads, and since the control lines themselves had to be conducted to the vertical drive circuit 202, the surface area devoted thereto in the circuit layout was also increased.

In contrast, in the present embodiment, by providing the AND gate circuits 21-1 through 21-256 (pulse width reducing means), which reduce the pulse width of the pulse signals from the half-bit scanning circuits 11-1 through 11-257, the second control terminals of every fourth NAND gate circuit 15-1 through 15-1024 can be connected together. Accordingly, there are four kinds of second control terminal, or half as many as conventionally.

Further, lines are dispersed between the AND gate circuits 21-1 through 21-256 and the NAND gate circuits 15-1 through 15-1024, thus preventing concentration of control lines.

As a result, it is possible to provide a liquid crystal display device and a driving method therefor which use a small number of driving signals, and which are capable of improving production efficiency.

Further, in the liquid crystal display device according to the present embodiment, in particular, pulse width reducing means, which reduce the pulse width of the pulse signals from the half-bit scanning circuits 11-P and 11-1 through 11-257, are structured as the AND gate circuits 21-1 through 21-256, each of which receives pulses outputted by each pair of adjacent half-bit scanning circuits 11-P and 11-1 through 11-257.

As a result, it is possible to provide with certainty a liquid crystal display device and a driving method therefor which use a small number of driving signals, and which are capable of improving production efficiency.

[Third Embodiment]

Figure 6:
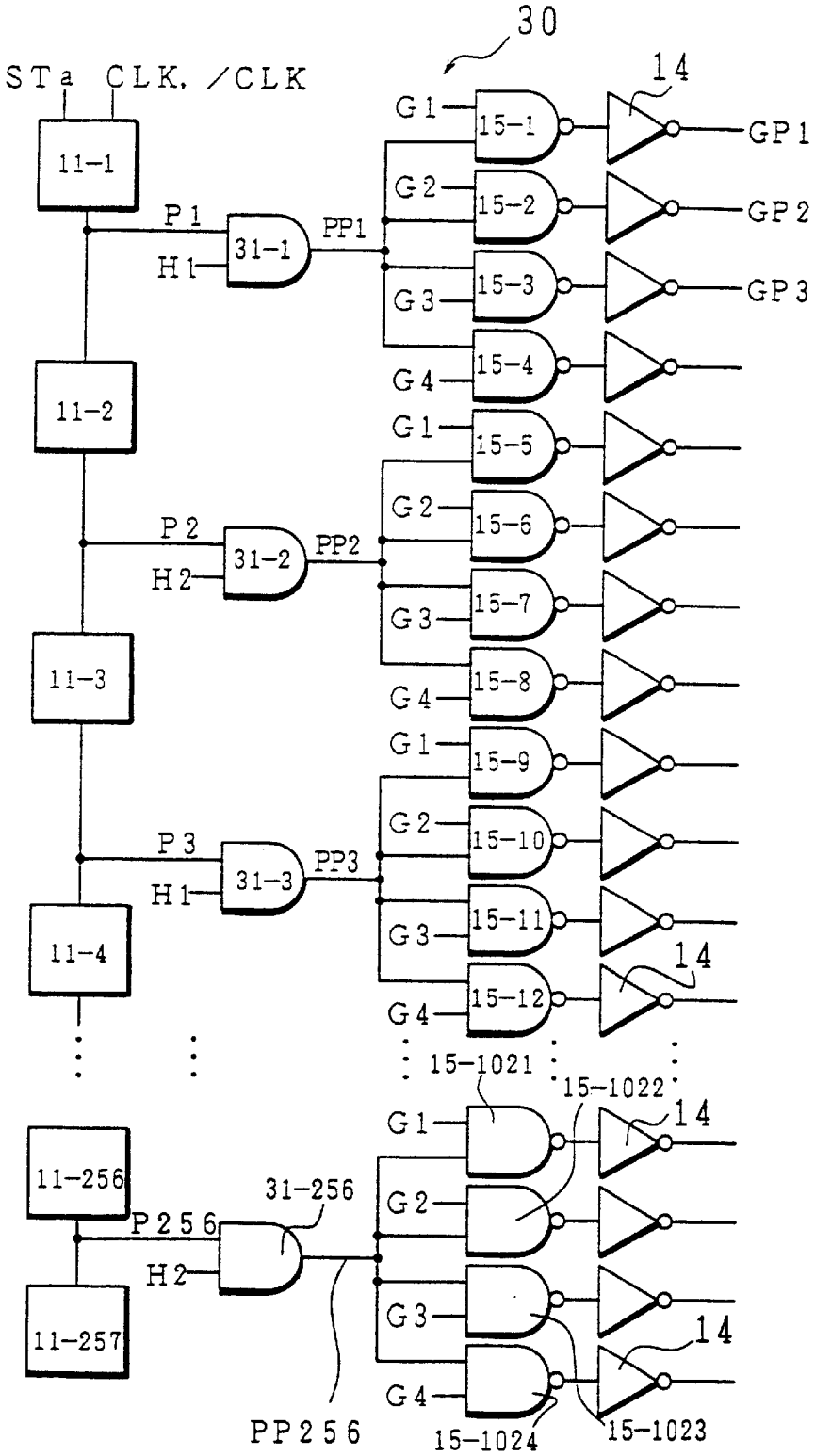
FIG. 6 is a block diagram showing the structure of a vertical drive circuit of a liquid crystal display device according to a further embodiment of the present invention.
Figure 7:
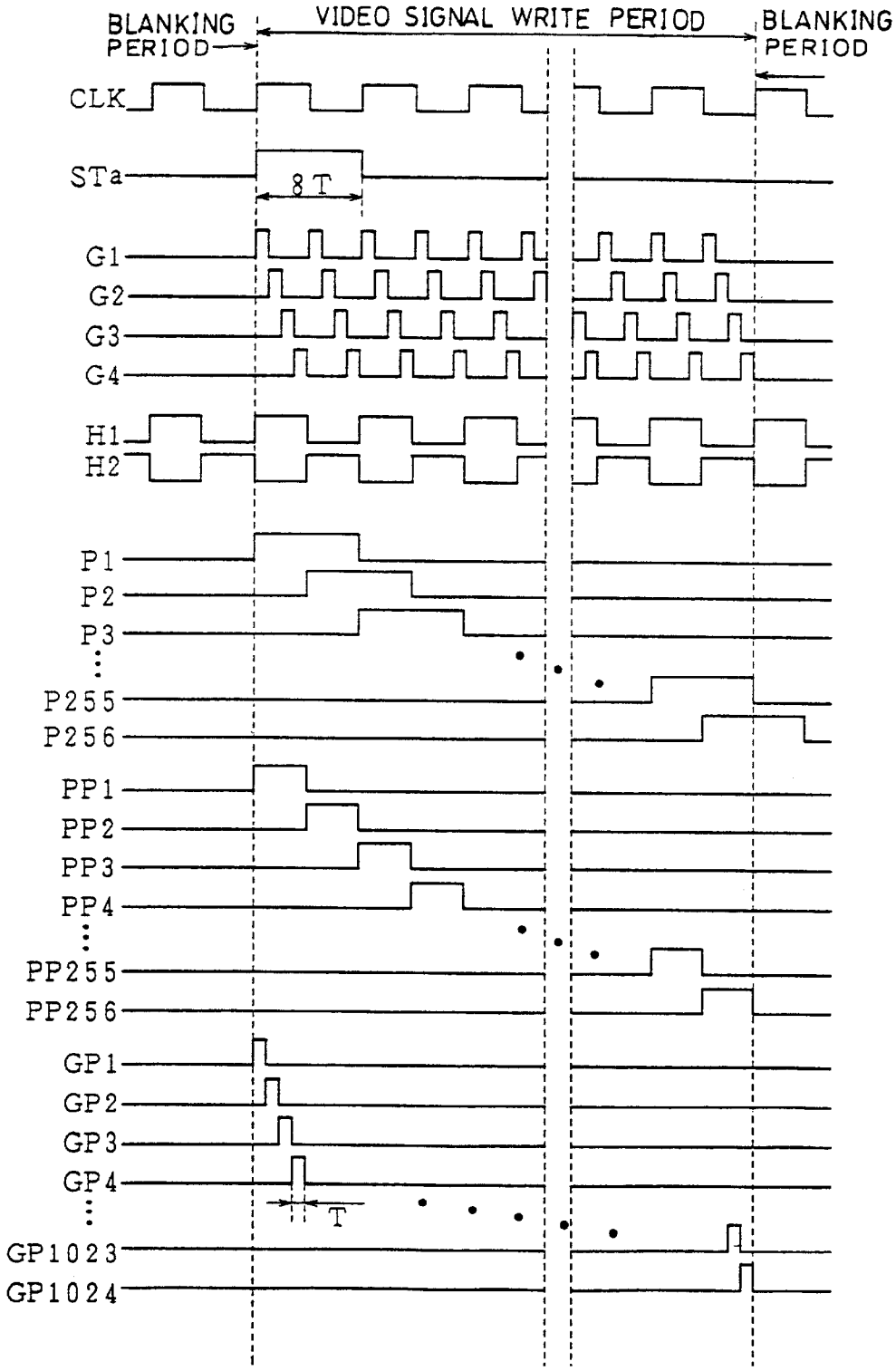
FIG. 7 is a timing chart showing a driving method for the foregoing vertical drive circuit.

The following will explain another embodiment of the present invention with reference to FIGS. 6 and 7. For ease of explanation, members having the same functions as those shown in the drawings pertaining to the first and second embodiments above will be given the same reference symbols, and explanation thereof will be omitted here.

As shown in FIG. 6, a vertical drive circuit 30 of a liquid crystal display device according to the present embodiment is made up of half-bit scanning circuits 11-1 through 11-257, which sequentially shift a start pulse STa by one-half pulse each in synchronization with a clock signal CLK; AND gate circuits 31-1 through 31-256 (pulse width reducing means; fifth logic gate circuits), each of which receives signals P1, P2, . . . , P256 outputted by the half-bit scanning circuits 11-1 through 11-257, and fourth control signals H1 and H2; NAND gate circuits 15-1 through 15-1024, which receive signals PP1, PP2, . . . , PP256 outputted by the AND gate circuits 31-1 through 31-256, and second control signals G1, G2, G3, and G4; and output buffers 14, which receive signals outputted by the NAND gate circuits 15-1 through 15-1024, and which output signals GP1, GP2, . . . , GP1024.

A characteristic feature of the vertical drive circuit 30 is that, by providing the AND gate circuits 31-1 through 31-256, the number of control signals for the NAND gate circuits 15-1 through 15-1024 can be reduced to half as many as conventionally.

A driving method for the liquid crystal display device structured as above is explained in the timing chart in FIG. 7, which shows sequential scanning.

First, if T is a scanning line selection period, a start pulse STa having a pulse width of 8T and a clock signal CLK and an inverse clock signal/CLK each having a cycle of 8T are inputted to the half-bit scanning circuits 11-1 through 11-257.

As a result, the half-bit scanning circuits 11-1 through 11-257 produce signals P1 through P256. Then, each of the AND gate circuits 31-1 through 31-256 receives one of the signals P1 through P256 outputted by the half-bit scanning circuits 11-1 through 11-257 and one of two fourth control signals H1 and H2. Consequently, the AND gate circuits 31-1 through 31-256 output signals PP1, PP2, . . . , PP256 having a pulse width of 4T, which is half of that of the pulses outputted by the half-bit scanning circuits 11-1 through 11-257.

Next, the signals PP1 through PP256 are sent to the NAND gate circuits 15-1 through 15-1024, and, as control signals for the NAND gate circuits 15-1 through 15-1024, four second control signals G1 through G4, shown in the Figure, are used. Accordingly, there are only half as many of these control signals as in the conventional structure.

In this way, the respective signals outputted by the NAND gate circuits 15-1 through 15-1024 and the respective signals GP1 through GP1024 outputted by the output buffer circuits 14 include pulses having a pulse width of T and phases shifted by T each. Thus the scanning lines can be scanned in sequence.

As a result, reduction of the number of signal lines can contribute to reduction of the size and cost of the liquid crystal display device.

In this way, with the liquid crystal display device and driving method according to the present embodiment, when the 256 half-bit scanning circuits 11-1 through 11-257 of the vertical drive circuit 30 receive the start pulse STa, the half-bit scanning circuits 11-1 through 11-257 output the signals P1, P2, . . . , P256, which are pulse signals having phases sequentially shifted by one-half of the cycle of the clock signal CLK, which is (2×4×T).

These pulse signals are sent to the AND gate circuits 31-1 through 31-256 (pulse width reducing means), which reduce the pulse width of the pulse signals from the half-bit scanning circuits 11-1 through 11-257, thereby producing pulses having a pulse width of (M×T). The pulses outputted by the AND gate circuits 31-1 through 31-256 are sent to the first control terminals of the (256×4=1,024) NAND gate circuits 15-1 through 15-1024.

Here, of the (256×4=1,024) NAND gate circuits 15-1 through 15-1024, the first control terminals of every four adjacent NAND gate circuits 15-1 through 15-1024 are connected together. Thus the pulse outputted by each of the AND gate circuits 31-1 through 31-256 is sent to four NAND gate circuits 15-1 through 15-4, 15-5 through 15-8, . . . , 15-1021 through 15-1024.

Further, the second control terminals of every four adjacent NAND gate circuits 15-1 through 15-1024 receive different respective second control signals G1 through G4 as additional inputs. Each of the second control signals G1 through G4 is made up of pulses having a cycle of 4T and a pulse width of T.

Consequently, the NAND gate circuits 15-1 through 15-1024 and the output buffers 14 output signals having a pulse width of T.

Accordingly, by sending these signals of pulse width T to the scanning lines in sequence, in combination with signals sent to the signal lines by the horizontal drive circuit 2, each TFT of the active matrix array 1 can be ON/OFF controlled, thus performing display in each pixel of the screen of the liquid crystal display device.

In the conventional structure, since different signals were sent to every 8 (=2×4) NAND gate circuits 205-1 through 205-1024 (see FIG. 31), at least 8 (=2×4) control lines were necessary for the NAND gate circuits 205-1 through 205-1024. This increased the number of control lines for input to the vertical drive circuit 202, which increased the surface area used for input pads, and since the control lines themselves had to be conducted to the vertical drive circuit 202, the surface area devoted thereto in the circuit layout was also increased.

In contrast, in the present embodiment, by providing the AND gate circuits 31-1 through 31-256 (pulse width reducing means), which reduce the pulse width of the pulse signals from the half-bit scanning circuits 11-1 through 11-257, the second control terminals of every fourth NAND gate circuit 15-1 through 15-1024 can be connected together. Accordingly, there are four kinds of second control terminal, or half as many as conventionally.

Further, lines are dispersed between the AND gate circuits 31-1 through 31-256 and the NAND gate circuits 15-1 through 15-1024, thus preventing concentration of control lines.

As a result, it is possible to provide a liquid crystal display device and a driving method therefor which use a small number of driving signals, and which are capable of improving production efficiency.

Further, in the liquid crystal display device and driving method according to the present embodiment, in particular, the pulse width reducing means are structured as the AND gate circuits 31-1 through 31-256, each of which receives the pulse outputted by one of the half-bit scanning circuits 11-1 through 11-257 and one of two fourth control signals H1 and H2 having a cycle of (2×4×T) and a pulse width of 4T, each of which is the inverse of the other.

As a result, it is possible to provide with certainty a liquid crystal display device and a driving method therefor which use a small number of driving signals, and which are capable of improving production efficiency.

Further, in the liquid crystal display device and driving method according to the present embodiment, the clock signal CLK and the inverted clock signal/CLK are used for the fourth control signals H1 and H2. For this reason, there is no need to provide further control lines for inputting the fourth control signals H1 and H2 to the vertical drive circuit 30, nor to produce further signals in an external circuit.

In the conventional structure, the number of control lines for input to the vertical drive circuit 202 was increased, which increased the surface area used for input pads, and since the control lines themselves had to be conducted to the vertical drive circuit 202, the surface area devoted thereto in the circuit layout was also increased. However, in the present embodiment, this can be prevented by using existing control lines.

Accordingly, it is possible to provide a liquid crystal display device and a driving method therefor which use a small number of driving signals, and which are capable of improving production efficiency.

[Fourth Embodiment]

Figure 8:
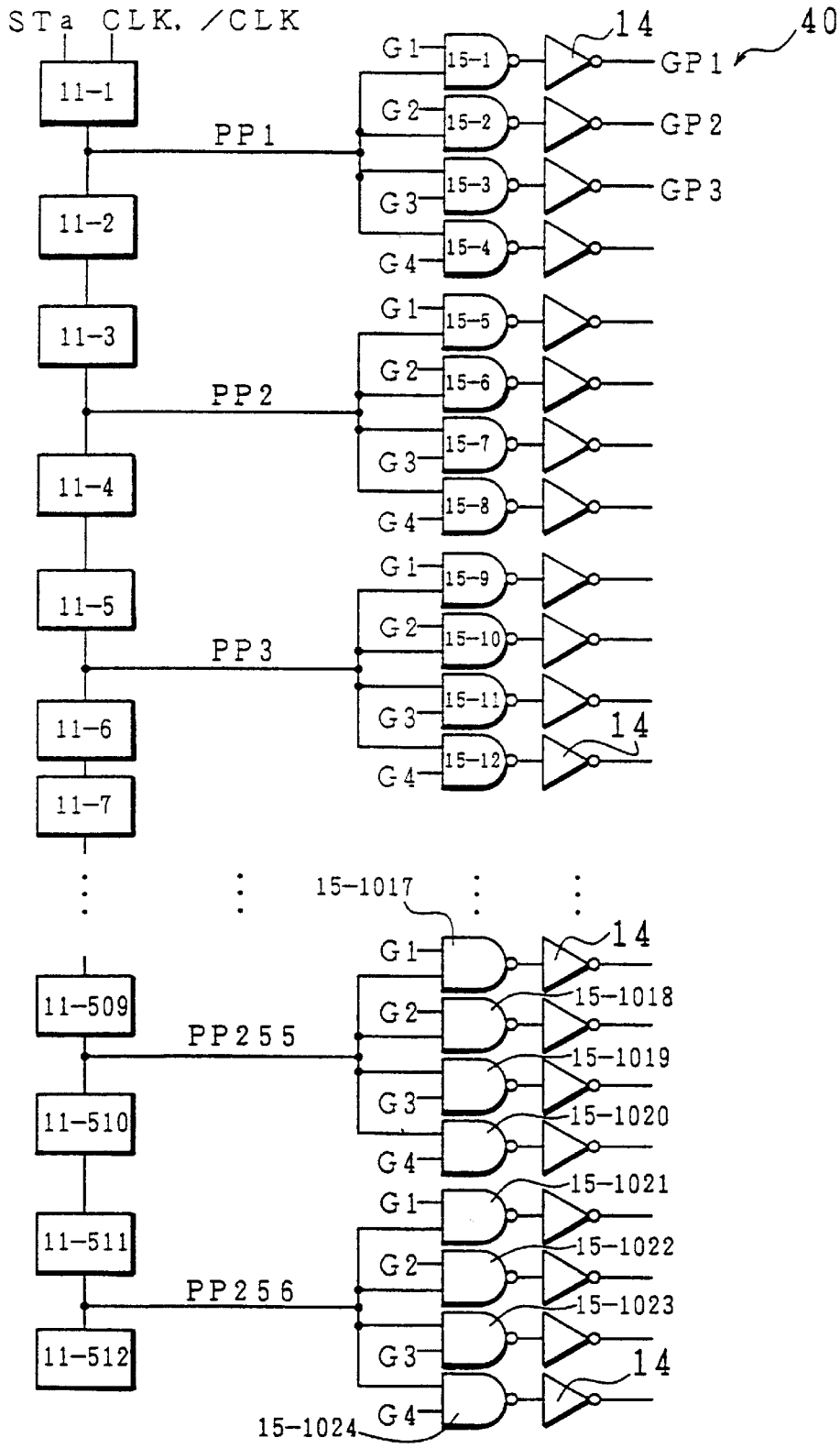
FIG. 8 is a block diagram showing the structure of a vertical drive circuit of a liquid crystal display device according to a further embodiment of the present invention.
Figure 9:
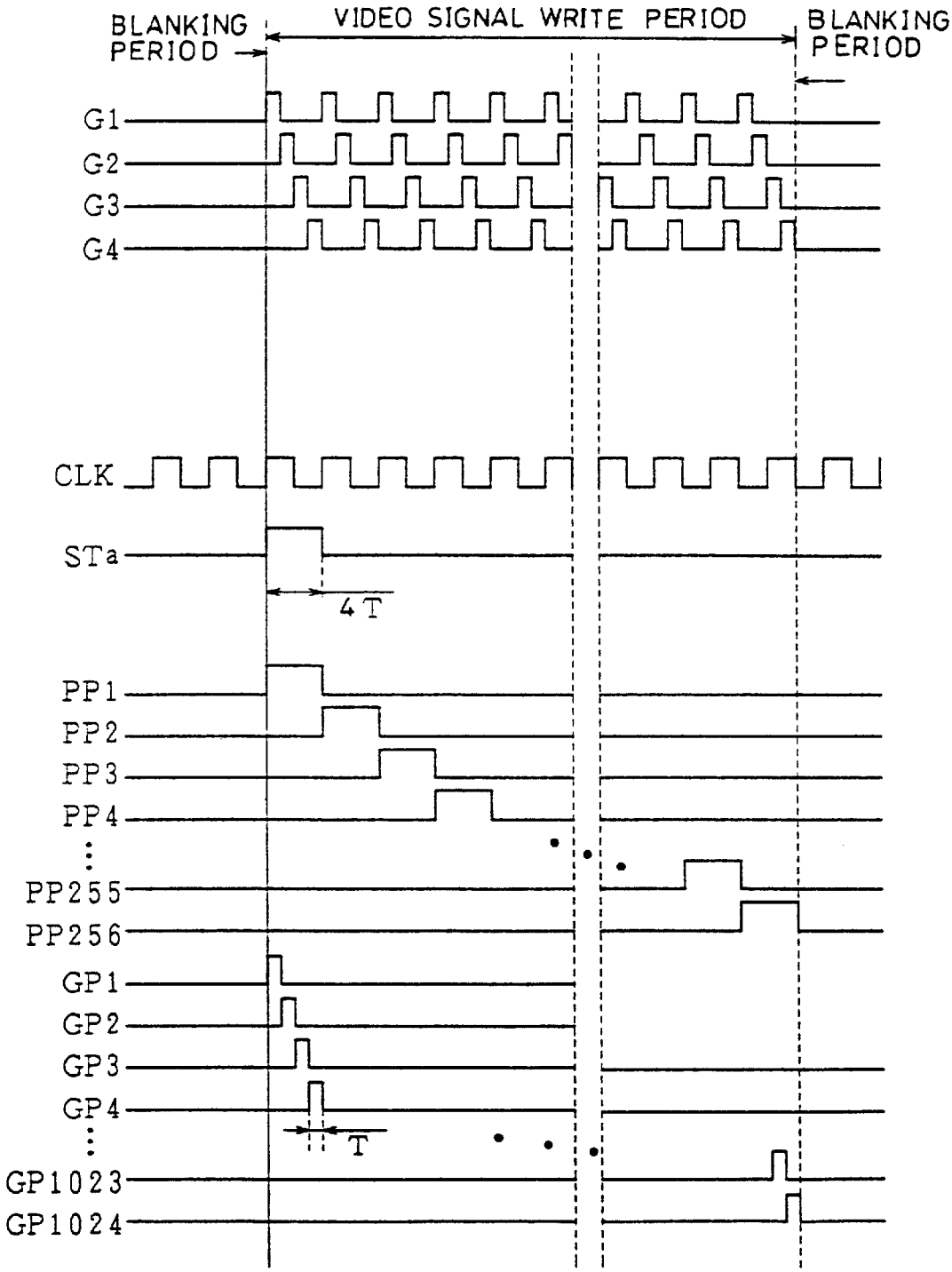
FIG. 9 is a timing chart showing a driving method for the foregoing vertical drive circuit.

The following will explain another embodiment of the present invention with reference to FIGS. 8 and 9. For ease of explanation, members having the same functions as those shown in the drawings pertaining to the first through third embodiments above will be given the same reference symbols, and explanation thereof will be omitted here.

As shown in FIG. 8, a vertical drive circuit 40 of a liquid crystal display device according to the present embodiment is made up of half-bit scanning circuits 11-1 through 11-512, which sequentially shift a start pulse STa by one-half pulse each in synchronization with a clock signal CLK; NAND gate circuits 15-1 through 15-1024 (sixth logic gate circuits), each of which receives signals PP1, PP2, . . . , PP256 outputted by every other half-bit scanning circuit 11-1 through 11-512, and second control signals G1, G2, G3, and G4; and output buffers 14, which receive signals outputted by the NAND gate circuits 15-1 through 15-1024, and which output signals GP1, GP2, . . . , GP1024.

A characteristic feature of the vertical drive circuit 40 is that, by providing twice as many half-bit scanning circuits 11-1 through 11-512 as in the first through third embodiments above, and eliminating overlap of output pulses by retrieving output from every other half-bit scanning circuit 11-1 through 11-512, the number of control signals for the NAND gate circuits 15-1 through 15-1024 can be reduced to half as many as conventionally.

A driving method for the liquid crystal display device structured as above is explained in the timing chart in FIG. 9, which shows sequential scanning.

First, if T is a scanning line selection period, a start pulse STa having a pulse width of 4T and a clock signal CLK and an inverse clock signal/CLK each having a cycle of 4T are inputted to the half-bit scanning circuits 11-1 through 11-512. Then, by retrieving output from every other half-bit scanning circuit 11-1 through 11-512, signals PP1 through PP256, the pulses of which do not overlap with each other, are produced.

Next, the signals PP1 through PP256 are sent to the NAND gate circuits 15-1 through 15-1024, and, as control signals for the NAND gate circuits 15-1 through 15-1024, four second control signals G1 through G4, shown in the Figure, are used. Accordingly, there are only half as many of these control signals as in the conventional structure.

In this way, the respective signals outputted by the NAND gate circuits 15-1 through 15-1024 and the respective signals GP1 through GP1024 outputted by the output buffer circuits 14 include pulses having a pulse width of T and phases sequentially shifted by T each. Thus the scanning lines can be scanned in sequence.

As a result, reduction of the number of signal lines can contribute to reduction of the size and cost of the liquid crystal display device.

In this way, with the liquid crystal display device and driving method according to the present embodiment, when the (2×256) half-bit scanning circuits 11-1 through 11-512 of the vertical drive circuit 40 receive the start pulse STa, the half-bit scanning circuits 11-1 through 11-512 produce pulse signals having phases sequentially shifted by one-half of the cycle of the clock signal CLK, which is 4T. Accordingly, the respective output signals PP1 through PP256 retrieved from every other half-bit scanning circuit 11-1 through 11-512 are sequentially shifted by one cycle each.

These pulse signals are sent to the first control terminals of the (256×4=1,024) NAND gate circuits 15-1 through 15-1024.

Here, of the (256×4=1,024) NAND gate circuits 15-1 through 15-1024, the first control terminals of every four adjacent NAND gate circuits 15-1 through 15-1024 are connected together. Thus the pulse outputted by every other half-bit scanning circuit 11-1, 11-3, 11-5, . . . , 11-511 is sent to four NAND gate circuits 15-1 through 15-4, 15-5 through 15-8, . . . , 15-1021 through 15-1024.

Further, the second control terminals of every four adjacent NAND gate circuits 15-1 through 15-1024 receive different respective second control signals G1 through G4 as additional inputs. Each of the second control signals G1 through G4 is made up of pulses having a cycle of 4T and a pulse width of T.

Consequently, the NAND gate circuits 15-1 through 15-1024 and the output buffers 14 output signals having a pulse width of T.

Accordingly, by sending these signals of pulse width T to the scanning lines in sequence, in combination with signals sent to the signal lines by the horizontal drive circuit 2, each TFT of the active matrix array 1 can be ON/OFF controlled, thus performing display in each pixel of the screen of the liquid crystal display device.

In the conventional structure, since different signals were sent to every 8 (=2×4) NAND gate circuits 205-1 through 205-1024 (see FIG. 31), at least 8 (=2×4) control lines were necessary for the NAND gate circuits 205-1 through 205-1024. This increased the number of control lines for input to the vertical drive circuit 202, which increased the surface area used for input pads, and since the control lines themselves had to be conducted to the vertical drive circuit 202, the surface area devoted thereto in the circuit layout was also increased.

However, in the present embodiment, there are (2×256) half-bit scanning circuits 11-1 through 11-512, which sequentially shift an inputted start pulse STa by one-half of the cycle of the clock signal CLK, and output is retrieved from every other half-bit scanning circuit 11-1, 11-3, 11-5, . . . , 11-511. Consequently, the respective output signals PP1 through PP256 are sequentially shifted by one cycle each.

As a result, it is possible to connect the second control terminals of every fourth NAND gate circuit 15-1 through 15-1024. Accordingly, there are four kinds of second control terminal, or half as many as conventionally.

As a result, it is possible to provide a liquid crystal display device and a driving method therefor which use a small number of driving signals, and which are capable of improving production efficiency.

[Fifth Embodiment]

Figure 10:
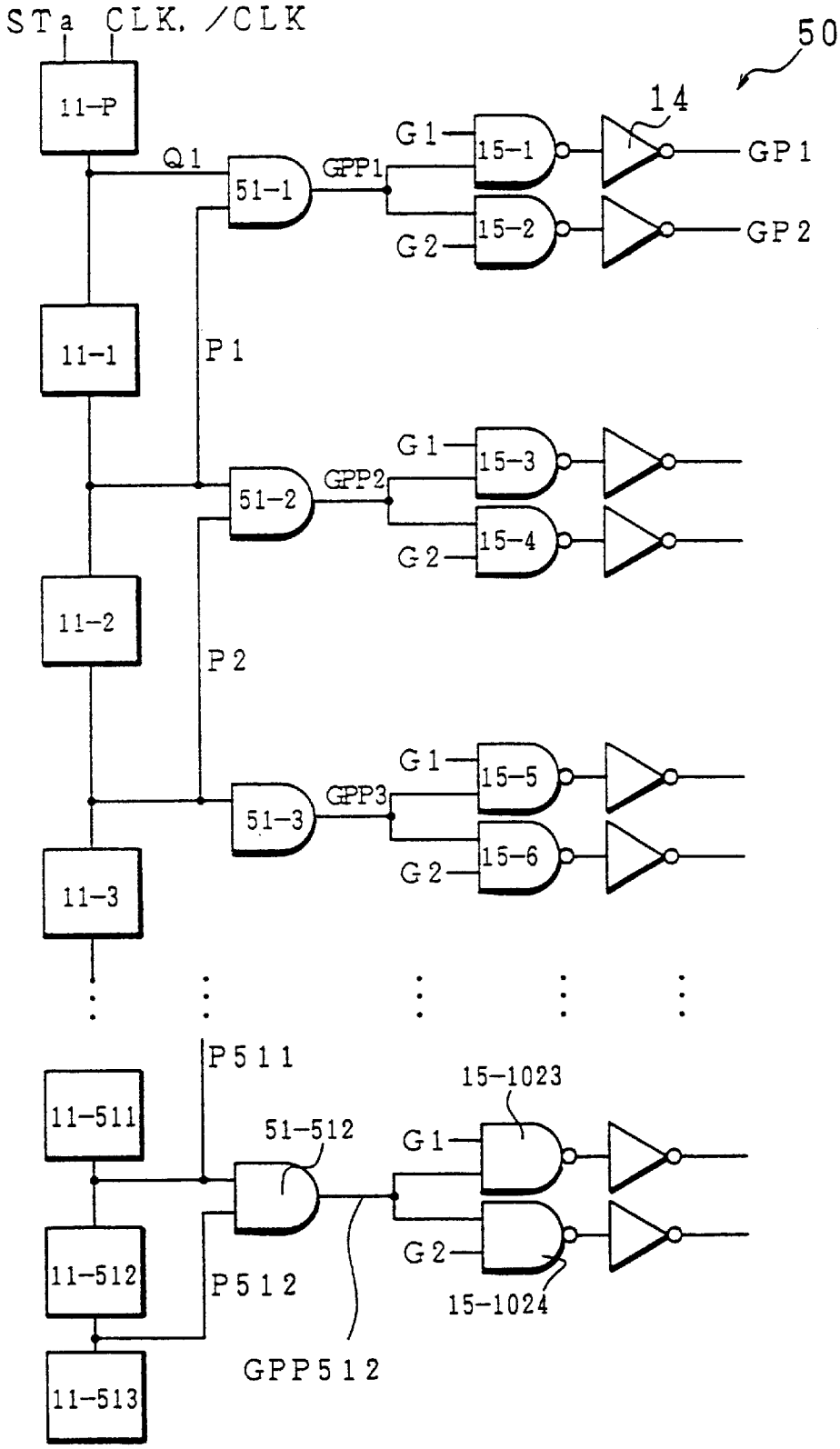
FIG. 10 is a block diagram showing the structure of a vertical drive circuit of a liquid crystal display device according to a further embodiment of the present invention.
Figure 11:
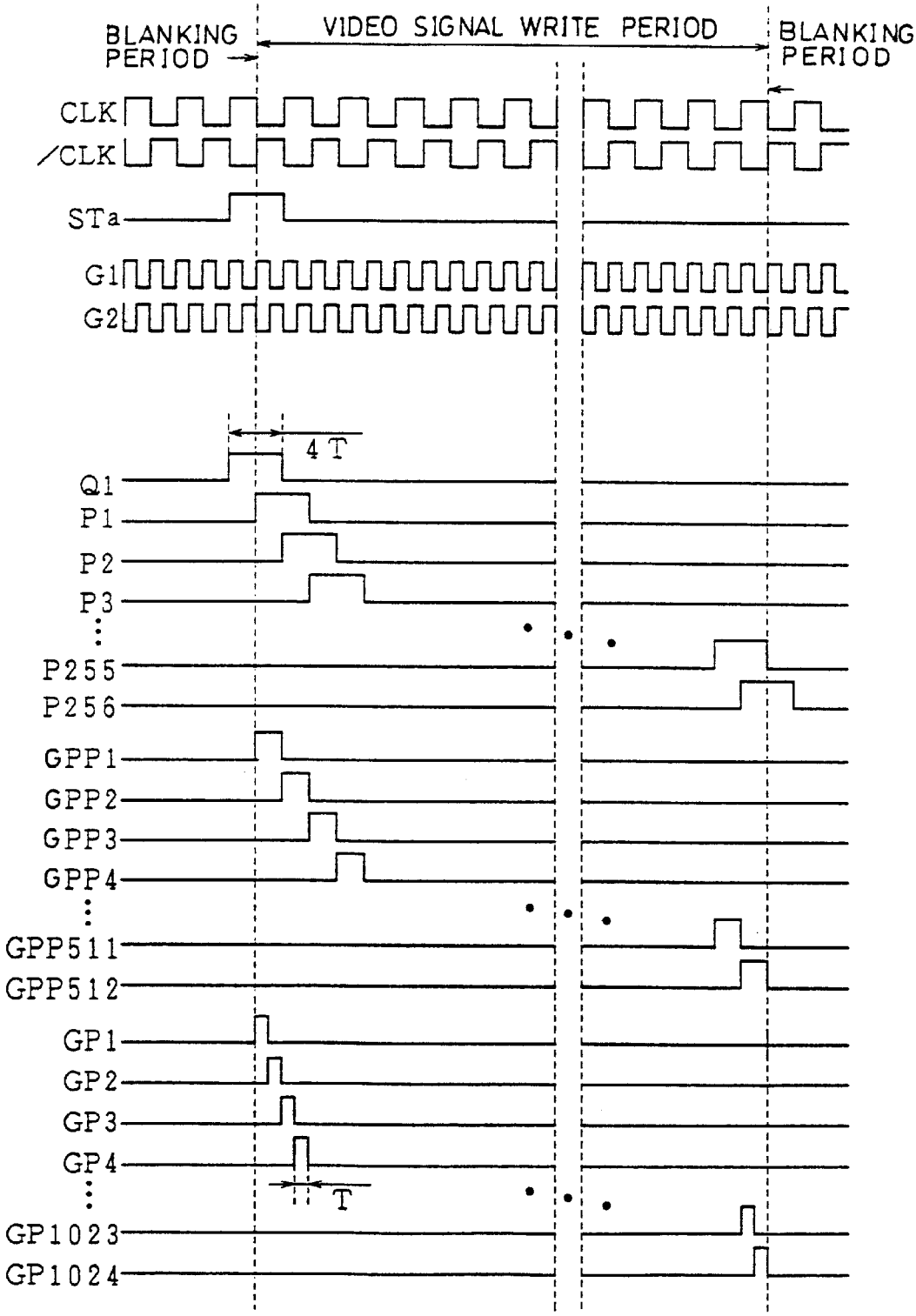
FIG. 11 is a timing chart showing a driving method for the foregoing vertical drive circuit.

The following will explain another embodiment of the present invention with reference to FIGS. 10 and 11. For ease of explanation, members having the same functions as those shown in the drawings pertaining to the first through fourth embodiments above will be given the same reference symbols, and explanation thereof will be omitted here.

In each of the first through fourth embodiments above, the output signal of each scanning circuit was used to drive four scanning lines, but the present embodiment explains a case in which the output signal of each scanning circuit is used to drive two scanning lines.

As shown in FIG. 10, a vertical drive circuit 50 of a liquid crystal display device according to the present embodiment is made up of half-bit scanning circuits 11-P and 11-1 through 11-513, which sequentially shift a start pulse STa by one-half pulse each in synchronization with a clock signal CLK; AND gate circuits 51-1 through 51-512 (seventh logic gate circuits), each of which receives a pair of signals Q1 and P1, P1 and P2, . . . , P511 and P512 outputted by the half-bit scanning circuits 11-P and 11-1 through 11-513; NAND gate circuits 15-1 through 15-1024, which receive signals GPP1, GPP2, . . . , GPP512 outputted by the AND gate circuits 51-1 through 51-512, and second control signals G1 and G2; and output buffers 14, which receive signals outputted by the NAND gate circuits 15-1 through 15-1024, and which output signals GP1, GP2, . . . , GP1024.

In other words, the vertical drive circuit 50 according to the present embodiment is similar to the vertical drive circuit 20 discussed in the second embodiment above, except that the number of AND gate circuits 21-1 through 21-256 and output signals GPP1 through GPP256 in the vertical drive circuit 20 shown in FIG. 4 are each doubled to 512 in the vertical drive circuit 50 in the present embodiment.

A characteristic feature of the vertical drive circuit 50 is that, by providing the AND gate circuits 51-1 through 51-512, the number of control signals for the NAND gate circuits 15-1 through 15-1024 can be reduced to half as many as conventionally. Further, each AND gate circuit 51-1 through 51-512 receives signals outputted by two adjacent half-bit scanning circuits 11-P and 11-1 through 11-513. Since the AND gate circuits 51-1 through 51-512 must provide 512 output signals, an extra half-bit scanning circuit 11-P is provided before the half-bit scanning circuit 11-1. Incidentally, the extra half-bit scanning circuit 11-P may instead be provided after the half-bit scanning circuit 11-513.

A driving method for the liquid crystal display device structured as above is explained in the timing chart in FIG. 11, which shows sequential scanning.

First, if T is a scanning line selection period, a start pulse STa having a pulse width of 4T and a clock signal CLK and an inverse clock signal/CLK each having a cycle of 4T are inputted to the half-bit scanning circuits 11-P and 11-1 through 11-513.

As a result, the half-bit scanning circuits 11-P and 11-1 through 11-513 produce signals Q1 and P1 through P512. Then, the signals Q1 and P1, P1 and P2, . . . , P511 and P512 outputted by each pair of adjacent half-bit scanning circuits 11-P and 11-1 through 11-513 are sent to one of the AND gate circuits 51-1 through 51-512, and the AND gate circuits 51-1 through 51-512 output signals GPP1, GPP2, . . . , GPP512 having a pulse width of half of that of the pulses outputted by the half-bit scanning circuits 11-P and 11-1 through 11-513.

Next, the signals GPP1 through GPP512 are sent to the NAND gate circuits 15-1 through 15-1024, and, as control signals for the NAND gate circuits 15-1 through 15-1024, two control signals G1 and G2, shown in the Figure, are used.

The control signals G1 and G2 have a cycle of 2T, and the inverse of the control signal G1 is used as the control signal G2. Consequently, the number of signal input terminals can be reduced by providing one input terminal for input of the control signal G1, which is sent through an inverter provided on the substrate to produce the control signal G2.

In this way, the respective signals outputted by the NAND gate circuits 15-1 through 15-1024 and the respective signals GP1 through GP1024 outputted by the output buffer circuits 14 include pulses having a pulse width of T and phases sequentially shifted by T each. Thus the scanning lines can be scanned in sequence.

As a result, reduction of the number of signal lines can contribute to reduction of the size and cost of the liquid crystal display device.

As discussed above, with the liquid crystal display device and driving method according to the present embodiment, the structure of the vertical drive circuit 20 of the second embodiment above (see FIG. 4), in which each of the AND gate circuits 21-1 through 21-256 receives pulses outputted by a pair of adjacent half-bit scanning circuits 11-P and 11-1 through 11-257, is combined with a structure in which there are twice as many half-bit scanning circuits, i.e., the half-bit scanning circuits 11-P and 11-1 through 11-513.

As a result, such a combined structure is also able to provide a liquid crystal display device and a driving method therefor which use a small number of driving signals, and which are capable of improving production efficiency.

Incidentally, the first through fifth embodiments above explained sequential scanning only, but the first through fourth embodiments may also be applied to the cases of interlace scanning and two-line simultaneous scanning. In the fifth embodiment, however, with a small number of control signals, sequential scanning can be performed, but the fifth embodiment cannot be applied to interlace scanning and two-line simultaneous scanning. In other words, in the fifth embodiment, these kinds of scanning are possible if more than four control signals are used.

[Sixth Embodiment]

Figure 12:
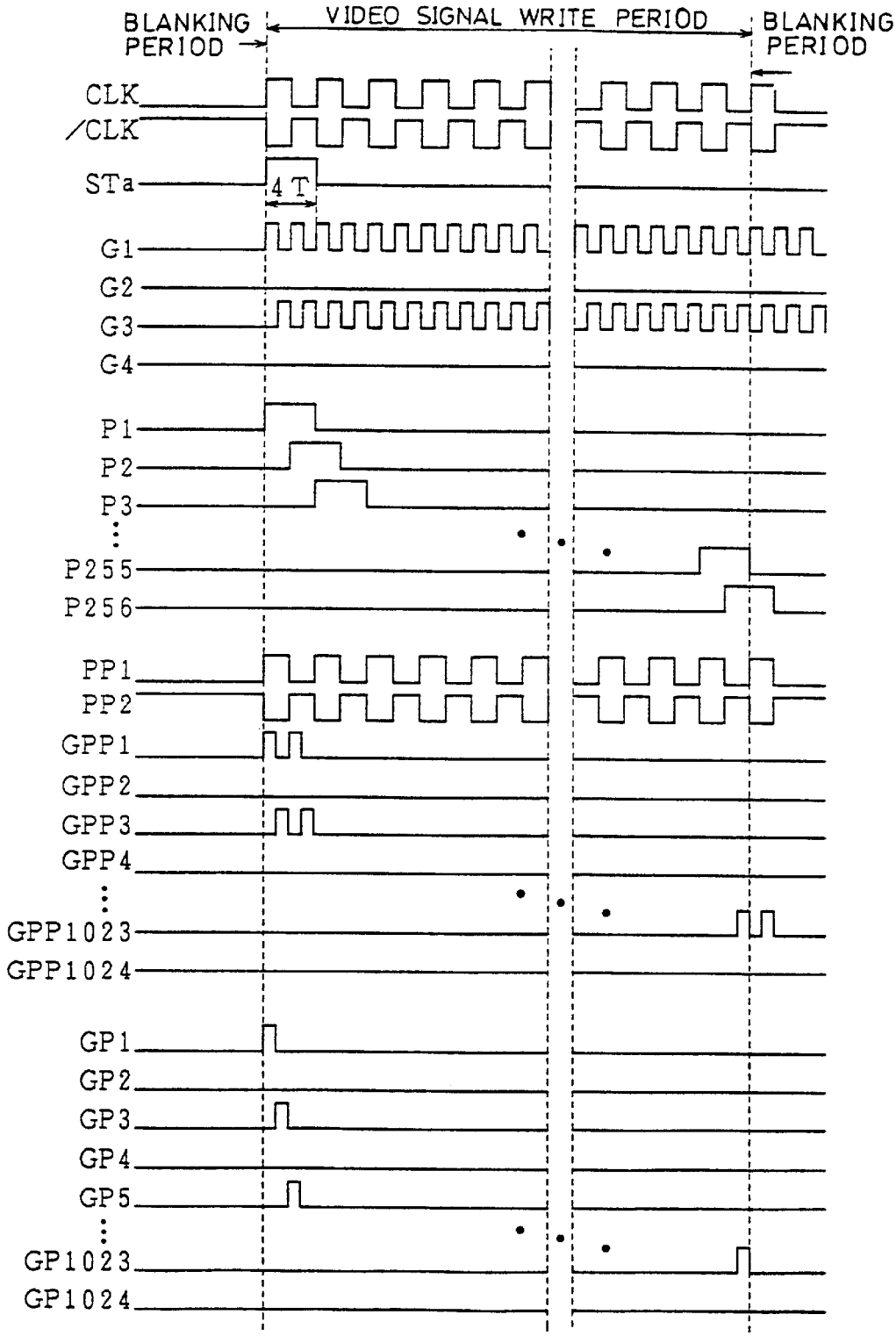
FIG. 12 is a timing chart showing a driving method according to a further embodiment of the present invention, which uses the vertical drive circuit shown in FIG. 1 to perform interlace scanning, in which input is performed sequentially to every other scanning line.

The following will explain another embodiment of the present invention with reference to FIG. 12. For ease of explanation, members having the same functions as those shown in the drawings pertaining to the first through fifth embodiments above will be given the same reference symbols, and explanation thereof will be omitted here.

Each of the first through fifth embodiments above explained sequential scanning, but the present and following embodiments will explain interlace scanning or two-line simultaneous scanning.

The present embodiment will explain interlace scanning using the vertical drive circuit 10 according to the first embodiment above, shown in FIG. 1.

In interlace scanning using the vertical drive circuit 10, as shown in FIG. 12, if T is a scanning line selection period, a start pulse STa having a pulse width of 4T and a clock signal CLK and an inverse clock signal/CLK each having a cycle of 4T are inputted to the half-bit scanning circuits 11-1 through 11-257.

As a result, the half-bit scanning circuits 11-1 through 11-257 produce signals P1, P2, . . . , P256. For the control signals for the AND gate circuits 12-1 through 12-1024 (first logic gate circuits), four second control signals G1 through G4, shown in the Figure, are used. Accordingly, there are only half as many of these control signals as in the conventional structure.

In the present embodiment, during an odd-number field, a control signal with pulses having a cycle of 2T is inputted for the second control signal G1, and a control signal shifted by T from the second control signal G1 is inputted for the second control signal G3. Further, during the odd-number field, no control signals are inputted for the second control signals G2 and G4.

Incidentally, in the present embodiment, as shown in the Figure, pulses of the second control signals G1 and G3 are also produced during a blanking period immediately following the video signal write period, but there is no limitation to this; these pulses need not be produced during the blanking period.

After receiving the signals P1 through P256 and the second control signals G1 through G4, two output pulses appear in each of the signals GPP1 through GPP1024 outputted by the AND gate circuits 12-1 through 12-1024 (first logic gate circuits), as shown in the Figure. These two output pulses are sent to the NAND gate circuits 13-1 through 13-1024 (second logic gate circuits).

At this time, a third control signal PP1 is sent to the NAND gate circuits 13-1 through 13-4, 13-9 through 13-12, . . . , which receive the output of the odd-numbered half-bit scanning circuits 11-1, 11-3, 11-5 . . . , and a third control signal PP2 is sent to the NAND gate circuits 13-5 through 13-8, 13-13 through 13-16, which receive the output of the even-numbered half-bit scanning circuits 11-2, 11-4, 11-6. . . .

As the third control signal PP1, the clock signal CLK inputted to the half-bit scanning circuits 11-1 through 11-257 may be used, and as the third control signal PP2, the inverted clock signal/CLK may be used. Accordingly, there is no need to produce further control signals, nor to provide further input terminals for input of external signals.

In this way, during an odd-number field, the respective signals GP1, GP3, GP5, . . . , GP1023 outputted by the output buffer circuits 14 include pulses having a pulse width of T and phases sequentially shifted by T each. Thus the odd-numbered scanning lines can be interlace scanned.

Further, although not shown in the Figure, during an even-number field, the signals shown as the second control signals G1 and G3 are inputted for the second control signals G2 and G4, while no control signals are inputted for the second control signals G1 and G3. Thus pulses having a pulse width of T and phases sequentially shifted by T each are produced in the respective signals GP2, GP4, GP6, . . . , GP1024 outputted by the output buffer circuits 14 to the even-numbered scanning lines.

In this way, in the present embodiment, interlace scanning can be performed using the vertical drive circuit 10.

[Seventh Embodiment]

Figure 13:
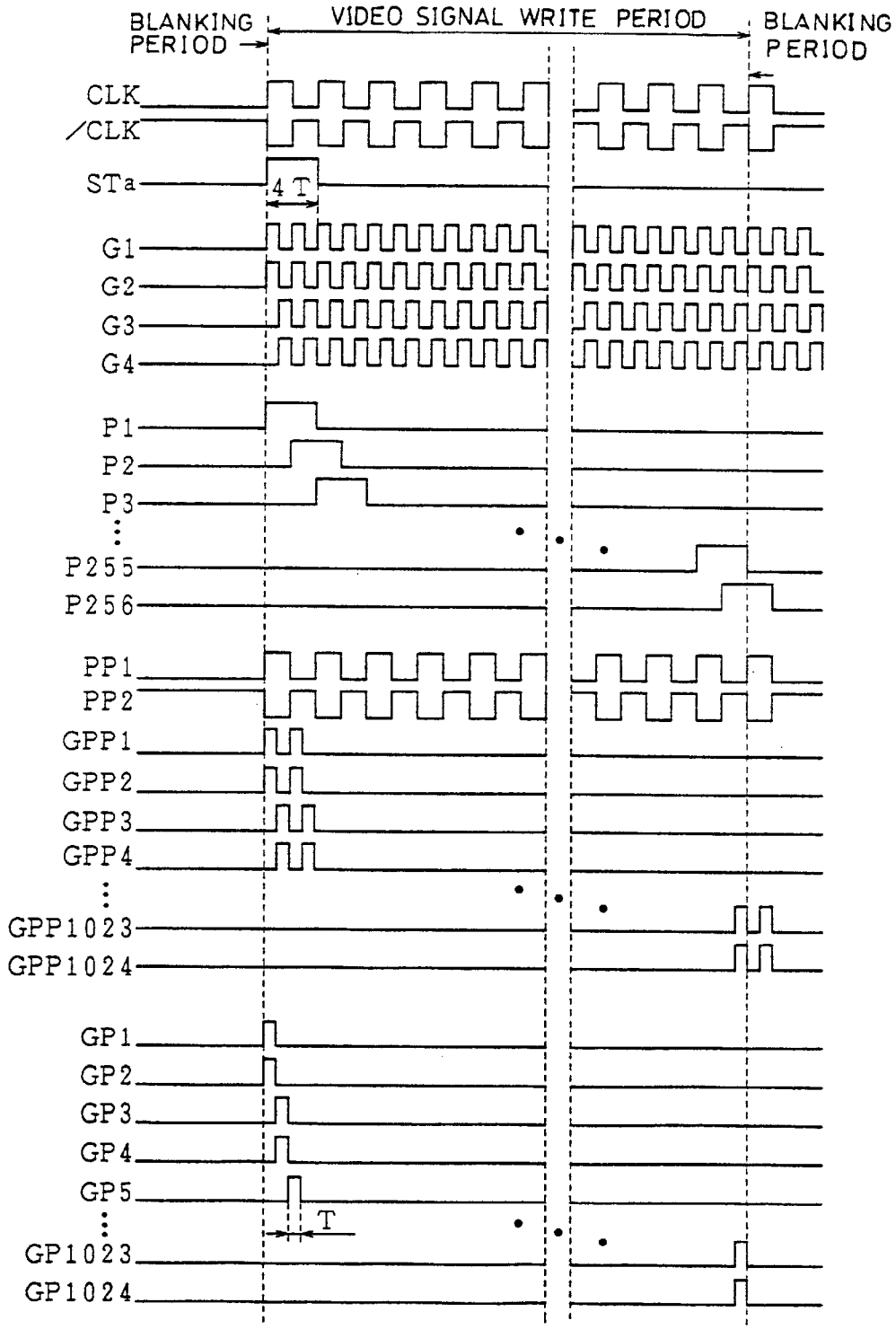
FIG. 13 is a timing chart showing two-line simultaneous scanning, in which input is performed sequentially to two scanning lines at a time, using the vertical drive circuit shown in FIG. 1.

The following will explain another embodiment of the present invention with reference to FIG. 13. For ease of explanation, members having the same functions as those shown in the drawings pertaining to the first through sixth embodiments above will be given the same reference symbols, and explanation thereof will be omitted here.

The present embodiment will explain two-line simultaneous scanning using the vertical drive circuit 10 according to the first embodiment above, shown in FIG. 1.

In two-line simultaneous scanning using the vertical drive circuit 10, as shown in FIG. 13, if T is a scanning line selection period, a start pulse STa having a pulse width of 4T and a clock signal CLK and an inverse clock signal/CLK each having a cycle of 4T are inputted to the half-bit scanning circuits 11-1 through 11-257.

As a result, the half-bit scanning circuits 11-1 through 11-257 produce signals P1, P2, . . . , P256. For the control signals for the AND gate circuits 12-1 through 12-1024 (first logic gate circuits), four second control signals G1 through G4, shown in the Figure, are used. Accordingly, there are only half as many of these control signals as in the conventional structure.

In the present embodiment, during an odd-number field, a control signal with pulses having a cycle of 2T is inputted for the second control signals G1 and G2, and a control signal shifted by T from the second control signals G1 and G2 is inputted for the second control signals G3 and G4.

Incidentally, in the present embodiment, as shown in the Figure, pulses of the second control signals G1 through G4 are also produced during a blanking period immediately following the video signal write period, but there is no limitation to this; these pulses need not be produced during the blanking period.

After receiving the signals P1 through P256 and the second control signals G1 through G4, two output pulses appear in each of the signals GPP1 through GPP1024 outputted by the AND gate circuits 12-1 through 12-1024 (first logic gate circuits), as shown in the Figure. These two output pulses are sent to the NAND gate circuits 13-1 through 13-1024 (second logic gate circuits).

At this time, a third control signal PP1 is sent to the NAND gate circuits 13-1 through 13-4, 13-9 through 13-12, . . . , which receive the output of the odd-numbered half-bit scanning circuits 11-1, 11-3, 11-5 . . . , and a third control signal PP2 is sent to the NAND gate circuits 13-5 through 13-8, 13-13 through 13-16, . . . , which receive the output of the even-numbered half-bit scanning circuits 11-2, 11-4, 11-6. . . .

As the third control signal PP1, the clock signal CLK inputted into the half-bit scanning circuits 11-1 through 11-257 may be used, and as the third control signal PP2, the inverted clock signal/CLK inputted into the half-bit scanning circuits 11-1 through 11-257 may be used. Accordingly, there is no need to produce further control signals, nor to provide further input terminals for input of external signals.

In this way, during the odd number field, the respective signals GP1, GP3, GP5, . . . , GP1023 outputted by the output buffer circuits 14 include pulses having a pulse width of T and phases sequentially shifted by T each, and output signals GP2, GP4, GP6, . . . , GP1024, having the same waveforms as the foregoing output signals GP1, GP3, GP5, . . . , GP1023, respectively, are produced. In this way, two scanning lines can be scanned simultaneously.

Further, although not shown in the Figure, during an even-number field, the signals shown as the second control signals G1 and G2 are inputted for the second control signals G2 and G3, while the control signals shown as the second control signals G3 and G4 are inputted for the second control signals G4 and G1. Thus the respective signals GP2, GP4, GP6, . . . , GP1024 outputted by the output buffer circuits 14 to the even-numbered scanning lines include pulses having a pulse width of T and phases sequentially shifted by T each.

In this way, in the present embodiment, two-line simultaneous scanning can be performed using the vertical drive circuit 10.

[Eighth Embodiment]

Figure 14:
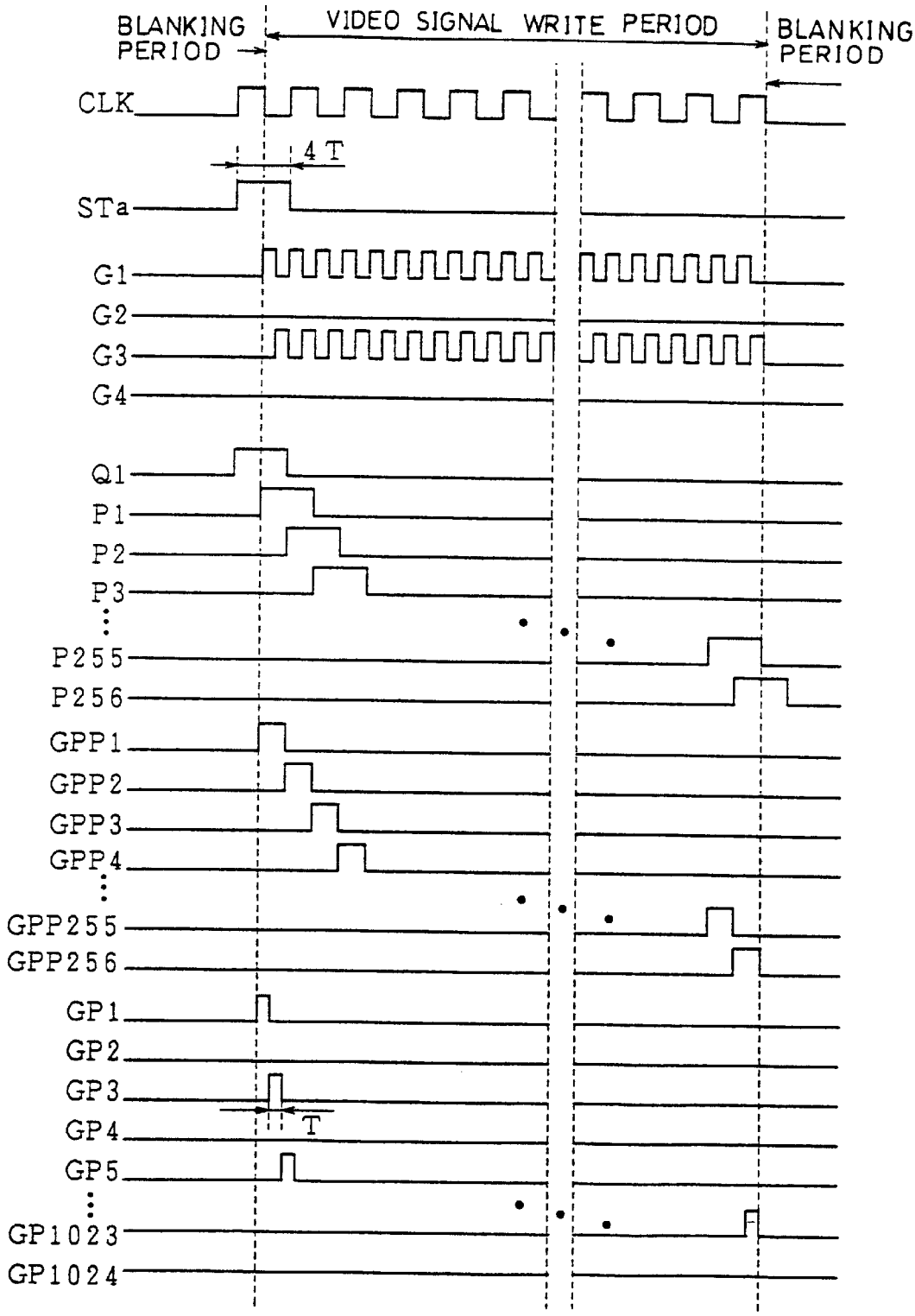
FIG. 14 is a timing chart showing a driving method according to a further embodiment of the present invention, which uses the vertical drive circuit shown in FIG. 4 to perform interlace scanning, in which input is performed sequentially to every other scanning line.

The following will explain another embodiment of the present invention with reference to FIG. 14. For ease of explanation, members having the same functions as those shown in the drawings pertaining to the first through seventh embodiments above will be given the same reference symbols, and explanation thereof will be omitted here.

The present embodiment will explain interlace scanning using the vertical drive circuit 20 according to the second embodiment above, shown in FIG. 4.

In interlace scanning using the vertical drive circuit 20, as shown in FIG. 14, if T is a scanning line selection period, a start pulse STa having a pulse width of 4T and a clock signal CLK and an inverse clock signal/CLK each having a cycle of 4T are inputted to the half-bit scanning circuits 11-P and 11-1 through 11-257.

As a result, the half-bit scanning circuits 11-P and 11-1 through 11-257 produce signals Q1, P1, P2, . . . , P256. Then, the signals Q1 and P1, P1 and P2, . . . , P255 and P256 outputted by each pair of adjacent half-bit scanning circuits 11-P and 11-1 through 11-257 are sent to one of the AND gate circuits 21-1 through 21-256 (fourth logic gate circuits), and the AND gate circuits 21-1 through 21-256 output signals GPP1, GPP2, . . . , GPP256 having a pulse width of half of that of the pulses outputted by the half-bit scanning circuits 11-P and 11-1 through 11-257.

Next, the signals GPP1 through GPP256 are sent to the NAND gate circuits 15-1 through 15-1024 (third logic gate circuits), and, as control signals for the NAND gate circuits 15-1 through 15-1024, four second control signals G1 through G4, shown in the Figure, are used. Accordingly, there are only half as many of these control signals as in the conventional structure.

In the present embodiment, during an odd-number field, a control signal with pulses having a cycle of 2T is inputted for the second control signal G1, and a control signal shifted by T from the second control signal G1 is inputted for the second control signal G3. Further, during the odd-number field, no control signals are inputted for the second control signals G2 and G4.

In this way, the respective signals GP1, GP3, GP5, . . . , GP1023 outputted by the output buffer circuits 14 include pulses having a pulse width of T and phases sequentially shifted by T each. Thus the odd-numbered scanning lines can be interlace scanned.

Further, although not shown in the Figure, during an even-number field, the signals shown as the second control signals G1 and G3 are inputted for the second control signals G2 and G4, while no control signals are inputted for the second control signals G1 and G3. Thus the respective signals GP2, GP4, GP6, . . . , GP1024 outputted by the output buffer circuits 14 to the even-numbered scanning lines include pulses having a pulse width of T and phases sequentially shifted by T each.

In this way, in the present embodiment, interlace scanning can be performed using the vertical drive circuit 20.

[Ninth Embodiment]

Figure 15:
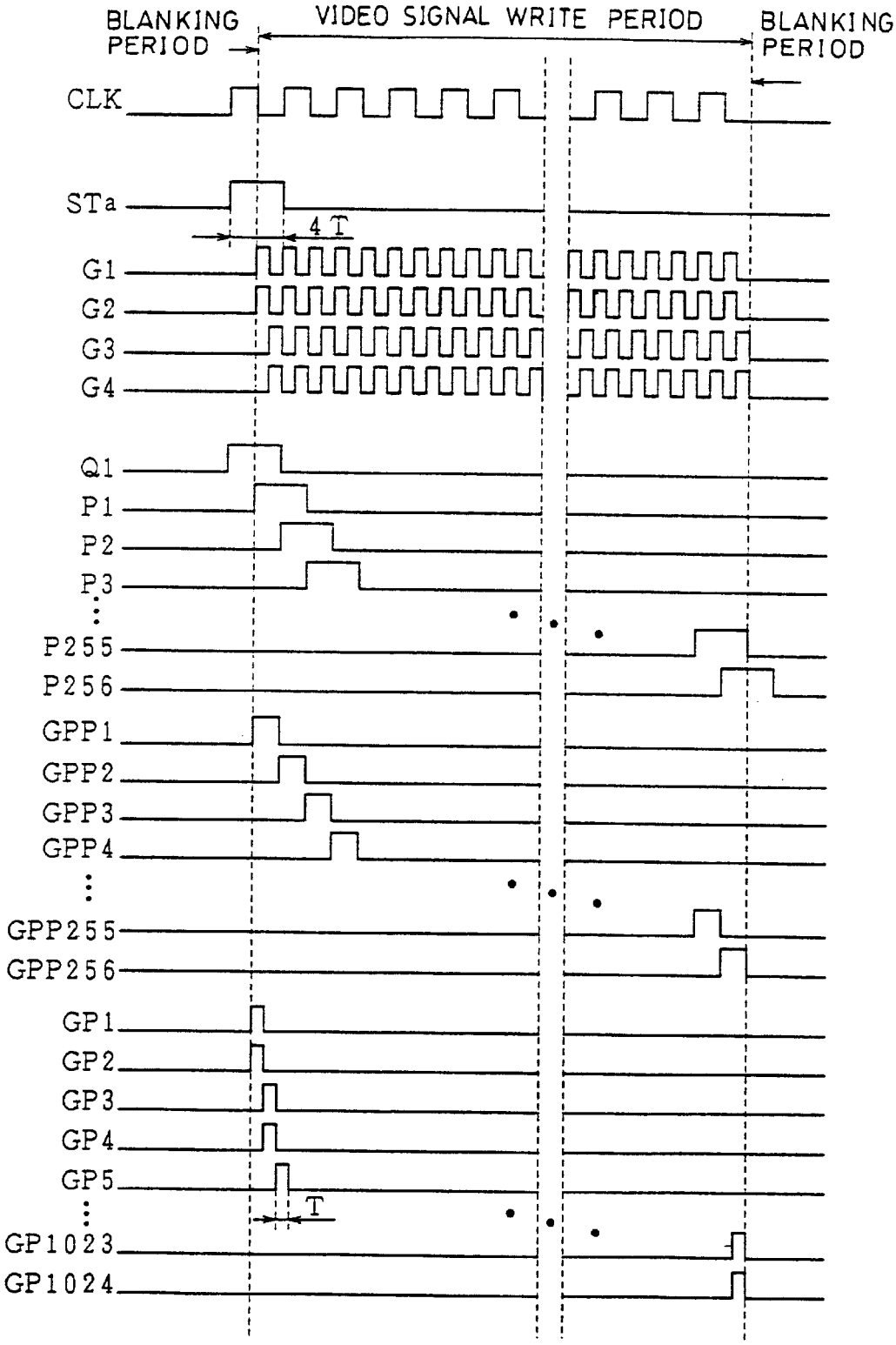
FIG. 15 is a timing chart showing two-line simultaneous scanning, in which input is performed sequentially to two scanning lines at a time, using the vertical drive circuit shown in FIG. 4.

The following will explain another embodiment of the present invention with reference to FIG. 15. For ease of explanation, members having the same functions as those shown in the drawings pertaining to the first through eighth embodiments above will be given the same reference symbols, and explanation thereof will be omitted here.

The present embodiment will explain two-line simultaneous scanning using the vertical drive circuit 20 according to the second embodiment above, shown in FIG. 4.

In two-line simultaneous scanning using the vertical drive circuit 20, as shown in FIG. 15, if T is a scanning line selection period, a start pulse STa having a pulse width of 4T and a clock signal CLK and an inverse clock signal/CLK each having a cycle of 4T are inputted to the half-bit scanning circuits 11-P and 11-1 through 11-257.

As a result, the half-bit scanning circuits 11-P and 11-1 through 11-257 produce signals Q1, P1, P2, . . . , P256. Then, the signals Q1 and P1, P1 and P2, . . . , P255 and P256 outputted by each pair of adjacent half-bit scanning circuits 11-P and 11-1 through 11-257 are sent to one of the AND gate circuits 21-1 through 21-256 (fourth logic gate circuits), and the AND gate circuits 21-1 through 21-256 output signals GPP1, GPP2, . . . , GPP256 having a pulse width of half of that of the pulses outputted by the half-bit scanning circuits 11-P and 11-1 through 11-257.

Next, the signals GPP1 through GPP256 are sent to the NAND gate circuits 15-1 through 15-1024 (third logic gate circuits), and, as control signals for the NAND gate circuits 15-1 through 15-1024, four second control signals G1 through G4, shown in the Figure, are used. Accordingly, there are only half as many of these control signals as in the conventional structure.

In the present embodiment, during an odd-number field, a control signal with pulses having a cycle of 2T is inputted for the second control signals G1 and G2, and a control signal shifted by T from the second control signals G1 and G2 is inputted for the second control signals G3 and G4.

In this way, during the odd number field, the respective pairs of signals GP1 and GP2, GP3 and GP4, . . . , GP1023 and GP1024 outputted by the output buffer circuits 14 include pulses having a pulse width of T and phases sequentially shifted by T for each pair. Thus, two scanning lines are scanned simultaneously.

Further, although not shown in the Figure, during an even-number field, the signals shown as the second control signals G1 and G2 are inputted for the second control signals G2 and G3, while the control signals shown as the second control signals G3 and G4 are inputted for the second control signals G4 and G1. Thus the signal GP1 and the respective pairs of signals GP2 and GP3, GP4 and GP5, . . . outputted by the output buffer circuits 14 include pulses having a pulse width of T and phases sequentially shifted by T for each pair. Thus, two scanning lines are scanned simultaneously.

In this way, in the present embodiment, two-line simultaneous scanning can be performed using the vertical drive circuit 20.

[Tenth Embodiment]

Figure 16:
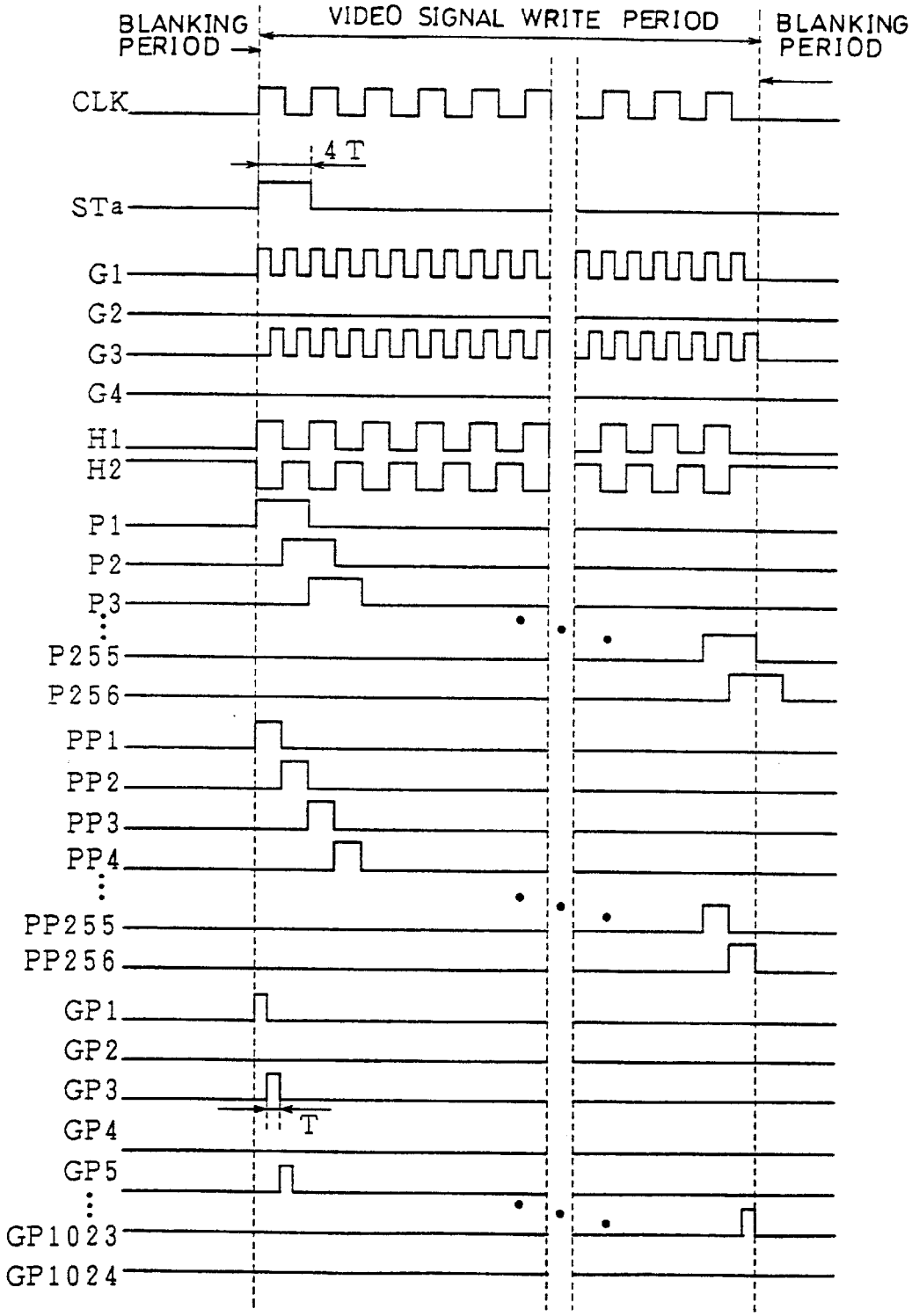
FIG. 16 is a timing chart showing a driving method according to a further embodiment of the present invention, which uses the vertical drive circuit shown in FIG. 6 to perform interlace scanning, in which input is performed sequentially to every other scanning line.

The following will explain another embodiment of the present invention with reference to FIG. 16. For ease of explanation, members having the same functions as those shown in the drawings pertaining to the first through ninth embodiments above will be given the same reference symbols, and explanation thereof will be omitted here.

The present embodiment will explain interlace scanning using the vertical drive circuit 30 according to the third embodiment above, shown in FIG. 6.

In interlace scanning using the vertical drive circuit 30, as shown in FIG. 16, if T is a scanning line selection period, a start pulse STa having a pulse width of 4T and a clock signal CLK and an inverse clock signal/CLK each having a cycle of 4T are inputted to the half-bit scanning circuits 11-1 through 11-257.

As a result, the half-bit scanning circuits 11-1 through 11-257 produce signals P1, P2, . . . , P256. Then the signals P1, P2, . . . , P256 are sent to the AND gate circuits 31-1 through 31-256 (fifth logic gate circuits), each of which also receives either a fourth control signal H1 or a fourth control signal H2. Then the AND gate circuits 31-1 through 31-256 output signals PP1, PP2, . . . , PP256 having a pulse width of half of that of the pulses outputted by the half-bit scanning circuits 11-1 through 11-257.

Next, the signals PP1 through PP256 are sent to the NAND gate circuits 15-1 through 15-1024, and, as control signals for the NAND gate circuits 15-1 through 15-1024, four second control signals G1 through G4, shown in the Figure, are used. Accordingly, there are only half as many of these control signals as in the conventional structure.

In the present embodiment, during an odd-number field, a control signal with pulses having a cycle of 2T is inputted for the second control signal G1, and a control signal shifted by T from the second control signal G1 is inputted for the second control signal G3. Further, during the odd-number field, no control signals are inputted for the second control signals G2 and G4.

In this way, during the odd-number field, the respective signals GP1, GP3, GP5, . . . , GP1023 outputted by the output buffer circuits 14 include pulses having a pulse width of T and phases sequentially shifted by T each. Thus the odd-numbered scanning lines can be interlace scanned.

Further, although not shown in the Figure, during an even-number field, the signals shown as the second control signals G1 and G3 are inputted for the second control signals G2 and G4, while no control signals are inputted for the second control signals G1 and G3. Thus the respective signals GP2, GP4, GP6, . . . , GP1024 outputted by the output buffer circuits 14 to the even-numbered scanning lines include pulses having a pulse width of T and phases sequentially shifted by T each.

In this way, in the present embodiment, interlace scanning can be performed using the vertical drive circuit 30.

[Eleventh Embodiment]

Figure 17:
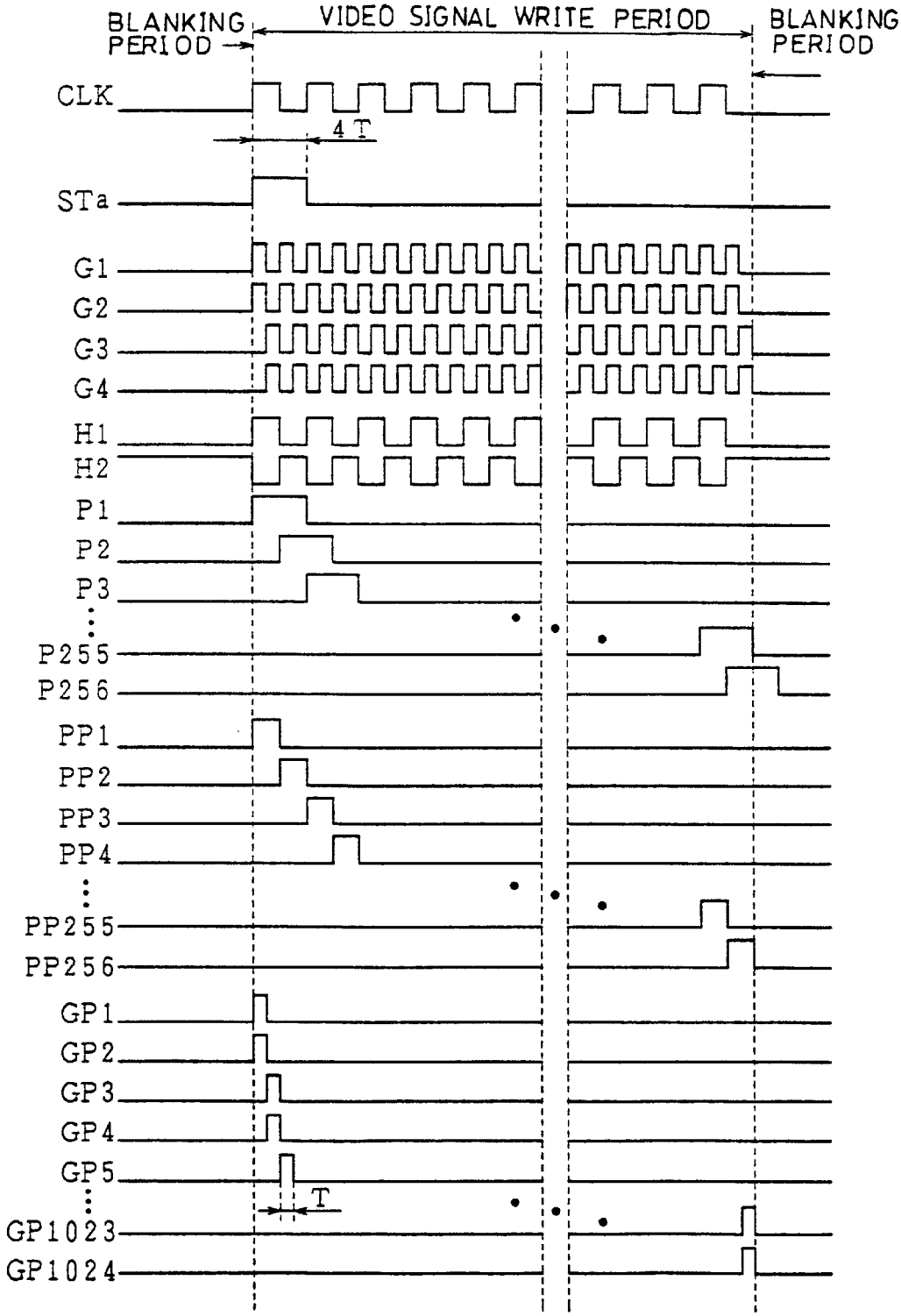
FIG. 17 is a timing chart showing two-line simultaneous scanning, in which input is performed sequentially to two scanning lines at a time, using the vertical drive circuit shown in FIG. 6.

The following will explain another embodiment of the present invention with reference to FIG. 17. For ease of explanation, members having the same functions as those shown in the drawings pertaining to the first through tenth embodiments above will be given the same reference symbols, and explanation thereof will be omitted here.

The present embodiment will explain two-line simultaneous scanning using the vertical drive circuit 30 according to the third embodiment above, shown in FIG. 6.

In two-line simultaneous scanning using the vertical drive circuit 30, as shown in FIG. 17, if T is a scanning line selection period, a start pulse STa having a pulse width of 4T and a clock signal CLK and an inverse clock signal/CLK each having a cycle of 4T are inputted to the half-bit scanning circuits 11-1 through 11-257.

As a result, the half-bit scanning circuits 11-1 through 11-257 produce signals P1, P2, . . . , P256. Then the signals P1, P2, . . . , P256 are sent to the AND gate circuits 31-1 through 31-256 (fifth logic gate circuits), each of which also receives either a fourth control signal H1 or a fourth control signal H2. Then the AND gate circuits 31-1 through 31-256 output signals PP1, PP2, . . . , PP256 having a pulse width of half of that of the pulses outputted by the half-bit scanning circuits 11-1 through 11-257.

Next, the signals PP1 through PP256 are sent to the NAND gate circuits 15-1 through 15-1024, and, as control signals for the NAND gate circuits 15-1 through 15-1024, four second control signals G1 through G4, shown in the Figure, are used. Accordingly, there are only half as many of these control signals as in the conventional structure.

In the present embodiment, during an odd-number field, a control signal with pulses having a cycle of 2T is inputted for the second control signals G1 and G2, and a control signal shifted by T from the second control signals G1 and G2 is inputted for the second control signals G3 and G4.

In this way, during the odd number field, the respective pairs of signals GP1 and GP2, GP3 and GP4, . . . , GP1023 and GP1024 outputted by the output buffer circuits 14 include pulses having a pulse width of T and phases shifted by T for each pair. Thus, two scanning lines are scanned simultaneously.

Further, although not shown in the Figure, during an even-number field, the signals shown as the second control signals G1 and G2 are inputted for the second control signals G2 and G3, while the control signals shown as the second control signals G3 and G4 are inputted for the second control signals G4 and G1. Thus the signal GP1 and the respective pairs of signals GP2 and GP3, GP4 and GP5, . . . outputted by the output buffer circuits 14 include pulses having a pulse width of T and phases sequentially shifted by T for each pair. Thus, two scanning lines are scanned simultaneously.

In this way, in the present embodiment, interlace scanning can be performed using the vertical drive circuit 30.

[Twelfth Embodiment]

Figure 18:
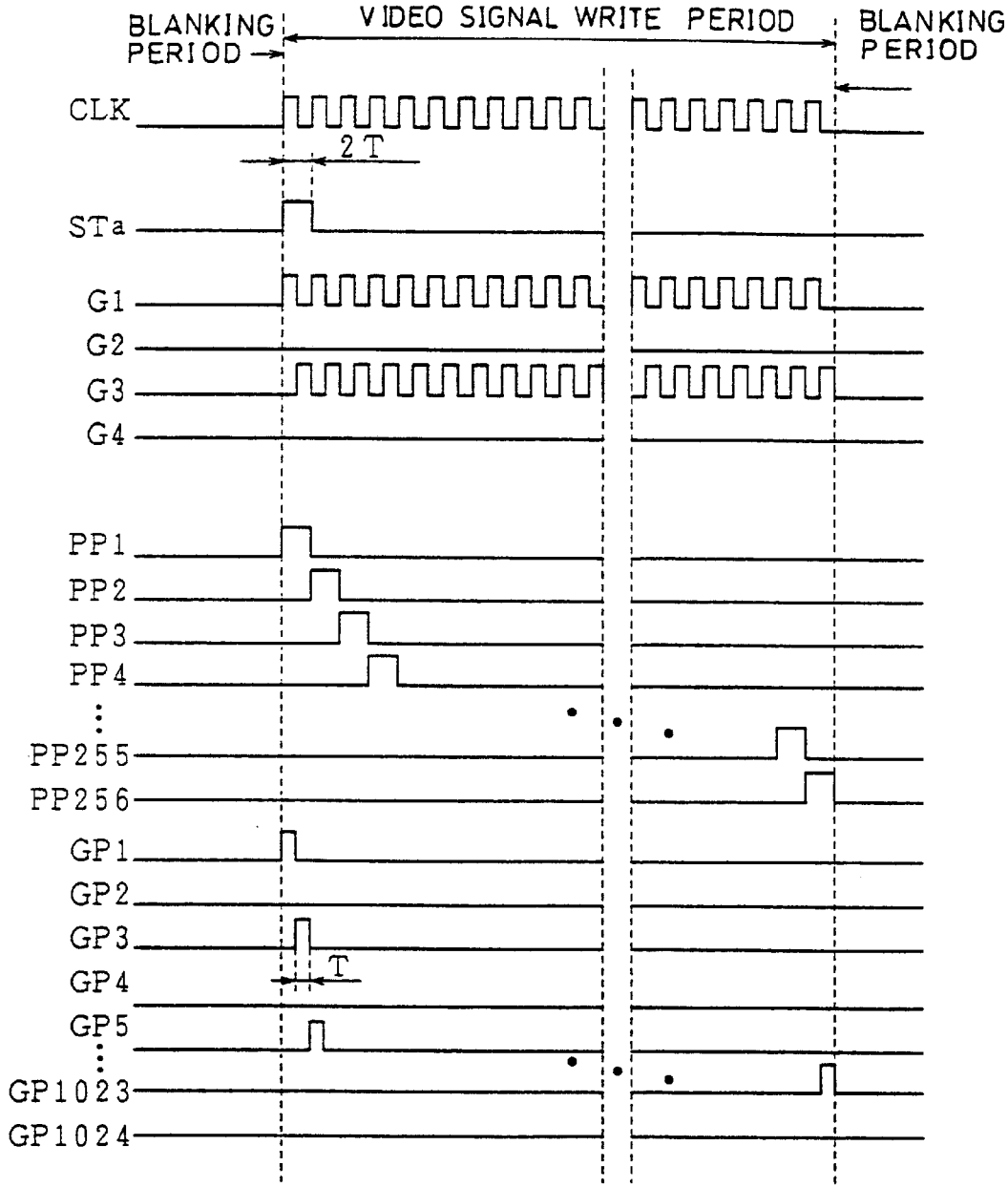
FIG. 18 is a timing chart showing a driving method according to a further embodiment of the present invention, which uses the vertical drive circuit shown in FIG. 8 to perform interlace scanning, in which input is performed sequentially to every other scanning line.

The following will explain another embodiment of the present invention with reference to FIG. 18. For ease of explanation, members having the same functions as those shown in the drawings pertaining to the first through eleventh embodiments above will be given the same reference symbols, and explanation thereof will be omitted here.

The present embodiment will explain interlace scanning using the vertical drive circuit 40 according to the fourth embodiment above, shown in FIG. 8.

In interlace scanning using the vertical drive circuit 40, as shown in FIG. 18, if T is a scanning line selection period, a start pulse STa having a pulse width of 2T and a clock signal CLK and an inverse clock signal/CLK each having a cycle of 2T are inputted to the half-bit scanning circuits 11-1 through 11-512.

Here, by retrieving the output of every other half-bit scanning circuit 11-1 through 11-512, signals PP1, PP2, . . . , PP256, the pulses of which do not overlap with each other, are produced. Then the signals PP1, PP2, . . . , PP256 are sent to the NAND gate circuits 15-1 through 15-1024 (sixth logic gate circuits), and, as control signals for the NAND gate circuits 15-1 through 15-1024, four second control signals G1 through G4, shown in the Figure, are used. Accordingly, there are only half as many of these control signals as in the conventional structure.

In the present embodiment, during an odd-number field, a control signal with pulses having a cycle of 2T is inputted for the second control signal G1, and a control signal shifted by T from the second control signal G1 is inputted for the second control signal G3. Further, during the odd-number field, no control signals are inputted for the second control signals G2 and G4.

In this way, during the odd-number field, the respective signals GP1, GP3, GP5, . . . , GP1023 outputted by the output buffer circuits 14 include pulses having a pulse width of T and phases sequentially shifted by T each. Thus the odd-numbered scanning lines can be interlace scanned.

Further, although not shown in the Figure, during an even-number field, the signals shown as the second control signals G1 and G3 are inputted for the second control signals G2 and G4, while no control signals are inputted for the second control signals G1 and G3. Thus the respective signals GP2, GP4, GP6, . . . , GP1024 outputted by the output buffer circuits 14 to the even-numbered scanning lines include pulses having a pulse width of T and phases sequentially shifted by T each.

In this way, in the present embodiment, interlace scanning can be performed using the vertical drive circuit 40.

[Thirteenth Embodiment]

Figure 19:
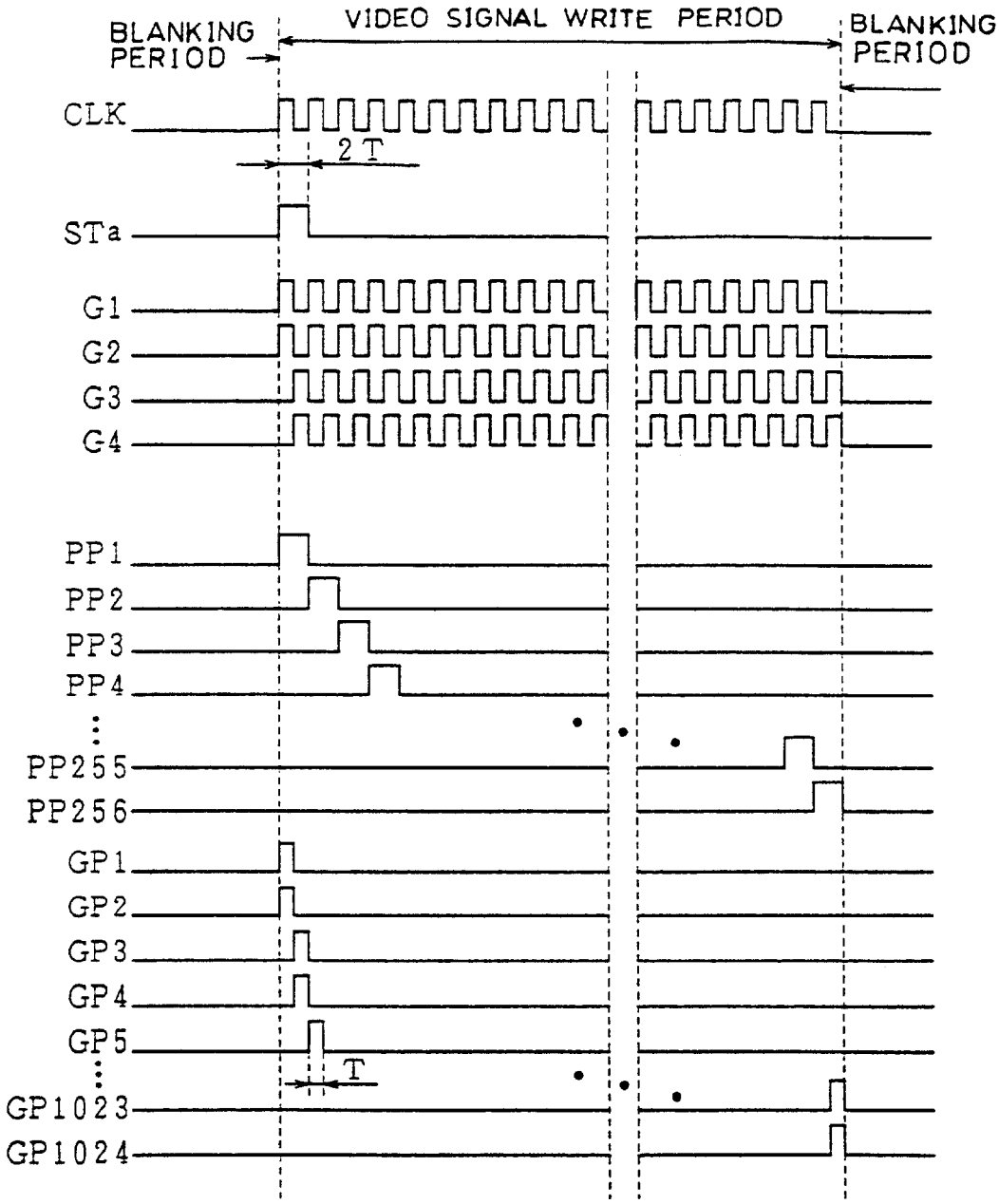
FIG. 19 is a timing chart showing two-line simultaneous scanning, in which input is performed sequentially to two scanning lines at a time, using the vertical drive circuit shown in FIG. 8.

The following will explain another embodiment of the present invention with reference to FIG. 19. For ease of explanation, members having the same functions as those shown in the drawings pertaining to the first through twelfth embodiments above will be given the same reference symbols, and explanation thereof will be omitted here.

The present embodiment will explain two-line simultaneous scanning using the vertical drive circuit 40 according to the fourth embodiment above, shown in FIG. 8.

In two-line simultaneous scanning using the vertical drive circuit 40, as shown in FIG. 19, if T is a scanning line selection period, a start pulse STa having a pulse width of 2T and a clock signal CLK and an inverse clock signal/CLK each having a cycle of 2T are inputted to the half-bit scanning circuits 11-1 through 11-512.

Here, by retrieving the output of every other half-bit scanning circuit 11-1 through 11-512, signals PP1, PP2, . . . , PP256, the pulses of which do not overlap with each other, are produced. Then the signals PP1, PP2, . . . , PP256 are sent to the NAND gate circuits 15-1 through 15-1024 (sixth logic gate circuits), and, as control signals for the NAND gate circuits 15-1 through 15-1024, four second control signals G1 through G4, shown in the Figure, are used. Accordingly, there are only half as many of these control signals as in the conventional structure.

In the present embodiment, during an odd-number field, a control signal with pulses having a cycle of 2T is inputted for the second control signals G1 and G2, and a control signal shifted by T from the second control signals G1 and G2 is inputted for the second control signals G3 and G4.

In this way, during the odd number field, the respective pairs of signals GP1 and GP2, GP3 and GP4, . . . GP1023 and GP1024 outputted by the output buffer circuits 14 include pulses having a pulse width of T and phases sequentially shifted by T each. Thus, two scanning lines are scanned simultaneously.

Further, although not shown in the Figure, during an even-number field, the signals shown as the second control signals G1 and G2 are inputted for the second control signals G2 and G3, while the control signals shown as the second control signals G3 and G4 are inputted for the second control signals G4 and G1. Thus the signal GP1 and the respective pairs of signals GP2 and GP3, GP4 and GP5, . . . outputted by the output buffer circuits 14 include pulses having a pulse width of T and phases sequentially shifted by T for each pair. Thus, two scanning lines are scanned simultaneously.

In this way, in the present embodiment, interlace scanning can be performed using the vertical drive circuit 40.

Incidentally, in each of the first through thirteenth embodiments above, the scanning line selection period was expressed as T, but it goes without saying that T varies according to the number of scanning lines, the scanning method, etc.

Further, in each of the first through thirteenth embodiments above, the logic gate circuits used were the AND gate circuits 12, 21, and 31 and the NAND gate circuits 15, but there is no limitation to this, and other logic gate circuits may be used instead. For example, instead of the AND gate circuits 12, 21, and 31, NOR gate circuits may be used. In this case, as the signals sent to the NOR gate circuits, it is sufficient to use signals which are the inverse of the respective signals sent to the AND gate circuits 12, 21, and 31. The present invention is also applicable to cases in which other logic gate circuits are used.

[Fourteenth Embodiment]

Figure 20:
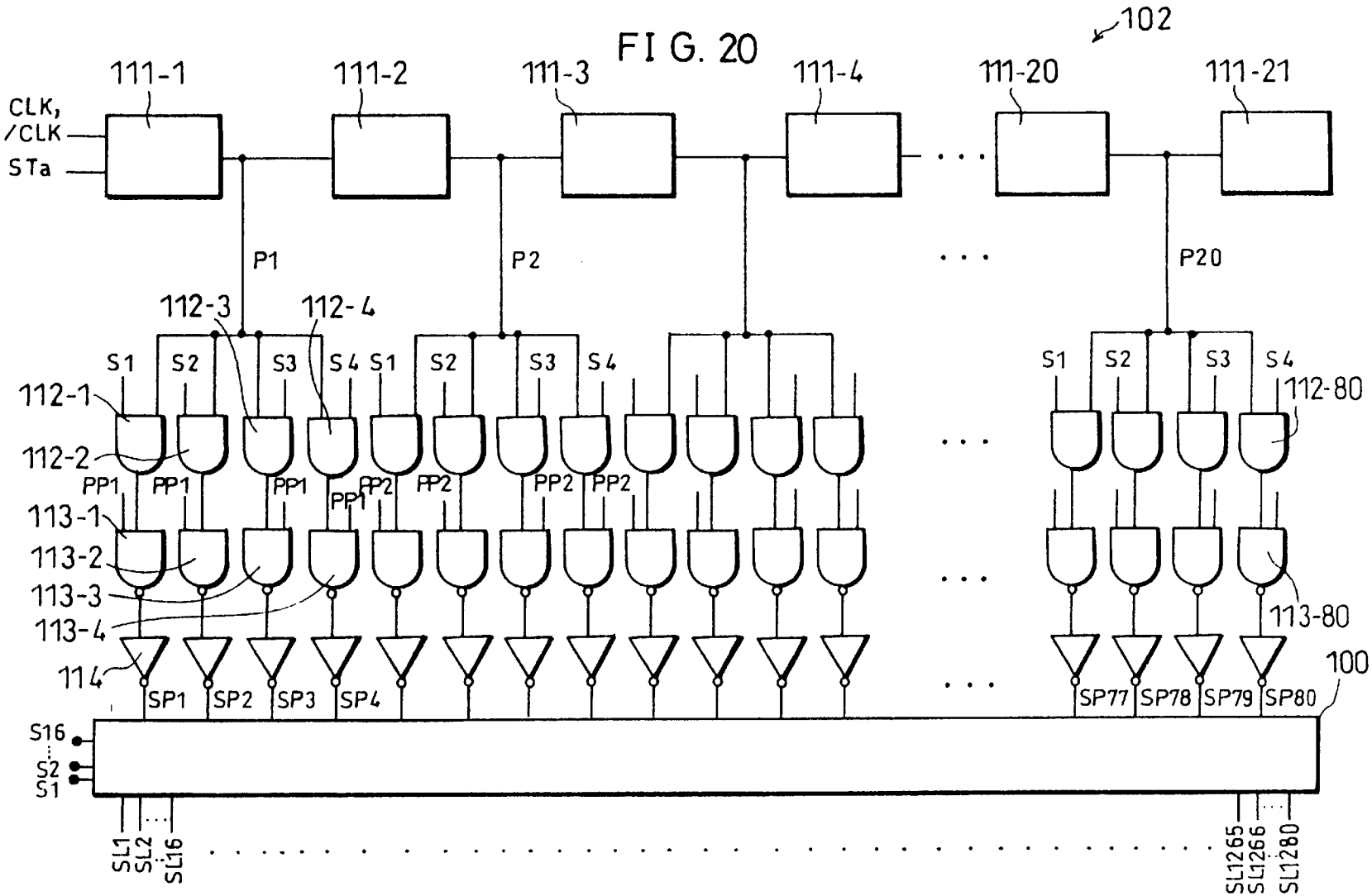
FIG. 20 is a block diagram showing the structure of a horizontal drive circuit of a liquid crystal display device according to a further embodiment of the present invention.
Figure 21:
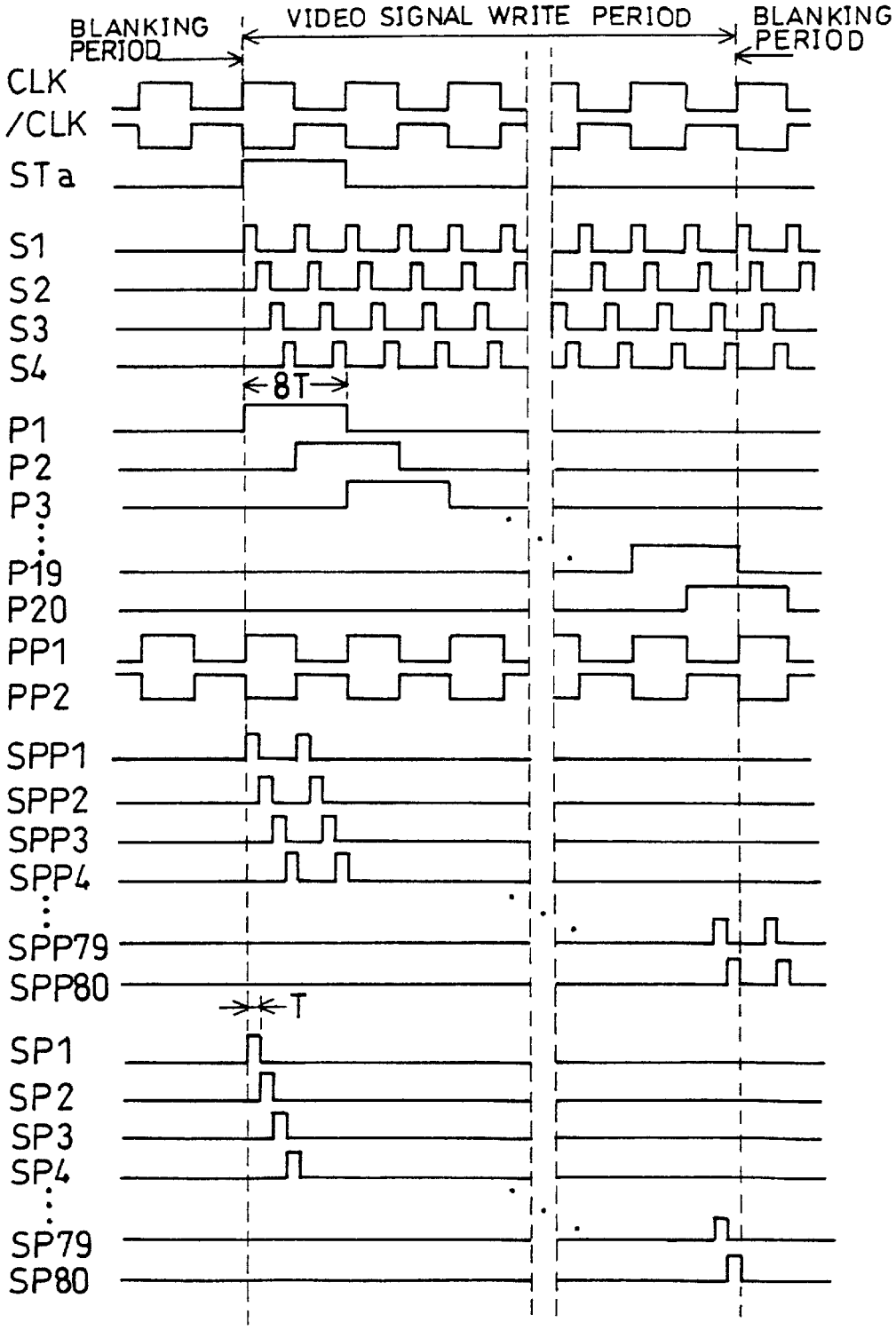
FIG. 21 is a timing chart showing a driving method for the foregoing horizontal drive circuit.
Figure 22:
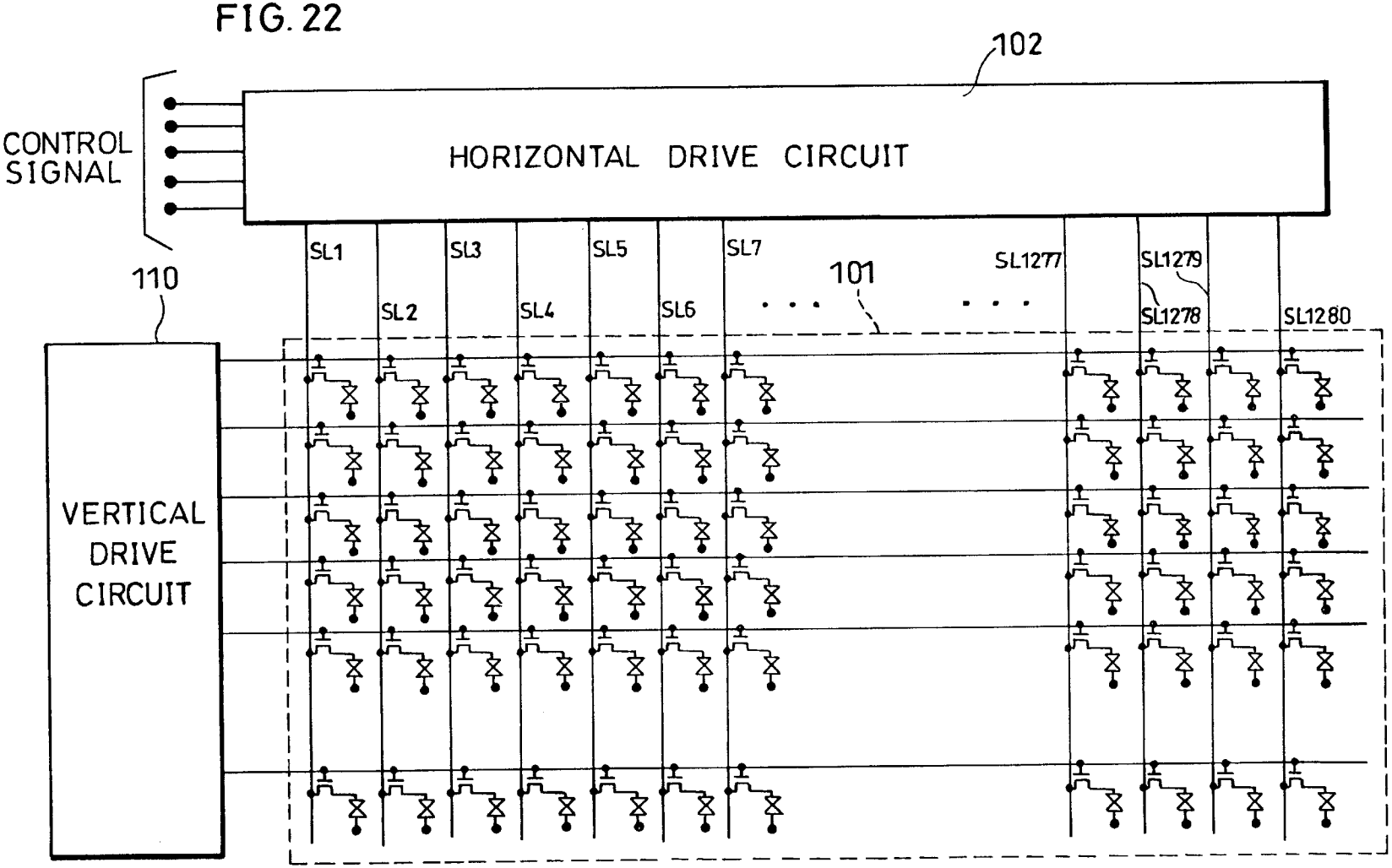
FIG. 22 is a drawing showing the overall structure of the foregoing liquid crystal display device.

The following will explain another embodiment of the present invention with reference to FIGS. 20 through 22.

In the present embodiment, the liquid crystal display device used is of the active matrix type. As shown in FIG. 22, this liquid crystal display device includes an active matrix array 101 made up of TFTs (switching elements), one provided at each intersection between scanning lines and signal lines, a horizontal drive circuit 102 for driving the signal lines, and a vertical drive circuit 110 for driving the scanning lines. In the liquid crystal display device according to the present embodiment, there are 1,280 signal lines, but the number of signal lines is not necessarily limited to this.

As shown in FIG. 20, the horizontal drive circuit 102 (driving means) of the foregoing liquid crystal display device is made up of a plurality of scanning circuits 111-1 through 111-21 having a half-bit structure (hereinafter referred to as "half-bit scanning circuits"), which sequentially shift a start pulse STa by one-half pulse each in synchronization with a clock signal CLK; AND gate circuits 112-1 through 112-80 (first logic gate circuits), which receive signals P1, P2, . . . , P20 outputted by the half-bit scanning circuits 111-1 through 111-21; NAND gate circuits 113-1 through 113-80 (second logic gate circuits), which receive signals SPP1, SPP2, . . . , SPP80 outputted by the AND gate circuits 112-1 through 112-80; and output buffers 114, which receive signals outputted by the NAND gate circuits 113-1 through 113-80, and which output signals SP1, SP2, . . . , SP80. In the present embodiment, each NAND gate circuit 113-1 through 113-80 and the output buffer 114 connected thereto collectively make up each second logic gate circuit. Further, the signal outputted by each output buffer 114 is sent to 16 sample holding switches, as in the conventional structure. In the present and following embodiments, the horizontal drive circuit includes a sample holding switch section 100 made up of a plurality of sample holding switches and a plurality of sample holding capacitances. The sample holding switches and sample holding capacitances of the sample holding switch section 100 are equivalent in structure and function to the sample holding switches 308 and the sample holding capacitances 309 of the conventional example discussed above, and accordingly further explanation thereof will be omitted here.

There are 20 half-bit scanning circuits 111-1 through 111-21 (here, N=20, N being a positive integer) plus an additional scanning circuit 111-21. The final half-bit scanning circuit 111-21 functions as a terminating set, and output is not retrieved therefrom.

To the half-bit scanning circuit 111-1 are inputted the start pulse STa, the clock signal CLK, and an inverted clock signal/CLK.

Each of the AND gate circuits 112-1 through 112-80 is provided with a first control terminal and a second control terminal as input terminals.

The first control terminals of every four (here, M=4, M being an integer no less than 2) adjacent AND gate circuits 112-1 through 112-80 are connected together, and each group of four interconnected first control terminals is connected to an output terminal of one of the half-bit scanning circuits 111-1 through 111-21. As a result, each of the signals P1, P2, . . . , P20 outputted by the half-bit scanning circuits 111-1 through 111-21, respectively, is sent to the first control terminals of four adjacent AND gate circuits 112-1 through 112-80.

There are 80, or 20×4 (N×M) AND gate circuits 112-1 through 112-80. These 80 outputs are later sent to the sample holding switches.

Further, the second control terminal of each AND gate circuit 112-1 through 112-80 receives an external second control signal S1, S2, S3, or S4.

In other words, the second control terminals of every M AND gate circuits 112-1 through 112-80 generally receive M kinds of signal, and since M=4 in the present embodiment, every four adjacent AND gate circuits 112-1 through 112-20 receive the second control signals S1, S2, S3, and S4, respectively. In other words, every fourth AND gate circuit 112-1 through 112-20 receives the same second control signal. Further, the second control terminals receiving the second control signal Si are connected together, those receiving the second control signal S2 are connected together, those receiving the second control signal S3 are connected together, and those receiving the second control signal S4 are connected together.

The NAND gate circuits 113-1 through 113-80 receive signals SPP1, SPP2, . . . , SPP80 outputted by the AND gate circuits 112-1 through 112-80, respectively, and each also receives one of two third control signals PP1 and PP2.

In the present embodiment, the third control signals PP1 and PP2 are sent to alternating groups of four adjacent NAND gate circuits 113-1 through 113-80. In other words, the first four adjacent NAND gate circuits 113-1 through 113-4 receive the third control signal PP1, and the second four adjacent NAND gate circuits 113-5 through 113-8 receive the third control signal PP2. The next four adjacent NAND gate circuits 113-9 through 113-12 receive the third control signal PP1, and the next four adjacent NAND gate circuits 113-13 through 113-16 receive the third control signal PP2. Thereafter, groups of four adjacent NAND gate circuits 113 receiving the third control signal PP1 alternate with groups of four adjacent NAND gate circuits 113 receiving the third control signal PP2.

Signals outputted by the NAND gate circuits 113-1 through 113-80 are inverted by the output buffer circuits 114 and outputted to the sample holding switches as signals SP1, SP2, . . . , SP80.

Figure 33:
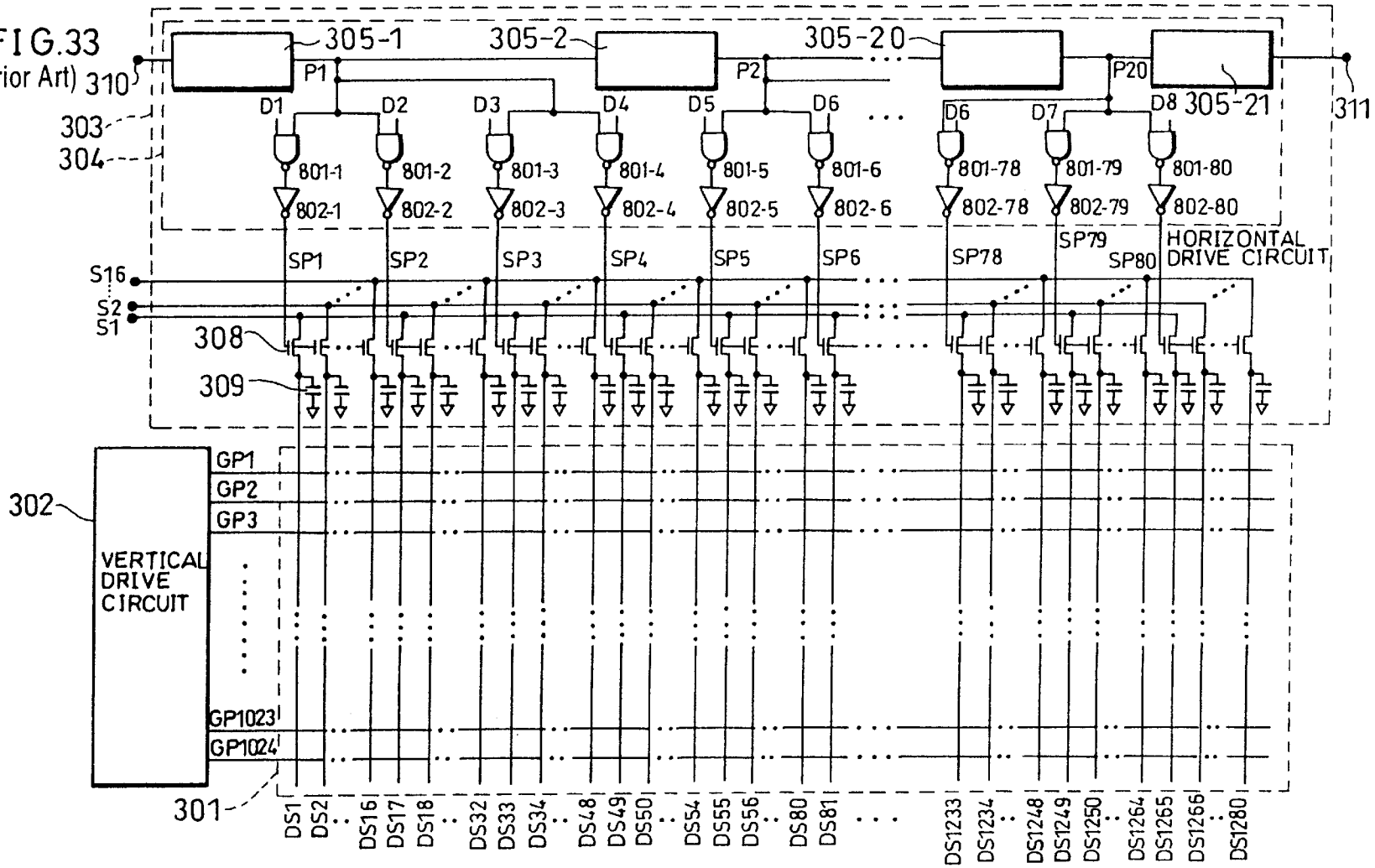
FIG.33 (Prior Art)
FIG. 33 is a drawing showing the overall structure of a conventional liquid crystal display device.
Figure 34:
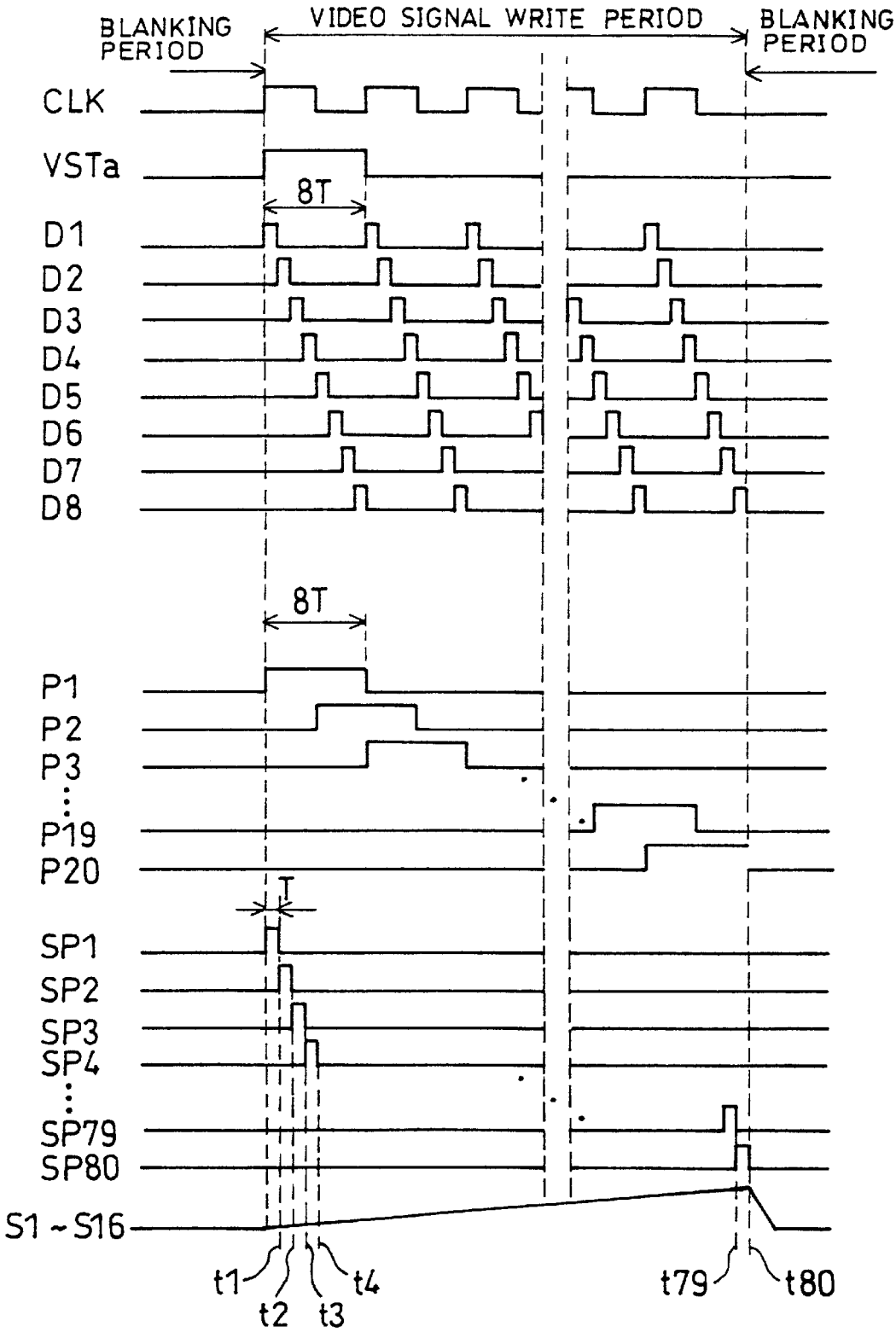
FIG.34 (Prior Art)
FIG. 34 is a timing chart showing a driving method for a horizontal drive circuit of the foregoing conventional liquid crystal display device.

In the horizontal drive circuit 102, by replacing the NAND gate circuits 801-1 through 801-80 shown in FIG. 33 with a combination of the AND gate circuits 112-1 through 112-80 and the NAND gate circuits 113-1 through 113-80, the number of control signals for the AND gate circuits 112-1 through 112-80 can be reduced to half as many as conventionally. Incidentally, the present embodiment uses a combination of the AND gate circuits 112-1 through 112-80 and the NAND gate circuits 113-1 through 113-80, but there is no limitation to this structure. Any circuit structure may be used which fulfills an equivalent function.

A driving method for the liquid crystal display device structured as above is explained in the timing chart for scanning shown in FIG. 21.

First, if T is a period for sampling 16 signal lines, a start pulse STa having a pulse width of 8T and a clock signal CLK and an inverse clock signal/CLK each having a cycle of 8T are inputted to the half-bit scanning circuits 111-1 through 111-21. As a result, the half-bit scanning circuits 111-1 through 111-21 produce signals P1 through P20.

At this time, in the present embodiment, four second control signals S1 through S4, shown in the Figure, are used as control signals for the AND gate circuits 112-1 through 112-80. Accordingly, there are only half as many of these control signals as in the conventional structure.

Incidentally, in the present embodiment, as shown in the Figure, pulses of the second control signals S1 through S4 are also produced during a blanking period immediately following the video signal write period, but there is no limitation to this; these pulses need not be produced during the blanking period.

After receiving the signals P1 through P20 and the second control signals S1 through S4, two output pulses appear in each of the signals SPP1 through SPP80 outputted by the AND gate circuits 112-1 through 112-80, as shown in the Figure. These two output pulses are sent to the NAND gate circuits 113-1 through 113-80. At this time, a third control signal PP1 is sent to the NAND gate circuits 113-1 through 113-4, 113-9 through 113-12, . . . , which receive the output of the odd-numbered half-bit scanning circuits 111-1, 111-3, 111-5 . . . , and a third control signal PP2 is sent to the NAND gate circuits 113-5 through 113-8, 113-13 through 113-16, . . . , which receive the output of the even-numbered half-bit scanning circuits 111-2, 111-4, 111-6 . . . .

As the third control signal PP1, the clock signal CLK inputted into the half-bit scanning circuits 111-1 through 111-21 may be used, and as the third control signal PP2, the inverted clock signal/CLK may be used. For this reason, there is no need to produce further control signals, nor to provide further input terminals for input of external signals.

In this way, the respective signals SP1 through SP80 outputted by the output buffer circuits 114 include pulses having a pulse width of T and phases sequentially shifted by T each. Each of the signals SP1 through SP80 is sent to a plurality of sample holding switches. Then, video signals sampled by the sample holding switches are sent to the signal lines sequentially as output signals SL1, SL2, . . . , SL1280.

By means of the signals SL1, SL2, . . . , SL1280 outputted by the horizontal drive circuit 102, and signals outputted by the vertical drive circuit 110 to the respective scanning lines, an ON/OFF signal can be supplied to the TFT provided at each intersection of the scanning lines and signal lines of the active matrix array 101, and thus display can be performed in each pixel of the screen of the liquid crystal display device.

As a result, reduction of the number of signal lines can contribute to reduction of the size and cost of the liquid crystal display device.

In this way, with the liquid crystal display device and driving method according to the present embodiments, when the 20 half-bit scanning circuits 111-1 through 111-21 of the horizontal drive circuit 102 receive the start pulse STa, the half-bit scanning circuits 111-1 through 111-21 output the signals P1, P2, . . . , P20, which are pulse signals having phases sequentially shifted by one-half of the cycle of the clock signal CLK, which is (2×4×T).

These pulse signals are sent to the first control terminals of the AND gate circuits 112-1 through 112-80, which are (20×4) in number.

Here, of the (20×4=80) AND gate circuits 112-1 through 112-80, the first control terminals of every four adjacent AND gate circuits 112-1 through 112-80 are connected together. Thus the pulse signal outputted by each of the half-bit scanning circuits 111-1 through 111-21 is sent to four AND gate circuits 112-1 through 112-4, 112-5 through 112-8, . . . , 112-77 through 112-80.

Further, the second control terminals of every four adjacent AND gate circuits 112-1 through 112-80 receive different respective second control signals S1 through S4 as additional inputs. Each of the second control signals S1 through S4 is made up of pulses having a cycle of 4T and a pulse width of T.

Consequently, each of the AND gate circuits 112-1 through 112-80 produces two pulses having a pulse width of T, produced ((4−1)×T) apart from each other.

Next, each of the NAND gate circuits 113-1 through 113-80 receives the foregoing two pulses and one of two third control signals PP1 and PP2, each of which is made up of pulses the inverse of the other, and then the NAND gate circuits 113-1 through 113-80 and the output buffers 114 output signals having a pulse width of T.

Accordingly, by sending these signals of pulse width T in sequence to the sample holding switches, in combination with signals sent to the signal lines by the vertical drive circuit 110, each TFT of the active matrix array 101 can be ON/OFF controlled, thus performing display in each pixel of the screen of the liquid crystal display device.

In the conventional structure, since different signals were sent to every 8 (=2×4) NAND gate circuits 801-1 through 801-80 (see FIG. 33), at least 8 (=2×4) control lines were necessary for the NAND gate circuits 801-1 through 801-80. This increased the number of control lines for input to the horizontal drive circuit 303, which increased the surface area used for input pads, and since the control lines themselves had to be conducted to the horizontal drive circuit 303, the surface area devoted thereto in the circuit layout was also increased.

However, in the present embodiment, the control signals inputted to the horizontal drive circuit 102 are the start pulse STa, the clock signal CLK, and the inverted clock signal/CLK inputted to the first half-bit scanning circuit 111-1; the four second control signals S1 through S4 sent to the 80 (=20×4) AND gate circuits 112-1 through 112-80; and the two third control signals PP1 and PP2 sent to the NAND gate circuits 113-1 through 113-80. In other words, the second control terminals of every fourth AND gate circuit 112-1 through 112-80 are connected together. For this reason, there are four kinds of second control terminal, or half as many as conventionally.

Further, lines are dispersed between the AND gate circuits 112-1 through 112-80 and the NAND gate circuits 113-1 through 113-80, thus preventing concentration of control lines.

As a result, it is possible to provide a liquid crystal display device which is operated by a small number of driving signals, and which is capable of improving production efficiency.

Further, in the present embodiment, the clock signal CLK and the inverted clock signal/CLK are used for the third control signals PP1 and PP2. For this reason, there is no need to provide further control lines for inputting the control signals to the horizontal drive circuit 102.

In the conventional structure, the number of control lines for input to the horizontal drive circuit 303 was increased, which increased the surface area used for input pads, and since the control lines themselves had to be conducted to the horizontal drive circuit 303, the surface area devoted thereto in the circuit layout was also increased. However, in the present embodiment, this can be prevented by using existing control lines.

Accordingly, it is possible to provide a liquid crystal display device and a driving method therefor which use a small number of driving signals, and which are capable of improving production efficiency.

[Fifteenth Embodiment]

Figure 23:
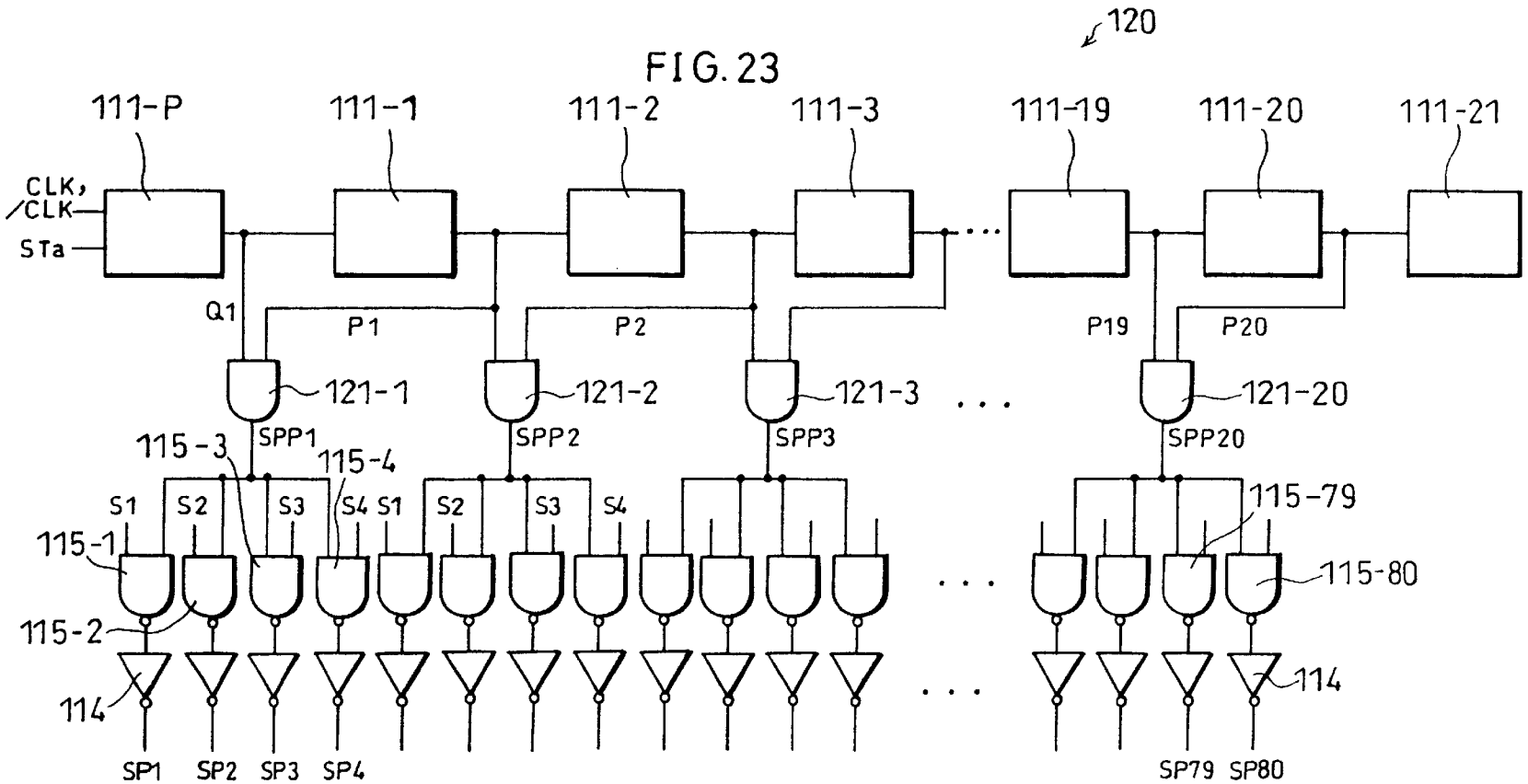
FIG. 23 is a block diagram showing the structure of a horizontal drive circuit of a liquid crystal display device according to a further embodiment of the present invention.
Figure 24:
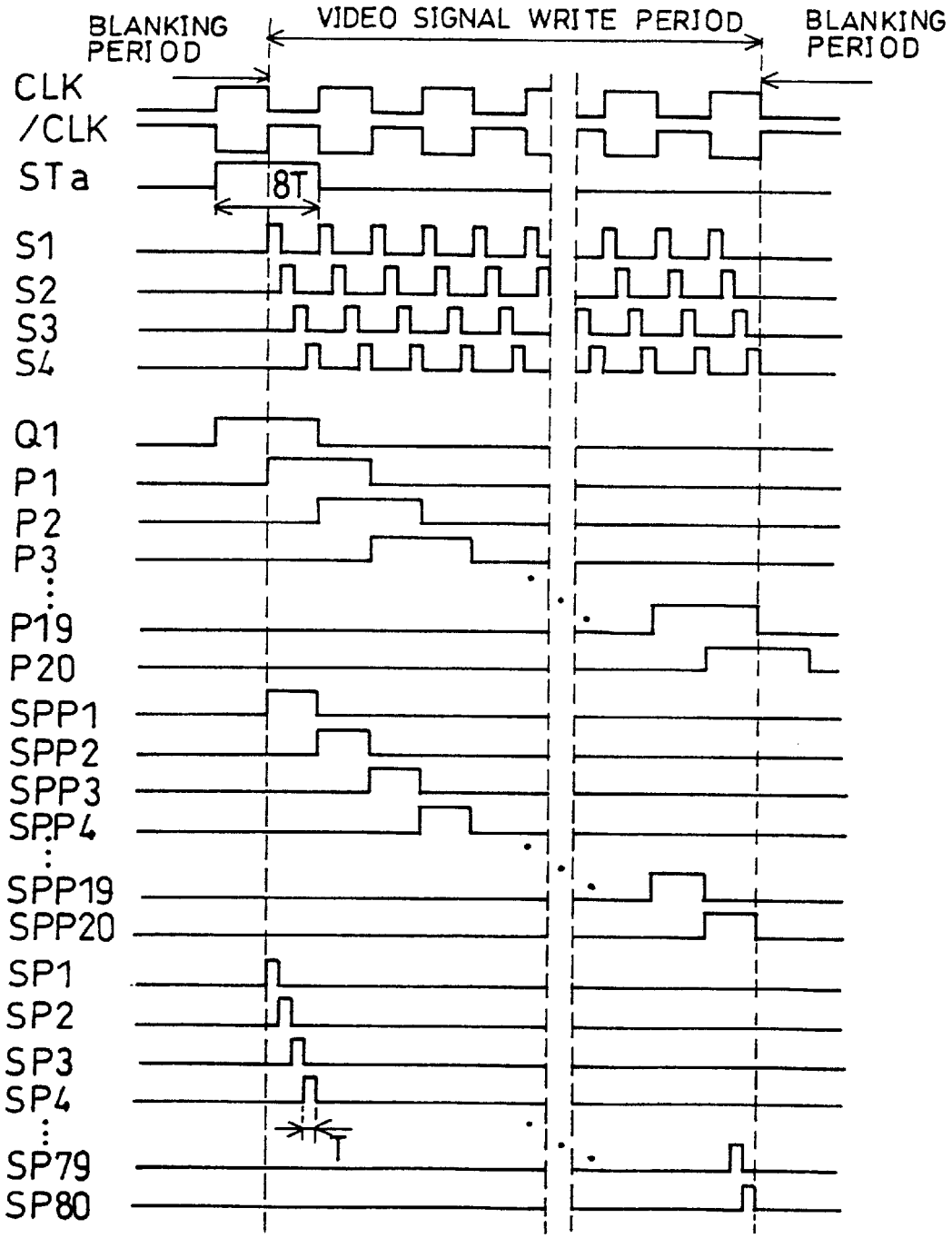
FIG. 24 is a timing chart showing a driving method for the foregoing horizontal drive circuit.

The following will explain another embodiment of the present invention with reference to FIGS. 23 and 24. For ease of explanation, members having the same functions as those shown in the drawings pertaining to the fourteenth embodiment above will be given the same reference symbols, and explanation thereof will be omitted here.

As shown in FIG. 23, a horizontal drive circuit 120 of a liquid crystal display device according to the present embodiment is made up of half-bit scanning circuits 111-P and 111-1 through 111-21, which sequentially shift a start pulse STa by one-half pulse each in synchronization with a clock signal CLK; AND gate circuits 121-1 through 121-20 (fourth logic gate circuits), each of which receives a pair of signals Q1 and P1, P1 and P2, . . . , P19 and P20 outputted by the half-bit scanning circuits 111-P and 111-1 through 111-21; NAND gate circuits 115-1 through 115-80 (third log c gate circuits), which receive signals SPP1, SPP2, SPP20 outputted by the AND gate circuits 121-1 through 121-20, and second control signals S1, S2, S3, and S4; and output buffers 114, which receive signals outputted by the NAND gate circuits 115-1 through 115-80, and which output signals SP1, SP2, . . . , SP-80.

In the present embodiment, each NAND gate circuit 115-1 through 115-80 and the output buffer 114 connected thereto collectively make up each third logic gate circuit.

Further, the AND gate circuits 121-1 through 121-20, each of which receives pulses outputted by two adjacent scanning circuits of the extra half-bit scanning circuit 11-P and the 20 half-bit scanning circuits 111-1 through 111-21, function as pulse width reducing means, which reduce the respective pulse widths of the pulses outputted by the half-bit scanning circuits 111-P and 111-1 through 111-21.

A characteristic feature of the horizontal drive circuit 120 is that, by providing the AND gate circuits 121-1 through 121-21 between the half-bit scanning circuits 111-P and 111-1 through 111-21 and the NAND gate circuits 115-1 through 115-80, the number of second control signals can be reduced to the four second control signals S1 through S4, half as many as conventionally.

Further, each AND gate circuit 121-1 through 121-20 receives signals outputted by two adjacent half-bit scanning circuits 111-P and 111-1 through 111-21. Since the AND gate circuits 121-1 through 121-20 must provide 20 output signals, an extra half-bit scanning circuit 111-P is provided before the half-bit scanning circuit 111-1. Incidentally, the extra half-bit scanning circuit 111-P may instead be provided after the half-bit scanning circuit 111-21.

A driving method for the liquid crystal display device structured as above is explained in the timing chart for scanning shown in FIG. 24.

First, if T is a period for sampling 16 signal lines, a start pulse STa having a pulse width of 8T and a clock signal CLK and an inverse clock signal/CLK each having a cycle of 8T are inputted to the half-bit scanning circuits 111-P and 111-1 through 111-21.

As a result, the half-bit scanning circuits 111-P and 111-1 through 111-21 produce signals Q1 and P1 through P20. Then, the signals Q1 and P1, P1 and P2, . . . , P19 and P20 outputted by each pair of adjacent half-bit scanning circuits 111-P and 111-1 through 111-21 are sent to one of the AND gate circuits 121-1 through 121-20, and the AND gate circuits 121-1 through 121-20 output signals SPP1, SPP2, . . . , SPP20 having a pulse width of 4T, which is half of that of the pulses outputted by the half-bit scanning circuits 111-P and 111-1 through 111-21.

Next, the signals SPP1 through SPP20 are sent to the NAND gate circuits 115-1 through 115-80, and, as control signals for the NAND gate circuits 115-1 through 115-80, four second control signals S1 through S4, shown in the Figure, are used. Accordingly, there are only half as many of these control signals as in the conventional structure.

In this way, pulses having a pulse width of T and phases sequentially shifted by T each are produced in the respective signals SP1 through SP80 outputted by the output buffer circuits 114. Each of the signals SP1 through SP80 is sent to a plurality of sample holding switches.

As a result, reduction of the number of signal lines can contribute to reduction of the size and cost of the liquid crystal display device.

In this way, with the liquid crystal display device and driving method according to the present embodiment, when the extra half-bit scanning circuit 111-P and the 20 half-bit scanning circuits 111-1 through 111-21 of the horizontal drive circuit 120 receive the start pulse STa, the half-bit scanning circuits 111-P and 111-1 through 111-21 output the signals Q1, P1, P2, . . . , P20, which are pulse signals having phases sequentially shifted by one-half of the cycle of the clock signal CLK, which is (2×4×T).

These pulse signals are sent to the AND gate circuits 121-1 through 121-20 (pulse width reducing means), which reduce the pulse width of the pulse signals from the half-bit scanning circuits 111-P and 111-1 through 111-21, thereby producing pulses having a pulse width of 4T.

The pulses outputted by the AND gate circuits 121-1 through 121-20 are sent to the first control terminals of the (20×4=80) NAND gate circuits 115-1 through 115-80.

Here, of the (20×4=80) NAND gate circuits 115-1 through 115-80, the first control terminals of every four adjacent NAND gate circuits 115-1 through 115-80 are connected together. Thus the pulse outputted by each AND gate circuit 121-1 through 121-20 is sent to four NAND gate circuits 115-1 through 115-4, 115-5 through 115-8, . . . , 115-77 through 115-80.

Further, the second control terminals of every four adjacent NAND gate circuits 115-1 through 115-80 receive different respective second control signals S1 through S4 as second inputs. Each of the second control signals S1 through S4 is made up of pulses having a cycle of 4T and a pulse width of T.

Consequently, the NAND gate circuits 115-1 through 115-1024 and the output buffers 114 output signals having a pulse width of T.

Accordingly, by sending these signals of pulse width T in sequence to the sample holding switches, in combination with signals sent to the scanning lines by the vertical drive circuit 110, each TFT of the active matrix array 101 can be ON/OFF controlled, thus performing display in each pixel of the screen of the liquid crystal display device.

In the conventional structure, since different signals were sent to every 8 (=2×4) NAND gate circuits 801-1 through 801-80 (see FIG. 33), at least 8 (=2×4) control lines were necessary for the NAND gate circuits 801-1 through 801-80. This increased the number of control lines for input to the horizontal drive circuit 303, which increased the surface area used for input pads, and since the control lines themselves had to be conducted to the horizontal drive circuit 303, the surface area devoted thereto in the circuit layout was also increased.

However, in the present embodiment, by providing the AND gate circuits 121-1 through 121-20 (pulse width reducing means), which reduce the pulse width of the pulse signals from the half-bit scanning circuits 111-P and 111-1 through 111-21, the second control terminals of every fourth NAND gate circuit 115-1 through 115-80 can be connected together. Accordingly, there are four kinds of second control terminal, or half as many as conventionally.

Further, lines are dispersed between the AND gate circuits 121-1 through 121-20 and the NAND gate circuits 115-1 through 115-80, thus preventing concentration of control lines.

As a result, it is possible to provide a liquid crystal display device and a driving method therefor which use a small number of driving signals, and which are capable of improving production efficiency.

Further, in the liquid crystal display device according to the present embodiment, in particular, pulse width reducing means, which reduce the pulse width of the pulse signals from the half-bit scanning circuits 111-P and 111-1 through 111-21, are structured as the AND gate circuits 121-1 through 121-20, each of which receives pulses outputted by each pair of adjacent half-bit scanning circuits 111-P and 111-1 through 111-21.

As a result, it is possible to provide with certainty a liquid crystal display device and a driving method therefor which use a small number of driving signals, and which are capable of improving production efficiency.

[Sixteenth Embodiment]

Figure 25:
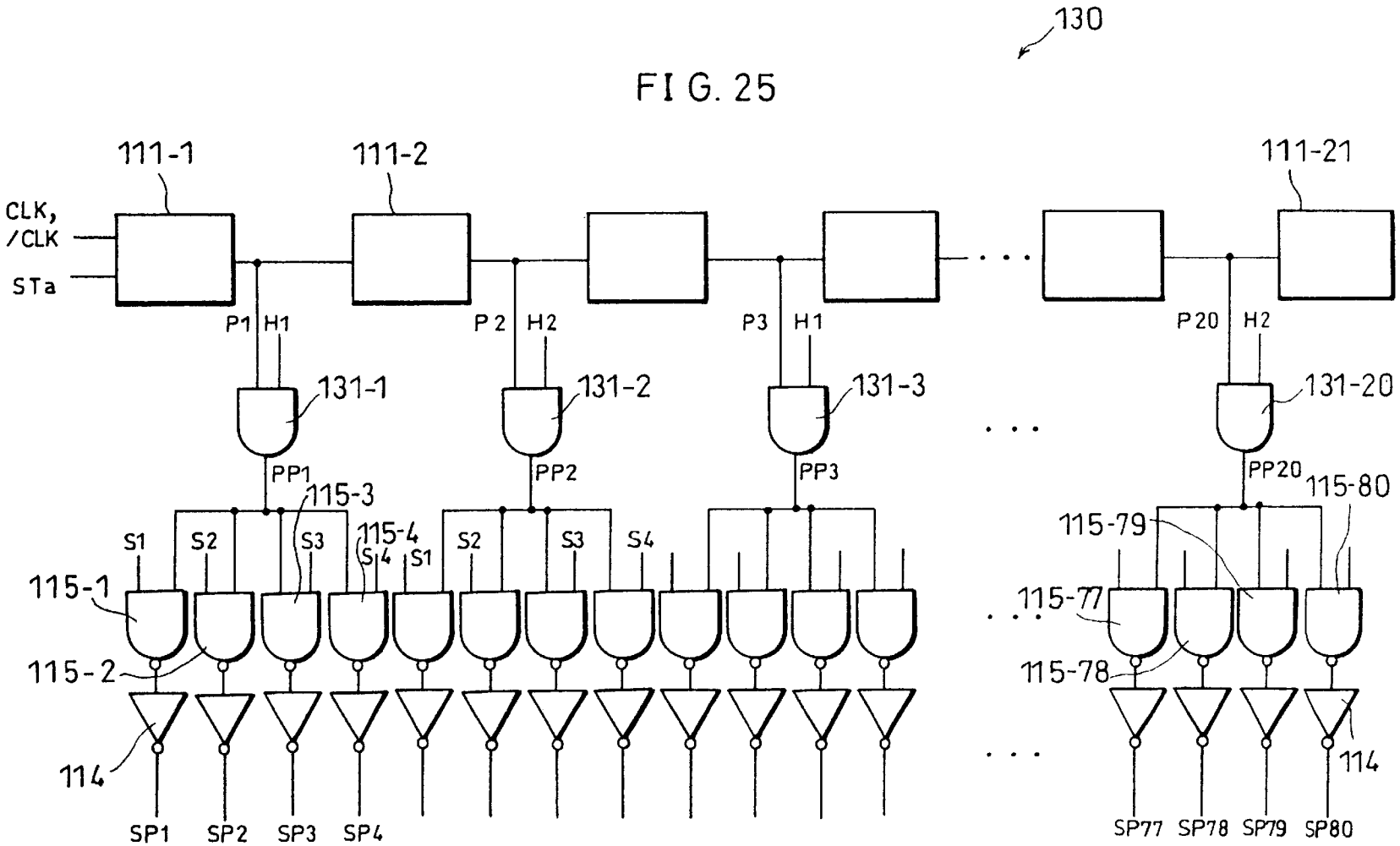
FIG. 25 is a block diagram showing the structure of a horizontal drive circuit of a liquid crystal display device according to a further embodiment of the present invention.
Figure 26:
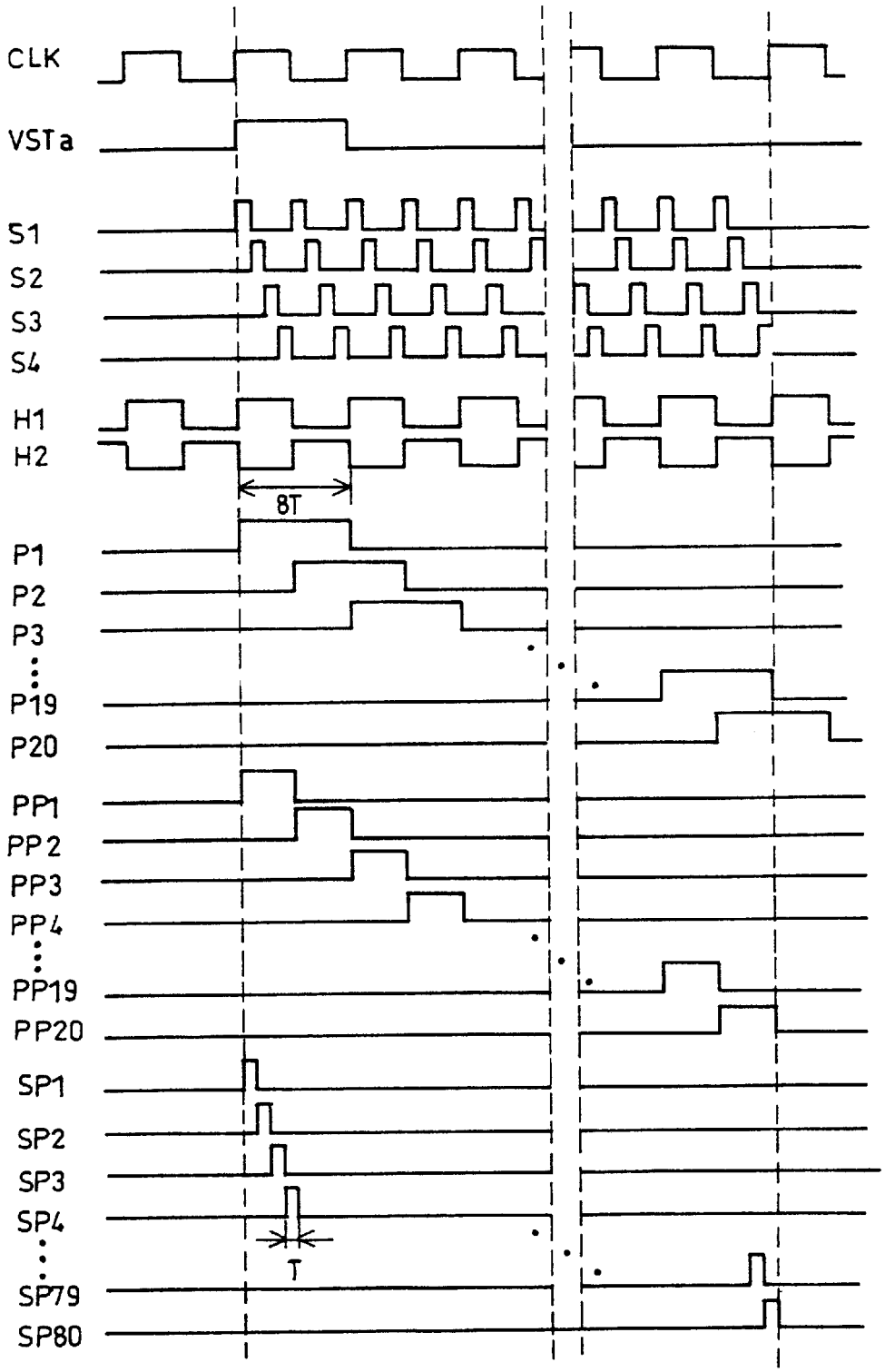
FIG. 26 is a timing chart showing a driving method for the foregoing horizontal drive circuit.

The following will explain another embodiment of the present invention with reference to FIGS. 25 and 26. For ease of explanation, members having the same functions as those shown in the drawings pertaining to the fourteenth and fifteenth embodiments above will be given the same reference symbols, and explanation thereof will be omitted here.

As shown in FIG. 25, a horizontal drive circuit 130 of a liquid crystal display device according to the present embodiment is made up of half-bit scanning circuits 111-1 through 111-21, which sequentially shift a start pulse STa by one-half pulse each in synchronization with a clock signal CLK; AND gate circuits 131-1 through 131-20 (pulse width reducing means; fifth logic gate circuits), each of which receives signals P1, P2, . . . , P20 outputted by the half-bit scanning circuits 111-1 through 111-21, and fourth control signals H1 and H2; NAND gate circuits 115-1 through 115-80, which receive signals PP1, PP2, . . . , PP20 outputted by the AND gate circuits 131-1 through 131-20, and second control signals S1, S2, S3, and S4; and output buffers 114, which receive signals outputted by the NAND gate circuits 115-1 through 115-80, and which output signals SP1, SP2, . . . , SP80.

A characteristic feature of the horizontal drive circuit 130 is that, by providing the AND gate circuits 131-1 through 131-20, the number of control signals for the NAND gate circuits 115-1 through 115-80 can be reduced to half as many as conventionally.

A driving method for the liquid crystal display device structured as above is explained in the timing chart for scanning shown in FIG. 26.

First, if T is a period for sampling 16 signal lines, a start pulse STa having a pulse width of 8T and a clock signal CLK and an inverse clock signal/CLK each having a cycle of 8T are inputted to the half-bit scanning circuits 111-1 through 111-21.

As a result, the half-bit scanning circuits 111-1 through 111-21 produce signals P1 through P20. Then, each of the AND gate circuits 131-1 through 131-20 receives one of the signals P1 through P20 outputted by the half-bit scanning circuits 111-1 through 111-21 and one of two fourth control signals H1 and H2. Consequently, the AND gate circuits 131-1 through 131-20 output signals PP1, PP2, . . . , PP20 having a pulse width of half of that of the pulses outputted by the half-bit scanning circuits 111-1 through 111-21.

Next, the signals PP1 through PP20 are sent to the NAND gate circuits 115-1 through 115-80, and, as control signals for the NAND gate circuits 115-1 through 115-80, four second control signals S1 through S4, shown in the Figure, are used. Accordingly, there are only half as many of these control signals as in the conventional structure.

In this way, the respective signals SP1 through SP80 outputted by the output buffer circuits 114 include pulses having a pulse width of T and phases sequentially shifted by T each. Each signal SP1 through SP80 is sent to a plurality of sample holding switches.

As a result, reduction of the number of signal lines can contribute to reduction of the size and cost of the liquid crystal display device.

In this way, with the liquid crystal display device and driving method according to the present embodiment, when the 20 half-bit scanning circuits 111-1 through 111-21 of the horizontal drive circuit 130 receive the start pulse STa, the half-bit scanning circuits 111-1 through 111-21 output the signals P1, P2, . . . , P20, which are pulse signals having phases sequentially shifted by one-half of the cycle of the clock signal CLK, which is (2×4×T).

These pulse signals are sent to the AND gate circuits 131-1 through 131-20 (pulse width reducing means), which reduce the pulse width of the pulse signals from the half-bit scanning circuits 111-1 through 111-21, thereby producing pulses having a pulse width of (M×T). The pulses outputted by the AND gate circuits 131-1 through 131-20 are sent to the first control terminals of the (20×4=80) NAND gate circuits 115-1 through 115-80.

Here, of the (20×4=80) NAND gate circuits 115-1 through 115-80, the first control terminals of every four adjacent NAND gate circuits 115-1 through 115-80 are connected together. Thus the pulse outputted by each AND gate circuit 131-1 through 131-20 is sent to four NAND gate circuits 115-1 through 115-4, 115-5 through 115-8, . . . , 115-77 through 115-80.

Further, the second control terminals of every four adjacent NAND gate circuits 115-1 through 115-80 receive different respective second control signals S1 through S4 as additional inputs. Each of the second control signals S1 through S4 is made up of pulses having a cycle of 4T and a pulse width of T.

Consequently, the signals outputted by the NAND gate circuits 115-1 through 115-80 and by the output buffers 114 are signals having a pulse width of T.

Accordingly, by sending these signals of pulse width T in sequence to the sample holding switches, in combination with signals sent to the scanning lines by the vertical drive circuit 110, each TFT of the active matrix array 101 can be ON/OFF controlled, thus performing display in each pixel of the screen of the liquid crystal display device.

In the conventional structure, since different signals were sent to every 8 (=2×4) NAND gate circuits 801-1 through 801-80 (see FIG. 33), at least 8 (=2×4) control lines were necessary for the NAND gate circuits 801-1 through 801-80. This increased the number of control lines for input to the horizontal drive circuit 303, which increased the surface area used for input pads, and since the control lines themselves had to be conducted to the horizontal drive circuit 303, the surface area devoted thereto in the circuit layout was also increased.

However, in the present embodiment, by providing the AND gate circuits 131-1 through 131-20 (pulse width reducing means), which reduce the pulse width of the pulse signals from the half-bit scanning circuits 111-1 through 111-21, the second control terminals of every fourth NAND gate circuit 115-1 through 115-80 can be connected together. Accordingly, there are four kinds of second control terminal, or half as many as conventionally.

Further, lines are dispersed between the AND gate circuits 131-1 through 131-20 and the NAND gate circuits 115-1 through 115-80, thus preventing concentration of control lines.

As a result, it is possible to provide a liquid crystal display device and a driving method therefor which use a small number of driving signals, and which are capable of improving production efficiency.

Further, in the liquid crystal display device and driving method according to the present embodiment, in particular, the pulse width reducing means are structured as the AND gate circuits 131-1 through 131-20, each of which receives a pulse outputted by one of the half-bit scanning circuits 111-1 through 111-21 and one of two fourth control signals H1 and H2 having a cycle of (2×4×T) and a pulse width of 4T, each of which is the inverse of the other.

With this structure, it is possible to provide with certainty a liquid crystal display device and a driving method therefor which use a small number of driving signals, and which are capable of improving production efficiency.

Further, in the liquid crystal display device and driving method according to the present embodiment, the clock signal CLK and the inverted clock signal/CLK are used for the fourth control signals H1 and H2. For this reason, there is no need to provide further control lines for inputting the fourth control signals H1 and H2 to the horizontal drive circuit 130, nor to produce further signals in an external circuit.

In the conventional structure, the number of control lines for input to the horizontal drive circuit 303 was increased, which increased the surface area used for input pads, and since the control lines themselves had to be conducted to the horizontal drive circuit 303, the surface area devoted thereto in the circuit layout was also increased. However, in the present embodiment, this can be prevented by using existing control lines.

Accordingly, it is possible to provide a liquid crystal display device and a driving method therefor which use a small number of driving signals, and which are capable of improving production efficiency.

[Seventeenth Embodiment]

Figure 27:
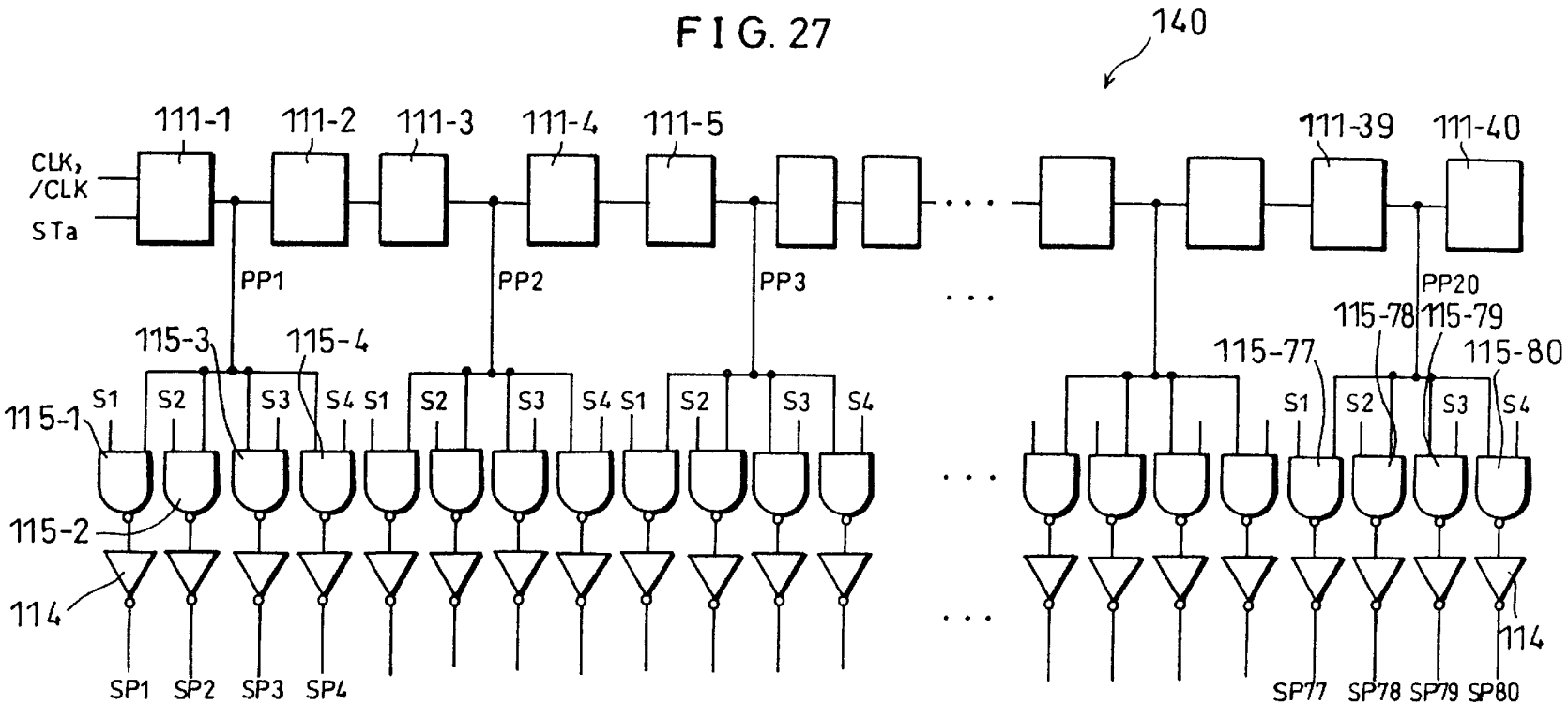
FIG. 27 is a block diagram showing the structure of a horizontal drive circuit of a liquid crystal display device according to a further embodiment of the present invention.
Figure 28:
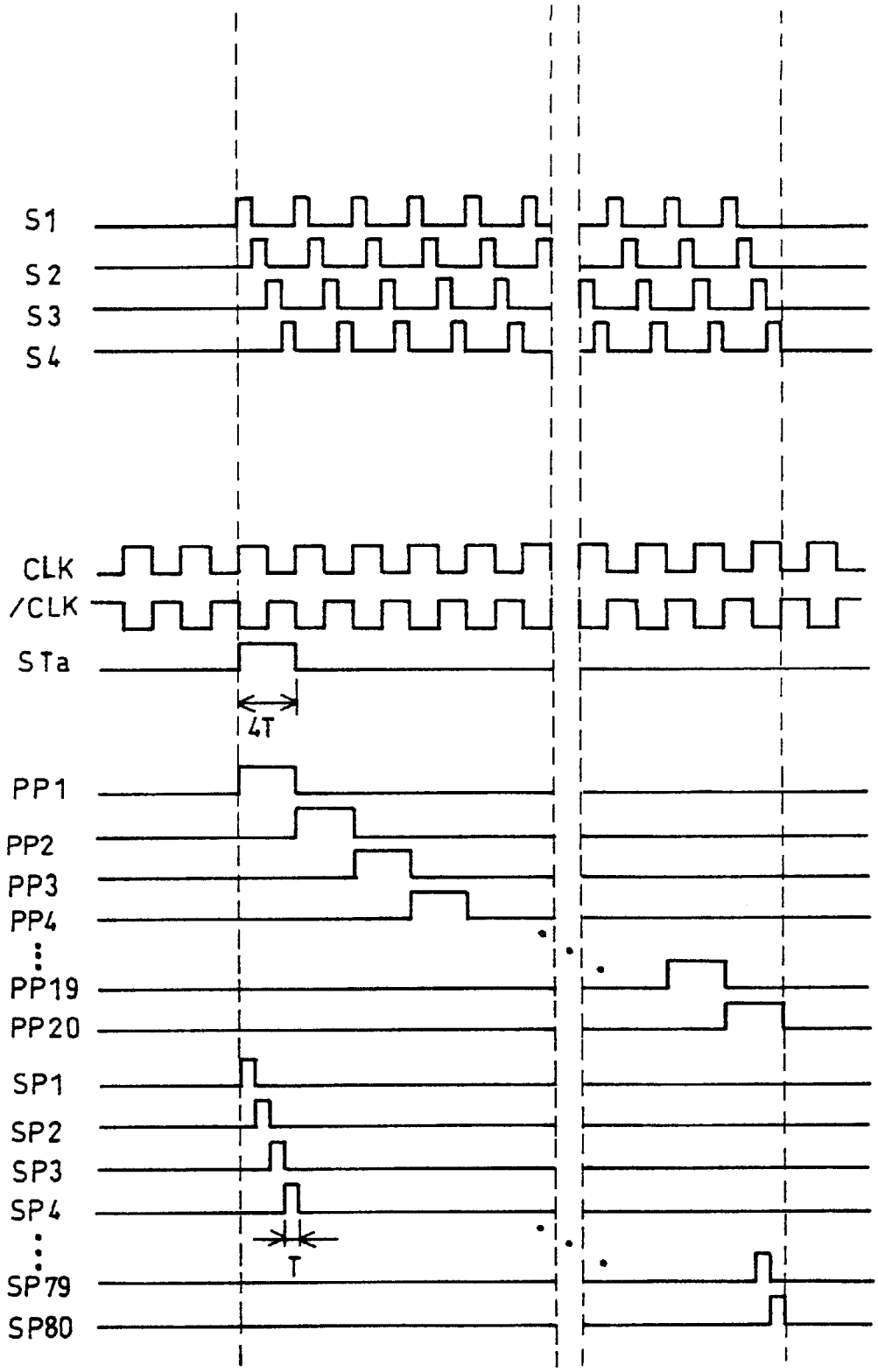
FIG. 28 is a timing chart showing a driving method for the foregoing horizontal drive circuit.

The following will explain another embodiment of the present invention with reference to FIGS. 27 and 28. For ease of explanation, members having the same functions as those shown in the drawings pertaining to the fourteenth through sixteenth embodiments above will be given the same reference symbols, and explanation thereof will be omitted here.

As shown in FIG. 27, a vertical drive circuit 140 of a liquid crystal display device according to the present embodiment is made up of half-bit scanning circuits 111-1 through 111-40, which sequentially shift a start pulse STa by one-half pulse each in synchronization with a clock signal CLK; NAND gate circuits 115-1 through 115-80 (sixth logic gate circuits), each of which receives signals PP1, PP2, . . . , PP20 outputted by every other half-bit scanning circuit 111-1 through 111-40, and second control signals S1, S2, S3, and S4; and output buffers 114, which receive signals outputted by the NAND gate circuits 115-1 through 115-80, and which output signals SP1, SP2, . . . , SP80.

A characteristic feature of the vertical drive circuit 140 is that, by providing twice as many half-bit scanning circuits 111-1 through 111-40 as in the fourteenth through sixteenth embodiments above, and eliminating overlap of output pulses by retrieving output from every other half-bit scanning circuit 111-1 through 111-40, the number of control signals for the NAND gate circuits 115-1 through 115-80 can be reduced to half as many as conventionally.

A driving method for the liquid crystal display device structured as above is explained in the timing chart for scanning shown in FIG. 28.

First, if T is a period for sampling 16 signal lines, a start pulse STa having a pulse width of 4T and a clock signal CLK and an inverse clock signal /CLK each having a cycle of 4T are inputted to the half-bit scanning circuits 111-1 through 111-40. Then, by retrieving output from every other half-bit scanning circuit 111-1 through 111-40, signals PP1 through PP20, the pulses of which do not overlap with each other, are produced.

Next, the signals PP1 through PP20 are sent to the NAND gate circuits 115-1 through 115-80, and, as control signals for the NAND gate circuits 115-1 through 115-80, four second control signals S1 through S4, shown in the Figure, are used. Accordingly, there are only half as many of these control signals as in the conventional structure.

In this way, the respective signals outputted by the NAND gate circuits 115-1 through 115-80 and the respective signals SP1 through SP80 outputted by the output buffer circuits 114 include pulses having a pulse width of T and phases sequentially shifted by T each. Each signal SP1 through SP80 is sent to a plurality of sample holding switches.

As a result, reduction of the number of signal lines can contribute to reduction of the size and cost of the liquid crystal display device.

In this way, with the liquid crystal display device and driving method according to the present embodiment, when the (2×20) half-bit scanning circuits 111-1 through 111-40 of the vertical drive circuit 140 receive the start pulse STa having a pulse width of 4T, the half-bit scanning circuits 111-1 through 111-40 produce pulse signals having phases sequentially shifted by one-half of the cycle of the clock signal CLK, which is 4T. Accordingly, the respective output signals PP1 through PP20 retrieved from every other half-bit scanning circuits 111-1 through 111-40 are sequentially shifted by one cycle each.

These pulse signals are sent to the first control terminals of the (20×4=80) NAND gate circuits 115-1 through 115-80.

Here, of the (20×4=80) NAND gate circuits 115-1 through 115-80, the first control terminals of every four adjacent NAND gate circuits 115-1 through 115-80 are connected together. Thus the pulse outputted by every other half-bit scanning circuit 111-1, 111-3, 111-5, 111-39 is sent to four NAND gate circuits 115-1 through 115-4, 115-5 through 115-8, . . . , 115-77 through 115-80.

Further, the second control terminals of every four adjacent NAND gate circuits 115-1 through 15-80 receive different respective second control signals S1 through S4 as additional inputs. Each of the second control signals S1 through S4 is, made up of pulses having a cycle of 4T and a pulse width of T.

Consequently, the signals outputted by the NAND gate circuits 115-1 through 115-80 and the output buffers 114 are signals having a pulse width of T.

Accordingly, by sending these signals of pulse width T in sequence to the sample holding switches, in combination with signals sent to the scanning lines by the vertical drive circuit 110, each TFT of the active matrix array 101 can be ON/OFF controlled, thus performing display in each pixel of the screen of the liquid crystal display device.

In the conventional structure, since different signals were sent to every 8 (=2×4) NAND gate circuits 801-1 through 801-80 (see FIG. 33), at least 8 (=2×4) control lines were necessary for the NAND gate circuits 801-1 through 801-80. This increased the number of control lines for input to the horizontal drive circuit 303, which increased the surface area used for input pads, and since the control lines themselves had to be conducted to the vertical drive circuit 303, the surface area devoted thereto in the circuit layout was also increased.

However, in the present embodiment, the half-bit scanning circuits 111-1 through 111-40, which sequentially shift an inputted start pulse STa by one-half of the cycle of the clock signal CLK, are (2×20) in number, and output is retrieved from every other half-bit scanning circuit 111-1, 111-3, 111-5, . . . , 111-40. Consequently, the respective output signals PP1 through PP20 are sequentially shifted by one cycle each.

As a result, it is possible to connect the second control terminals of every four NAND gate circuits 115-1 through 115-80. Accordingly, there are four kinds of second control terminal, or half as many as conventionally.

Accordingly, it is possible to provide a liquid crystal display device and a driving method therefor which use a small number of driving signals, and which are capable of improving production efficiency.

[Eighteenth Embodiment]

Figure 29:
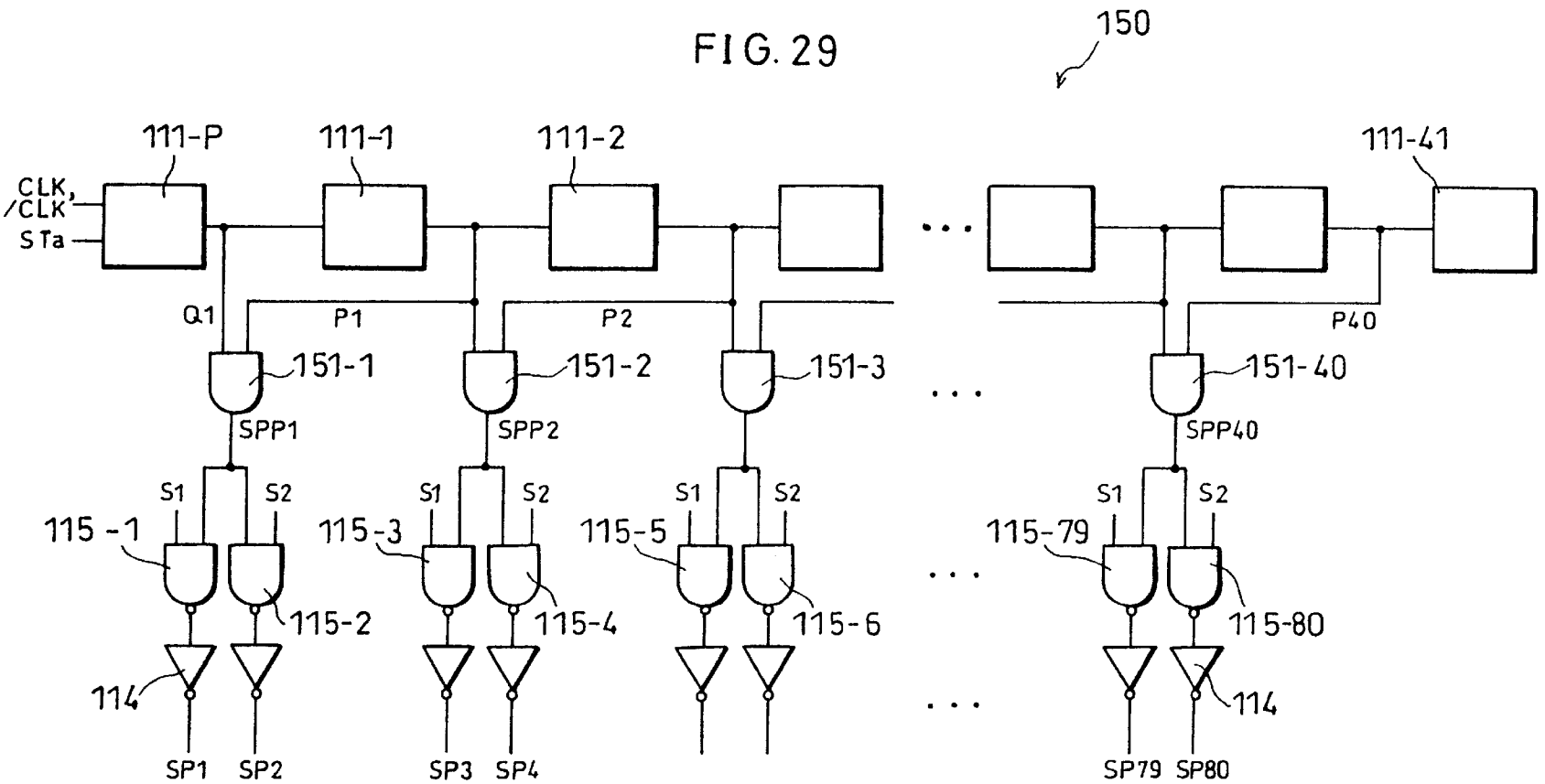
FIG. 29 is a block diagram showing the structure of a horizontal drive circuit of a liquid crystal display device according to a further embodiment of the present invention.
Figure 30:
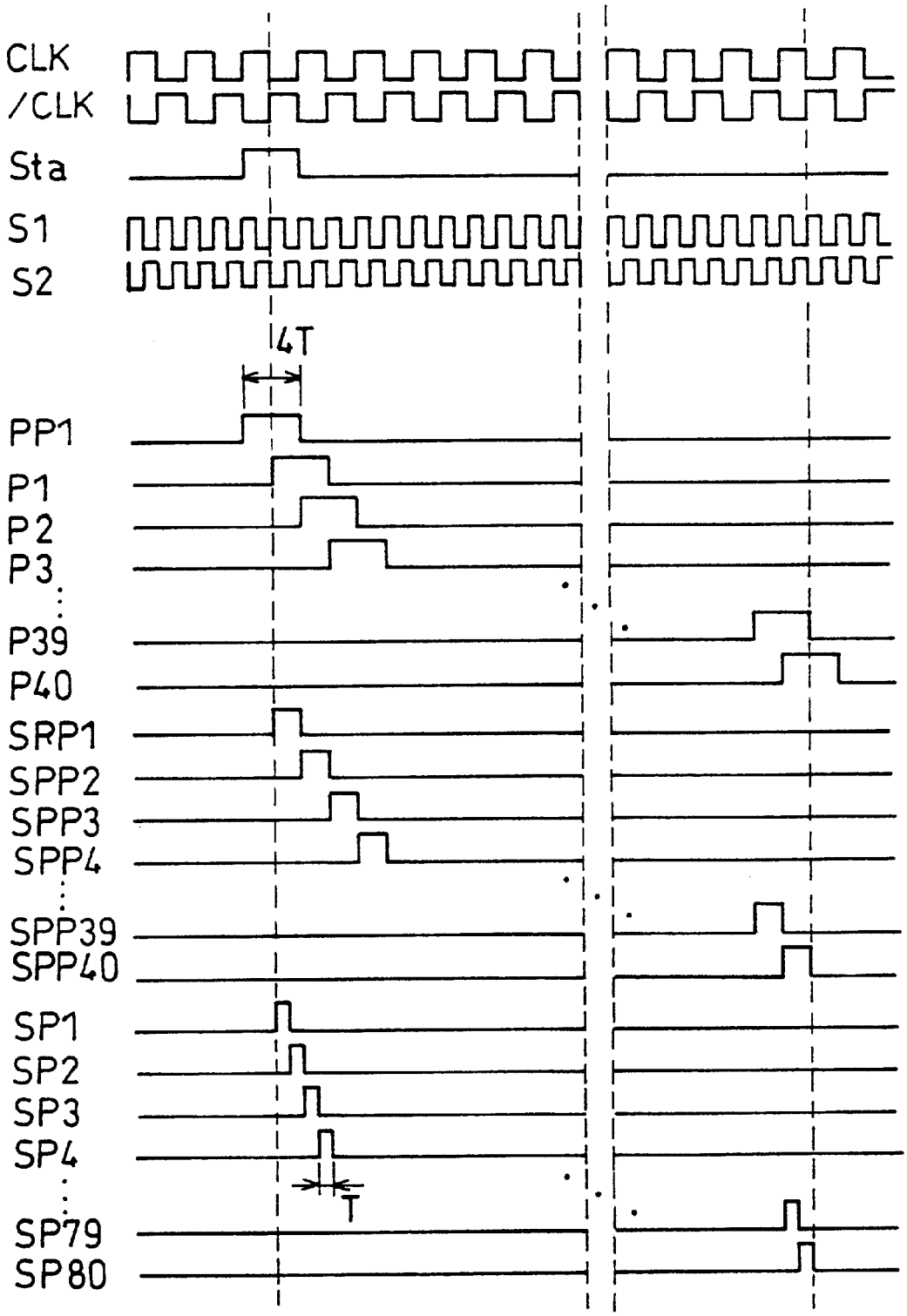
FIG. 30 is a timing chart showing a driving method for the foregoing horizontal drive circuit.

The following will explain another embodiment of the present invention with reference to FIGS. 29 and 30. For ease of explanation, members having the same functions as those shown in the drawings pertaining to the fourteenth through seventeenth embodiments above will be given the same reference symbols, and explanation thereof will be omitted here.

In each of the fourteenth through seventeenth embodiments above, the output signal of each scanning circuit was used to drive 4×16 signal lines, but the present embodiment explains a case in which the output signal of each scanning circuit is used to drive 2×16 signal lines.

As shown in FIG. 29, a horizontal drive circuit 150 of a liquid crystal display device according to the present embodiment is made up of half-bit scanning circuits 111-P and 111-1 through 111-41, which sequentially shift a start pulse STa by one-half pulse each in synchronization with a clock signal CLK; AND gate circuits 151-1 through 151-40 (seventh logic gate circuits), each of which receives a pair of signals Q1 and P1, P1 and P2, . . . , P39 and P40 outputted by the half-bit scanning circuits 111-P and 111-1 through 11-41; NAND gate circuits 115-1 through 115-80, which receive signals SPP1, SPP2, . . . , SPP512 outputted by the AND gate circuits 151-1 through 151-40, and second control signals S1 and S2; and output buffers 114, which receive signals outputted by the NAND gate circuits 115-1 through 115-80, and which output signals SP1, SP2, . . . , SP80.

In other words, the horizontal drive circuit 150 according to the present embodiment is similar to the horizontal drive circuit 120 discussed in the fifteenth embodiment above, except that the number of AND gate circuits 121-1 through 121-20 and output signals SPP1 through SPP20 in the horizontal drive circuit 120 shown in FIG. 23 are each doubled to 40 in the horizontal drive circuit 150 in the present embodiment.

A characteristic feature of the horizontal drive circuit 150 is that, by providing the AND gate circuits 151-1 through 151-40, the number of control signals for the NAND gate circuits 115-1 through 115-80 can be reduced to half as many as conventionally. Further, each AND gate circuit 151-1 through 151-40 receives signals outputted by two adjacent half-bit scanning circuits 111-P and 111-1 through 111-41. Since the AND gate circuits 151-1 through 151-40 must provide 40 output signals, an extra half-bit scanning circuit 111-P is provided before the half-bit scanning circuit 111-1. Incidentally, the extra half-bit scanning circuit 111-P may instead be provided after the half-bit scanning circuit 111-41.

A driving method for the liquid crystal display device structured as above is explained in the timing chart for scanning shown in FIG. 30.

First, if T is a period for sampling 16 signal lines, a start pulse STa having a pulse width of 4T and a clock signal CLK and an inverse clock signal /CLK each having a cycle of 4T are inputted to the half-bit scanning circuits 111-P and 111-1 through 111-41.

As a result, the half-bit scanning circuits 111-P and 111-1 through 111-41 produce signals Q1 and P1 through P40. Then, the signals Q1 and P1, P1 and P2, . . . , P39 and P40 outputted by each pair of adjacent half-bit scanning circuits 111-P and 111-1 through 111-41 are sent to one of the AND gate circuits 151-1 through 151-40, and the AND gate circuits 151-1 through 151-40 output signals SPP1, SPP2, . . . , SPP40 having a pulse width of half of that of the pulses outputted by the half-bit scanning circuits 111-P and 111-1 through 111-41.

Next, the signals SPP1 through SPP40 are sent to the NAND gate circuits 115-1 through 115-80, and, as control signals for the NAND gate circuits 115-1 through 115-80, two control signals S1 and S2, shown in the Figure, are used.

The control signals S1 and S2 have a cycle of 2T, and the inverse of the control signal S1 is used as the control signal S2. Consequently, the number of signal input terminals can be reduced by providing one input terminal for input of the control signal S1, which is sent through an inverter provided on the substrate to produce the control signal S2.

In this way, pulses having a pulse width of T and phases sequentially shifted by T each are produced in the respective signals outputted by the NAND gate circuits 115-1 through 115-80 and the respective signals SP1 through SP80 outputted by the output buffer circuits 114. Each signal SP1 through SP80 is sent to a plurality of sample holding switches.

As a result, reduction of the number of signal lines can contribute to reduction of the size and cost of the liquid crystal display device.

As discussed above, with the liquid crystal display device and driving method according to the present embodiment, the structure of the horizontal drive circuit 120 of the fifteenth embodiment above (see FIG. 23), in which each of the AND gate circuits 121-1 through 121-20 receives pulses outputted by a pair of adjacent half-bit scanning circuits 111-P and 111-1 through 111-21, is combined with a structure in which there are twice as many half-bit scanning circuits, i.e., the half-bit scanning circuits 111-P and 111-1 through 111-41.

As a result, such a combined structure is also able to provide a liquid crystal display device and a driving method therefor which use a small number of driving signals, and which are capable of improving production efficiency.

In each of the fourteenth through eighteenth embodiments above, the logic gate circuits used were AND gate circuits and NAND gate circuits, but there is no limitation to this, and other logic gate circuits may be used instead. For example, instead of the AND gate circuits, NOR gate circuits may be used. In this case, the signals sent to the NOR gate circuits are signals which are the inverse of the respective signals sent to the AND gate circuits in the respective embodiments above. The present invention is also applicable to cases in which other logic gate circuits are used.

Further, in each of the fourteenth through eighteenth embodiments above, there is no overlap between adjacent output pulses. Accordingly, when a given sampling pulse is in the ON state, other sampling pulses do not produce noise, and thus accurate video signal sampling can be performed, and the display quality of the liquid crystal display device improved. In order to produce non-overlapping sampling pulses of this type, it is necessary to operate the scanning circuits at a high frequency, but this can be accomplished by using as the driving elements TFTs which use polycrystalline silicon. In particular, TFTs having mobility of no less than 100($cm^2$/v·sec) are capable of operating high-frequency scanning circuits satisfactorily.

By means of the fourteenth through eighteenth embodiments above, reduction of the number of signal lines can contribute to reduction of the size and cost of the liquid crystal display device.

As discussed above, a first liquid crystal display device according to the present invention includes an active matrix array made up of switching elements provided at each intersection between a plurality of scanning lines and a plurality of signal lines, a vertical drive circuit for driving the scanning lines, and a horizontal drive circuit for driving the signal lines, in which the vertical drive circuit includes: scanning circuits N in number, N being a positive integer, which receive a start pulse, and which output pulse signals sequentially shifted by one-half of a clock signal cycle for each scanning circuit; first logic gate circuits N×M in number, M being an integer no less than 2, each provided with a first control terminal and a second control terminal, every M adjacent first logic gate circuits being connected together via the first control terminals thereof, which receive a signal from one of the N scanning circuits, and every Mth first logic gate circuit being connected together via the second control terminals thereof, which receive one of M kinds of second control signal; and second logic gate circuits, each of which receives an output from one of the first logic gate circuits and, via a third control terminal, one of two kinds of third control signal.

With the first liquid crystal display device according to the present invention, structured as above, the control signals inputted into the vertical drive circuit are the start pulse and the clock signal inputted into the first of the N scanning circuits (N being a positive integer), the M kinds of second control signal inputted into the N×M first logic gate circuits, and the two kinds of third control signal sent to the second logic gate circuits.

In the conventional structure, since a different kind of signal was sent to every 2Mth first logic gate circuit, at least 2M control lines were necessary for input to the first logic gate circuits. This increased the number of control lines for input to the vertical drive circuit, which increased the surface area used for input pads, and since the control lines themselves had to be conducted to the vertical drive circuit, the surface area devoted thereto in the circuit layout was also increased.

In contrast, with the first liquid crystal display device according to the present invention, structured as above, the second control terminals of every Mth first logic gate circuit are connected together. For this reason, the number of second control signals required are M kinds, or half as many as conventionally.

Further, lines are dispersed between the first and second logic gate circuits, thus preventing concentration of control lines.

In other words, by reducing the number of control terminals, the surface area devoted to the drive circuit and to input pads can be reduced, and accordingly, when running a plurality of liquid crystal display devices from a common substrate, more elements can fit on one substrate, thus increasing the number of panels.

Further, since the surface area devoted to the drive circuit and input pads is reduced, the size of the peripheral area surrounding the display section of the liquid crystal display device is reduced, and installation in a personal computer, etc. is facilitated.

In addition, by increasing the number of outputs from each scanning circuit to the logic gate circuits so that the output of each scanning circuit is inputted into a plurality of logic gate circuits, the number of scanning circuits can be reduced. Particularly in high-definition liquid crystal display devices, layout of each scanning circuit within the small pixel pitch is difficult, but with the foregoing structure according to the present invention, layout can be simplified.

As a result, it is possible to provide a liquid crystal display device which is operated by a small number of driving signals, and which is capable of improving production efficiency.

A second liquid crystal display device according to the present invention includes an active matrix array made up of switching elements provided at each intersection between a plurality of scanning lines and a plurality of signal lines, a vertical drive circuit for driving the scanning lines, and a horizontal drive circuit for driving the signal lines, in which the vertical drive circuit includes: scanning circuits N in number, N being a positive integer, which receive a start pulse, and which output pulse signals sequentially shifted by one-half of a clock signal cycle for each scanning circuit; pulse width reducing means, which reduce the pulse width of the pulses outputted by the scanning circuits and output these pulses of reduced width; and third logic gate circuits N×M in number, M being an integer no less than 2, each provided with a first control terminal and a second control terminal, every M adjacent first logic gate circuits being connected together via the first control terminals thereof, which receive an output of the pulse width reducing means, and every Mth first logic gate circuit being connected together via the second control terminals thereof, which receive one of M kinds of second control signal.

With the second liquid crystal display device according to the present invention, structured as above, the control signals inputted into the vertical drive circuit are the start pulse and the clock signal inputted into the first of the N scanning circuits (N being a positive integer), and the M kinds of second control signal inputted into the N×M third logic gate circuits.

In the conventional structure, since a different kind of signal was sent to every 2Mth third logic gate circuit, at least 2M control lines were necessary for input to the third logic gate circuits. This increased the number of control lines for input to the vertical drive circuit, which increased the surface area used for input pads, and since the control lines themselves had to be conducted to the vertical drive circuit, the surface area devoted thereto in the circuit layout was also increased.

In contrast, with the second liquid crystal display device according to the present invention, structured as above, the second control terminals of every Mth third logic gate circuit are connected together. For this reason, the number of second control signals required are M kinds, or half as many as conventionally.

Further, lines are dispersed between the pulse width reducing means and the third logic gate circuits, thus preventing concentration of control lines.

As a result, it is possible to provide a liquid crystal display device which is operated by a small number of driving signals, and which is capable of improving production efficiency.

A third liquid crystal display device according to the present invention is structured as the second liquid crystal display device above, in which the pulse width reducing means are fourth logic gate circuits, each of which receives pulses outputted by two adjacent scanning circuits.

With the foregoing structure, by using as the pulse width reducing means the fourth logic gate circuits, each of which receives the output of two adjacent scanning circuits, lines can be dispersed between the fourth logic gate circuits and the third logic gate circuits.

As a result, concentration of control lines can be prevented, and it is possible to provide with certainty a liquid crystal display device which is operated by a small number of driving signals, and which is capable of improving production efficiency.

A fourth liquid crystal display device according to the present invention is structured as the third liquid crystal display device above, in which the pulse reducing means include an additional scanning circuit before the first or after the last scanning circuit.

With the foregoing structure, since an additional scanning circuit is provided before the first or after the last scanning circuit, each of the pulse width reducing means can retrieve pulses from two adjacent scanning circuits.

A fifth liquid crystal display device according to the present invention is structured as the second liquid crystal display device above, in which the pulse width reducing means are fifth logic gate circuits, each of which receives pulses outputted by the N scanning circuits and one of two kinds of fourth control signal, each the inverse of the other.

With the foregoing structure, by using as the pulse width reducing means the fifth logic gate circuits, each of which receives the output of the N scanning circuits and one of two kinds of fourth control signal, each the inverse of the other, the clock signal and an inverted clock signal can be used as the two kinds of fourth control signal. Thus, it is possible to provide with certainty a liquid crystal display device which is operated by a small number of driving signals, and which is capable of improving production efficiency.

A sixth liquid crystal display device according to the present invention is structured as the first or fifth liquid crystal display device above, in which the clock signal and an inverted clock signal are used as the third control signals or the fourth control signals.

In other words, the third control signals (in the first liquid crystal display device) or the fourth control signals (in the fifth liquid crystal display device) should be two kinds of signal, each of which has a cycle of (2×M×T) and a pulse width of (M×T), and each of which is the inverse of the other. Here, these two kinds of signal are the same as the existing clock signal and an inverted clock signal. Accordingly, in the present invention, by using the clock signal and the inverted clock signal as the third control signals or the fourth control signals, there is no need to provide further control lines to supply the third control signals or the fourth control signals to the vertical drive circuit.

Conventionally, there was a large number of control lines for input to the vertical drive circuit, which increased the surface area used for input pads, and since the control lines themselves had to be conducted to the vertical drive circuit, the surface area devoted thereto in the circuit layout was also increased. However, in the present invention, this can be prevented by using existing control lines. Accordingly, it is possible to provide a liquid crystal display device which is operated by a small number of driving signals, and which is capable of improving production efficiency.

A seventh liquid crystal display device according to the present invention is structured as any one of the first through sixth liquid crystal display devices above, in which M=4.

In other words, in high-definition liquid crystal display devices, layout of each scanning circuit within the small pixel pitch is difficult, but, by increasing the number of outputs from each scanning circuit to the logic gate circuits so that the output of each scanning circuit is inputted into a plurality of logic gate circuits, the number of scanning circuits can be reduced.

With the foregoing structure of the seventh liquid crystal display device according to the present invention, in particular, since M=4, the output from each scanning circuit is inputted into four logic gate circuits, each scanning circuit can be laid out within the pitch of four pixels, thus simplifying layout.

As a result, it is possible to provide a liquid crystal display device which is operated by a small number of driving signals, and which is capable of improving production efficiency.

An eighth liquid crystal display device according to the present invention includes an active matrix array made up of switching elements provided at each intersection between a plurality of scanning lines and a plurality of signal lines, a vertical drive circuit for driving the scanning lines, and a horizontal drive circuit for driving the signal lines, in which the vertical drive circuit includes: scanning circuits 2N in number, N being a positive integer, which receive a start pulse, and which produce pulse signals sequentially shifted by one-half of a clock signal cycle for each scanning circuit; and sixth logic gate circuits N×M in number, M being an integer no less than 2, each provided with a first control terminal and a second control terminal, every M adjacent sixth logic gate circuits being connected together via the first control terminals thereof, which receive signals from every other scanning circuit of the 2N scanning circuits, and every Mth sixth logic gate circuit being connected together via the second control terminals thereof, which receive one of M kinds of second control signal.

With the eighth liquid crystal display device according to the present invention, structured as above, the control signals inputted into the vertical drive circuit are the start pulse and the clock signal inputted into the first of the 2N scanning circuits (N being a positive integer), and the M kinds of second control signal inputted into the N×M sixth logic gate circuits.

In the conventional structure, since a different kind of signal was sent to every 2Mth sixth logic gate circuit, at least 2M control lines were necessary for input to the sixth logic gate circuits. This increased the number of control lines for input to the vertical drive circuit, which increased the surface area used for input pads, and since the control lines themselves had to be conducted to the vertical drive circuit, the surface area devoted thereto in the circuit layout was also increased.

In contrast, with the eighth liquid crystal display device according to the present invention, structured as above, the second control terminals of every Mth sixth logic gate circuit are connected together. For this reason, the number of second control signals required are M kinds, or half as many as conventionally.

As a result, it is possible to provide a liquid crystal display device which is operated by a small number of driving signals, and which is capable of improving production efficiency.

As discussed above, a first driving method for a liquid crystal display device according to the present invention is a method of driving the first liquid crystal display device above, and includes the steps of: (a) inputting to the scanning circuits of the vertical drive circuit a start pulse having a pulse width of (2×M×T), T being a scanning line selection period, and, using a clock signal having a cycle of (2×M×T), causing the respective scanning circuits to produce pulse signals sequentially shifted by one-half cycle of the clock signal each; (b) inputting to the first control terminals of the respective first logic gate circuits the pulse signals sequentially shifted by one-half cycle each, and inputting to the second control terminals of the respective first logic gate circuits M kinds of second control signal having a cycle of (M×T) and a pulse width of T, thereby causing each first logic gate circuit to produce two pulses of pulse width T, produced ((M−1)×T) apart from each other; (c) inputting to each second logic gate circuit the two pulses produced by one of the first logic gate circuits and one of two kinds of third control signal having a cycle of (2×M×T) and a pulse width of (M×T), each third control signal being the inverse of the other, thereby causing the respective second logic gate circuits to output signals having a pulse width of T; and (d) sequentially inputting the respective signals of pulse width T to the scanning lines.

With the foregoing first driving method, when the N scanning circuits of the vertical drive circuit receive the start pulse, the respective scanning circuits output pulse signals having phases sequentially shifted by one-half of the cycle of the clock signal, which is (2×M×T).

These pulse signals are sent to the first control terminals of the first logic gate circuits, which are (N×M) in number.

Here, of the (N×M) first logic gate circuits, the first control terminals of every M adjacent first logic gate circuits are connected together. Thus the pulse signal outputted by each scanning circuit is sent to M first logic gate circuits.

Further, the second control terminals of every M adjacent first logic gate circuits receive different respective second control signals as additional inputs. Each of the M kinds of second control signal is made up of pulses having a cycle of (M×T) and a pulse width of T.

Consequently, each of the first logic gate circuits produces two pulses having a pulse width of T, produced ((M−1)×T) apart from each other.

Next, each of the second logic gate circuits receives the foregoing two pulses and one of two third control signals having a cycle of (2×M×T) and a pulse width of (M×T), each of which is the inverse of the other, and then each second logic gate circuit outputs signals having a pulse width of T.

Accordingly, by sending these signals of pulse width T to the scanning lines in sequence, in combination with signals sent to the signal lines by the horizontal drive circuit, each switching element of the active matrix array can be ON/OFF controlled, thus performing display on the screen of the liquid crystal display device.

In the conventional structure, since different signals were sent to every 2M first logic gate circuits, at least 2M control lines were necessary for the first logic gate circuits. This increased the number of control lines for input to the vertical drive circuit, which increased the surface area used for input pads, and since the control lines themselves had to be conducted to the vertical drive circuit, the surface area devoted thereto in the circuit layout was also increased.

However, in the first driving method according to the present invention, the second control terminals of every Mth first logic gate circuit are connected together. For this reason, there are M kinds of second control terminal, or half as many as conventionally.

Further, lines are dispersed between the first logic gate circuits and the second logic gate circuits, thus preventing concentration of control lines.

As a result, it is possible to provide a driving method for a liquid crystal display device which operates the liquid crystal display device using a small number of driving signals, and which is capable of improving production efficiency.

A second driving method for a liquid crystal display device according to the present invention is a method of driving the second liquid crystal display device above, and includes the steps of: (a) inputting to the scanning circuits of the vertical drive circuit a start pulse having a pulse width of (2×M×T), T being a scanning line selection period, and, using a clock signal having a cycle of (2×M×T), causing the respective scanning circuits to produce pulse signals sequentially shifted by one-half cycle of the clock signal each; (b) inputting the respective pulse signals sequentially shifted by one-half cycle each to the pulse width reducing means, thereby producing pulses having respective pulse widths of (M×T); (c) inputting the respective pulses produced by the pulse width reducing means to the first control terminals of the respective third logic gate circuits, and inputting to the second control terminal of each third logic gate circuit one of M kinds of second control signal having a cycle of (M×T) and a pulse width of T, thereby causing the respective third logic gate circuits to produce signals having a pulse width of T; and (d) sequentially inputting the respective signals of pulse width T to the scanning lines.

With the foregoing second driving method, when the N scanning circuits of the vertical drive circuit receive the start pulse, the respective scanning circuits output pulse signals having phases sequentially shifted by one-half of the cycle of the clock signal, which is (2×M×T).

These pulse signals are sent to the pulse width reducing means, which reduces the pulse width of these pulse signals to output pulses having a pulse width of (M×T).

The respective outputs of the pulse width reducing means are then inputted to the first control terminals of the third logic gate circuits, which are (N×M) in number.

Here, of the (N×M) third logic gate circuits, the first control terminals of every M adjacent third logic gate circuits are connected together. Thus each pulse signal outputted by the pulse width reducing means is sent to M third logic gate circuits.

Further, the second control terminals of every M adjacent third logic gate circuits receive different respective second control signals as additional inputs. Each of the M kinds of second control signal is made up of pulses having a cycle of (M×T) and a pulse width of T.

Consequently, each of the third logic gate circuits outputs signals having a pulse width of T.

Accordingly, by sending these signals of pulse width T to the scanning lines in sequence, in combination with signals sent to the signal lines by the horizontal drive circuit, each switching element of the active matrix array can be ON/OFF controlled, thus performing display on the screen of the liquid crystal display device.

In the conventional structure, since different signals were sent to every 2M third logic gate circuits, at least 2M control lines were necessary for the third logic gate circuits. This increased the number of control lines for input to the vertical drive circuit, which increased the surface area used for input pads, and since the control lines themselves had to be conducted to the vertical drive circuit, the surface area devoted thereto in the circuit layout was also increased.

However, in the second driving method according to the present invention, by providing pulse width reducing means which reduce the pulse width of the pulses outputted by each scanning circuit, the second control terminals of every Mth third logic gate circuit can be connected together. For this reason, there are M kinds of second control terminal, or half as many as conventionally.

Further, lines are dispersed between the pulse width reducing means and the third logic gate circuits, thus preventing concentration of control lines.

As a result, it is possible to provide a driving method for a liquid crystal display device which operates the liquid crystal display device using a small number of driving signals, and which is capable of improving production efficiency.

A third driving method for a liquid crystal display device according to the present invention is a method of driving the eighth liquid crystal display device above, and includes the steps of: (a) inputting to the scanning circuits of the vertical drive circuit a start pulse having a pulse width of (M×T), T being a scanning line selection period, and, using a clock signal having a cycle of (M×T), causing the respective scanning circuits to produce pulse signals sequentially shifted by one-half cycle of the clock signal each; (b) inputting to the first control terminals of the respective sixth logic gate circuits signals, sequentially shifted by one cycle each, produced by every other scanning circuit of the 2N scanning circuits, and inputting to the second control terminal of each sixth logic gate circuit one of M kinds of second control signal having a cycle of (M×T) and a pulse width of T, thereby causing the respective sixth logic gate circuits to produce signals having a pulse width of T; and (d) sequentially inputting the respective signals of pulse width T to the scanning lines.

With the foregoing third driving method, when the 2N scanning circuits of the vertical drive circuit receive the start pulse of pulse width (M×T), the respective scanning circuits produce pulse signals having phases sequentially shifted by one-half of the cycle of the clock signal, which is (M×T). Accordingly, the respective signals outputted by every other scanning circuit of the 2N scanning circuits are sequentially shifted by one cycle each.

These pulse signals are sent to the first control terminals of the sixth logic gate circuits, which are (N×M) in number.

Here, of the (N×M) sixth logic gate circuits, the first control terminals of every M adjacent sixth logic gate circuits are connected together. Thus each of the pulse signals outputted by every other scanning circuit is sent to M sixth logic gate circuits.

Further, the second control terminals of every M adjacent sixth logic gate circuits receive different respective second control signals as additional inputs. Each of the M kinds of second control signal is made up of pulses having a cycle of (M×T) and a pulse width of T.

Consequently, each sixth logic gate circuit outputs signals having a pulse width of T.

Accordingly, by sending these signals of pulse width T to the scanning lines in sequence, in combination with signals sent to the signal lines by the horizontal drive circuit, each switching element of the active matrix array can be ON/OFF controlled, thus performing display on the screen of the liquid crystal display device.

In the conventional structure, since different signals were sent to every 2M sixth logic gate circuits, at least 2M control lines were necessary for the sixth logic gate circuits. This increased the number of control lines for input to the vertical drive circuit, which increased the surface area used for input pads, and since the control lines themselves had to be conducted to the vertical drive circuit, the surface area devoted thereto in the circuit layout was also increased.

However, in the third driving method according to the present invention, there are 2N scanning circuits (N being a positive integer), which sequentially shift the inputted start pulse by one-half of the cycle of the clock signal each, and output is retrieved from every other scanning circuit. Consequently, the respective output signals are sequentially shifted by one cycle each. As a result, the second control terminals of every Mth sixth logic gate circuit can be connected. Accordingly, there are M kinds of second control terminal, or half as many as conventionally.

Accordingly, it is possible to provide a driving method for a liquid crystal display device which operates the liquid crystal display device using a small number of driving signals, and which is capable of improving production efficiency.

A fourth driving method for a liquid crystal display device according to the present invention is a method of driving the first liquid crystal display device above, and includes the steps of: (a) inputting to the scanning circuits of the vertical drive circuit a start pulse having a pulse width of (M×T), T being a scanning line selection period, and, using a clock signal having a cycle of (M×T), causing the respective scanning circuits to produce pulse signals sequentially shifted by one-half cycle of the clock signal each; (b) inputting to the respective first logic gate circuits the pulse signals sequentially shifted by one-half cycle each, and inputting to control terminals of (M/2) out of every M adjacent first logic gate circuits a control signal having a cycle of ((M/2)×T), thereby causing every other first logic gate circuit to produce two pulses of pulse width T, produced (((M/2)−1)×T) apart from each other; (c) inputting to every other second logic gate circuit the two pulses produced by every other first logic gate circuit, and inputting to each second logic gate circuit a third control signal having a cycle of (M×T), thereby causing every other second logic gate circuit to output a signal having a pulse width of T; and (d) sequentially inputting the respective signals of pulse width T to every other scanning line.

With the foregoing fourth driving method, there are M kinds of second control terminal, or half as many as conventionally. Accordingly, it is possible to provide a driving method for a liquid crystal display device which operates the liquid crystal display device using a small number of driving signals, and which is capable of improving production efficiency.

Further, the respective signals of pulse width T are sequentially inputted to every other scanning line. Consequently, interlace scanning, in which input is sequentially performed to every other scanning line, can be performed using the first liquid crystal display device according to the present invention.

A fifth driving method for a liquid crystal display device according to the present invention is a method of driving the first liquid crystal display device above, and includes the steps of: (a) inputting to the scanning circuits of the vertical drive circuit a start pulse having a pulse width of (M×T), T being a scanning line selection period, and, using a clock signal having a cycle of (M×T), causing the respective scanning circuits to produce pulse signals sequentially shifted by one-half cycle of the clock signal each; (b) inputting to the respective first logic gate circuits the pulse signals sequentially shifted by one-half cycle each, and inputting to control terminals of every M adjacent first logic gate circuits M/2 kinds of control signal having a cycle of ((M/2)×T) thereby causing each first logic gate circuit to produce two pulses of pulse width T, produced (((M/2)−1)×T) apart from each other, each pair of adjacent first logic gate circuits producing pulses having the same phase; (c) inputting to the respective second logic gate circuits the two pulses produced by the respective first logic gate circuits, and a third control signal having a cycle of (M×T), thereby causing each second logic gate circuit to produce a signal having a pulse width of T, each pair of adjacent second logic gate circuits producing pulses having the same phase; and (d) sequentially inputting the respective signals of pulse width T to two scanning lines each.

With the foregoing fifth driving method, there are M kinds of second control terminal, or half as many as conventionally. Accordingly, it is possible to provide a driving method for a liquid crystal display device which operates the liquid crystal display device using a small number of driving signals, and which is capable of improving production efficiency.

Further, the respective signals of pulse width T are sequentially inputted to two scanning lines each. Consequently, two-line simultaneous scanning, in which input is sequentially performed to two scanning lines each, can be performed using the first liquid crystal display device according to the present invention.

A sixth driving method for a liquid crystal display device according to the present invention is a method of driving the second liquid crystal display device above, and includes the steps of: (a) inputting to the scanning circuits of the vertical drive circuit a start pulse having a pulse width of (M×T), T being a scanning line selection period, and, using a clock signal having a cycle of (M×T), causing the respective scanning circuits to produce pulse signals sequentially shifted by one-half cycle of the clock signal each; (b) inputting to the pulse reducing means the pulse signals sequentially shifted by one-half cycle each, thereby causing the pulse width reducing means to produce pulses having a pulse width of (M×T/2); (c) inputting the respective pulses produced by the pulse width reducing means to the first control terminals of the respective third logic gate circuits, and inputting to the second control terminals of (M/2) out of every M adjacent third logic gate circuits a second control signal having a cycle of (M×T/2), thereby causing every other third logic gate circuit to produce signals having a pulse width of T; and (d) inputting the respective signals of pulse width T to every other scanning line.

With the foregoing sixth driving method, there are M kinds of second control terminal, or half as many as conventionally. Accordingly, it is possible to provide a driving method for a liquid crystal display device which operates the liquid crystal display device using a small number of driving signals, and which is capable of improving production efficiency.

Further, the respective signals of pulse width T are sequentially inputted to every other scanning line. Consequently, interlace scanning, in which input is sequentially performed to every other scanning line, can be performed using the second liquid crystal display device according to the present invention.

A seventh driving method for a liquid crystal display device according to the present invention is a method of driving the second liquid crystal display device above, and includes the steps of: (a) inputting to the scanning circuits of the vertical drive circuit a start pulse having a pulse width of (M×T), T being a scanning line selection period, and, using a clock signal having a cycle of (M×T), causing the respective scanning circuits to produce pulse signals sequentially shifted by one-half cycle of the clock signal each; (b) inputting to the pulse reducing means the pulse signals sequentially shifted by one-half cycle each, thereby causing the pulse width reducing means to produce pulses having a pulse width of (M×T/2); (c) inputting the pulses produced by the respective pulse width reducing means to the respective third logic gate circuits, and inputting to control terminals of every M adjacent third logic gate circuits M/2 kinds of control signal having a cycle of (M×T/2), thereby causing the respective third logic gate circuits to produce signals having a pulse width of T, each pair of adjacent third logic gate circuits producing signals having the same phase; and (d) sequentially inputting the respective signals of pulse width T to two scanning lines each.

With the foregoing seventh driving method, there are M kinds of second control terminal, or half as many as conventionally. Accordingly, it is possible to provide a driving method for a liquid crystal display device which operates the liquid crystal display device using a small number of driving signals, and which is capable of improving production efficiency.

Further, the respective signals of pulse width T are sequentially inputted to two scanning lines each. Consequently, two-line simultaneous scanning, in which input is performed sequentially to two scanning lines each, can be performed using the second liquid crystal display device according to the present invention.

An eighth driving method for a liquid crystal display device according to the present invention is a method of driving the eighth liquid crystal display device above, and includes the steps of: (a) inputting to the scanning circuits of the vertical drive circuit a start pulse having a pulse width of (M×T), T being a scanning line selection period, and, using a clock signal having a cycle of (M×T), causing the respective scanning circuits to produce pulse signals sequentially shifted by one-half cycle of the clock signal each; (b) inputting to the respective sixth logic gate circuits signals, sequentially shifted by one cycle each, produced by every other scanning circuit of the 2N scanning circuits, and inputting to control terminals of (M/2) out of every M adjacent sixth logic gate circuits a control signal having a cycle of (M×T/2), thereby causing every other sixth logic gate circuit to produce signals having a pulse width of T; and (d) sequentially inputting the respective signals of pulse width T to every other scanning line.

With the foregoing eighth driving method, there are M kinds of second control terminal, or half as many as conventionally. Accordingly, it is possible to provide a driving method for a liquid crystal display device which operates the liquid crystal display device using a small number of driving signals, and which is capable of improving production efficiency.

Further, the respective signals of pulse width T are sequentially inputted to every other scanning line. Consequently, interlace scanning, in which input is performed sequentially to every other scanning line, can be performed using the eighth liquid crystal display device according to the present invention.

A ninth driving method for a liquid crystal display device according to the present invention is a method of driving the eighth liquid crystal display device above, and includes the steps of: (a) inputting to the scanning circuits of the vertical drive circuit a start pulse having a pulse width of (M×T), T being a scanning line selection period, and, using a clock signal having a cycle of (M×T), causing the respective scanning circuits to produce pulse signals sequentially shifted by one-half cycle of the clock signal each; (b) inputting to the respective sixth logic gate circuits signals, sequentially shifted by one cycle each, produced by every other scanning circuit of the 2N scanning circuits, and inputting to control terminals of every M adjacent sixth logic gate circuits M/2 kinds of control signal having a cycle of (M×T/2), thereby causing the respective sixth logic gate circuits to produce signals having a pulse width of T, each pair of adjacent third logic gate circuits producing signals having the same phase; and (d) sequentially inputting the respective signals of pulse width T to two scanning lines each.

With the foregoing ninth driving method, there are M kinds of second control terminal, or half as many as conventionally. Accordingly, it is possible to provide a driving method for a liquid crystal display device which operates the liquid crystal display device using a small number of driving signals, and which is capable of improving production efficiency.

Further, the respective signals of pulse width T are sequentially inputted to two scanning lines each. Consequently, two-line simultaneous scanning, in which input is sequentially performed to two scanning lines each, can be performed using the eighth liquid crystal display device according to the present invention.

In a ninth liquid crystal display device according to the present invention, a horizontal drive circuit includes: scanning circuits N in number, N being a positive integer, which receive a start pulse, and which output pulse signals sequentially shifted by one-half of a clock signal cycle for each scanning circuit; first logic gate circuits N×M in number, M being an integer no less than 2, each provided with a first control terminal and a second control terminal, every M adjacent first logic gate circuits being connected together via the first control terminals thereof, which receive a signal from one of the N scanning circuits, and every Mth first logic gate circuit being connected together via the second control terminals thereof, which receive one of M kinds of second control signal; second logic gate circuits, each of which receives an output from one of the first logic gate circuits and, via a third control terminal, one of two kinds of third control signal; and sample holding switches.

With the ninth liquid crystal display device according to the present invention, structured as above, the second control terminals of every Mth first logic gate circuit are connected together. For this reason, the number of second control signals required are M kinds, or half as many as conventionally.

Further, lines are dispersed between the first and second logic gate circuits, thus preventing concentration of control lines.

As a result, it is possible to provide a liquid crystal display device which is operated by a small number of driving signals, and which is capable of improving production efficiency.

In a tenth liquid crystal display device according to the present invention, a horizontal drive circuit includes: scanning circuits N in number (N being a positive integer), which receive a start pulse, and which output pulse signals sequentially shifted by one-half of a clock signal cycle for each scanning circuit; pulse width reducing means, which reduce the pulse width of the pulses outputted by the scanning circuits and output these pulses of reduced width; third logic gate circuits N×M in number, M being an integer no less than 2, each provided with a first control terminal and a second control terminal, every M adjacent first logic gate circuits being connected together via the first control terminals thereof, which receive an output of the pulse width reducing means, and every Mth first logic gate circuit being connected together via the second control terminals thereof, which receive one of M kinds of second control signal; and sample holding switches.

With the tenth liquid crystal display device according to the present invention, structured as above, the second control terminals of every Mth third logic gate circuit are connected together. For this reason, the number of second control signals required are M kinds, or half as many as conventionally.

Further, lines are dispersed between the pulse width reducing means and the third logic gate circuits, thus preventing concentration of control lines.

As a result, it is possible to provide a liquid crystal display device which is operated by a small number of driving signals, and which is capable of improving production efficiency.

An eleventh liquid crystal display device according to the present invention is structured as the tenth liquid crystal display device above, in which the pulse width reducing means are fourth logic gate circuits, each of which receives pulses outputted by two adjacent scanning circuits.

With the eleventh liquid crystal display device according to the present invention, structured as above, by using as the pulse width reducing means the fourth logic gate circuits, each of which receives the output of two adjacent scanning circuits, lines can be dispersed between the fourth logic gate circuits and the third logic gate circuits.

As a result, concentration of control lines can be prevented, and it is possible to provide with certainty a liquid crystal display device which is operated by a small number of driving signals, and which is capable of improving production efficiency.

A twelfth liquid crystal display device according to the present invention is structured as the eleventh liquid crystal display device above, in which the pulse reducing means include an additional scanning circuit before the first or after the last scanning circuit.

With the twelfth liquid crystal display device according to the present invention, structured as above, each of the pulse width reducing means can retrieve pulses from two adjacent scanning circuits.

A thirteenth liquid crystal display device according to the present invention is structured as the eleventh liquid crystal display device above, in which the pulse width reducing means are fifth logic gate circuits, each of which receives pulses outputted by the N scanning circuits and one of two kinds of fourth control signal, each the inverse of the other.

With the thirteenth liquid crystal display device according to the present invention, structured as above, by using as the pulse width reducing means the fifth logic gate circuits, each of which receives the output of the N scanning circuits and one of two kinds of fourth control signal having a cycle of (2×M×T) and a pulse width of (M×T), each the inverse of the other, the clock signal and an inverted clock signal can be used as the two kinds of fourth control signal. Thus, it is possible to provide with certainty a liquid crystal display device which is operated by a small number of driving signals, and which is capable of improving production efficiency.

A fourteenth liquid crystal display device according to the present invention is structured as either the ninth or the thirteenth liquid crystal display device above, in which the clock signal and an inverted clock signal are used as the third control signals or the fourth control signals.

With the fourteenth liquid crystal display device according to the present invention, structured as above, there is no need to provide further control lines to supply the third control signals (in the first liquid crystal display device) or the fourth control signals (in the fifth liquid crystal display device) to the horizontal drive circuit.

Conventionally, there was a large number of control lines for input to the horizontal drive circuit, which increased the surface area used for input pads, and since the control lines themselves had to be conducted to the horizontal drive circuit, the surface area devoted thereto in the circuit layout was also increased. However, in the present invention, this can be prevented by using existing control lines.

Accordingly, it is possible to provide a liquid crystal display device which is operated by a small number of driving signals, and which is capable of improving production efficiency.

In a fifteenth liquid crystal display device according to the present invention, the horizontal drive circuit includes: scanning circuits 2N in number, N being a positive integer, which receive a start pulse, and which produce pulse signals sequentially shifted by one-half of a clock signal cycle for each scanning circuit; sixth logic gate circuits N×M in number, M being an integer no less than 2, each provided with a first control terminal and a second control terminal, every M adjacent sixth logic gate circuits being connected together via the first control terminals thereof, which receive signals produced by every other scanning circuit of the 2N scanning circuits, and every Mth sixth logic gate circuit being connected together via the second control terminals thereof, which receive one of M kinds of second control signal; and sample holding switches.

With the fifteenth liquid crystal display device according to the present invention, structured as above, the second control terminals of every Mth sixth logic gate circuit are connected together. For this reason, the number of second control signals required are M kinds, or half as many as conventionally.

As a result, it is possible to provide a liquid crystal display device which is operated by a small number of driving signals, and which is capable of improving production efficiency.

A tenth driving method for a liquid crystal display device according to the present invention is a method of driving the ninth liquid crystal display device above, and includes the steps of: (a) inputting to the scanning circuits of the horizontal drive circuit a start pulse having a pulse width of (2×M×T), T being a sampling period, and, using a clock signal having a cycle of (2×M×T), causing the respective scanning circuits to produce pulse signals sequentially shifted by one-half cycle of the clock signal each; (b) inputting to the first control terminals of the respective first logic gate circuits the pulse signals sequentially shifted by one-half cycle each, and inputting to the second control terminals of the respective first logic gate circuits M kinds of second control signal having a cycle of (M×T) and a pulse width of T, thereby causing each first logic gate circuit to produce two pulses of pulse width T, produced ((M−1)×T) apart from each other; (c) inputting to each second logic gate circuit the two pulses produced by one of the first logic gate circuits and one of two kinds of third control signal having a cycle of (2×M×T) and a pulse width of (M×T), each third control signal being the inverse of the other, thereby causing the respective second logic gate circuits to produce signals having a pulse width of T; and (d) sequentially inputting the respective signals of pulse width T to the sample holding switches.

With the foregoing tenth driving method, the second control terminals of every Mth first logic gate circuit are connected together. For this reason, the number of second control signals required are M kinds, or half as many as conventionally.

Further, lines are dispersed between the first and second logic gate circuits, thus preventing concentration of control lines.

As a result, it is possible to provide a driving method for a liquid crystal display device which operates the liquid crystal display device using a small number of driving signals, and which is capable of improving production efficiency.

An eleventh driving method for a liquid crystal display device according to the present invention is a method of driving the tenth liquid crystal display device above, and includes the steps of: (a) inputting to the scanning circuits of the horizontal drive circuit a start pulse having a pulse width of (2×M×T), T being a sampling period, and, using a clock signal having a cycle of (2×M×T) causing the respective scanning circuits to produce pulse signals sequentially shifted by one-half cycle of the clock signal each; (b) inputting the respective pulse signals sequentially shifted by one-half cycle each to the pulse width reducing means, thereby producing pulses having respective pulse widths of (M×T); (c) inputting the respective pulses produced by the pulse width reducing means to the first control terminals of the respective third logic gate circuits, and inputting to the second control terminal of each third logic gate circuit one of M kinds of second control signal having a cycle of (M×T) and a pulse width of T, thereby causing the respective third logic gate circuits to produce signals having a pulse width of T; and (d) sequentially inputting the respective signals of pulse width T to the sample holding switches.

With the foregoing eleventh driving method, by providing pulse width reducing means which reduce the pulse width of the pulses outputted by each scanning circuit, the second control terminals of every Mth third logic gate circuit can be connected together. For this reason, there are M kinds of second control terminal, or half as many as conventionally.

Further, lines are dispersed between each of the pulse width reducing means and the third logic gate circuits, thus preventing concentration of control lines.

As a result, it is possible to provide a driving method for a liquid crystal display device which operates the liquid crystal display device using a small number of driving signals, and which is capable of improving production efficiency.

A twelfth driving method for a liquid crystal display device according to the present invention is a method of driving the fifteenth liquid crystal display device above, and includes the steps of: (a) inputting to the scanning circuits of the horizontal drive circuit a start pulse having a pulse width of (M×T), T being a sampling period, and, using a clock signal having a cycle of (M×T), causing the respective scanning circuits to produce pulse signals sequentially shifted by one-half cycle of the clock signal each; (b) inputting to the first control terminals of the respective sixth logic gate circuits signals, sequentially shifted by one cycle each, produced by every other scanning circuit of the 2N scanning circuits, and inputting to the second control terminal of each sixth logic gate circuit one of M kinds of second control signal having a cycle of (M×T) and a pulse width of T, thereby causing the respective sixth logic gate circuits to produce signals having a pulse width of T; and (d) sequentially inputting the respective signals of pulse width T to the sampling switches.

With the foregoing twelfth driving method, there are 2N scanning circuits (N being a positive integer), which sequentially shift the inputted start pulse by one-half of the cycle of the clock signal each, and output is retrieved from every other scanning circuit. Consequently, the respective output signals are sequentially shifted by one cycle each. As a result, the second control terminals of every Mth sixth logic gate circuit can be connected. Accordingly, there are M kinds of second control terminal, or half as many as conventionally.

Accordingly, it is possible to provide a driving method for a liquid crystal display device which operates the liquid crystal display device using a small number of driving signals, and which is capable of improving production efficiency.

A thirteenth driving method for a liquid crystal display device according to the present invention is a method of driving any one of the tenth through thirteenth liquid crystal display devices above, in which, among the signals of pulse width T which are sequentially inputted to the sample holding switches, pulses of adjacent signals do not mutually overlap.

With the foregoing thirteenth driving method, when a given sampling pulse is in the ON state, other sampling pulses do not produce noise, and thus accurate video signal sampling can be performed, and the display quality of the liquid crystal display device improved. In order to produce non-overlapping sampling pulses of this type, it is necessary to operate the scanning circuits at a high frequency, but this can be accomplished by using as the driving elements TFTs which use polycrystalline silicon. In particular, TFTs having mobility of no less than 100($cm^2$/v·sec) are capable of operating high-frequency scanning circuits satisfactorily.

With the foregoing thirteenth driving method, by reducing the number of control terminals, the surface area devoted to the drive circuit and to input pads can be reduced, and accordingly, when running a plurality of liquid crystal display devices from a common substrate, more elements can fit on one substrate, thus increasing the number of panels. Further, since the surface area devoted to the drive circuit and input pads is reduced, the size of the peripheral area surrounding the display section of the liquid crystal display device is reduced, and installation in a personal computer, etc. is facilitated.

In addition, by increasing the number of outputs from each scanning circuit to the logic gate circuits so that the output of each scanning circuit is inputted into a plurality of logic gate circuits, the number of scanning circuits can be reduced. Particularly in high-definition liquid crystal display devices, layout of each scanning circuit within the small pixel pitch is difficult, but with the foregoing structure according to the present invention, if the number of inputs to the logic gate circuits is, for example, four, it is easy to lay out each scanning circuit within the pitch of four pixels, and thus layout can be simplified.

The embodiments and concrete examples of implementation discussed in the foregoing detailed explanation of the present invention serve solely to illustrate the technical contents of the present invention, which should not be narrowly interpreted within the limits of such concrete examples, but rather may be applied in many variations without departing from the spirit of the present invention and the scope of the patent claims set forth below.

What is claimed is:

1. A liquid crystal display device including an active matrix array made up of switching elements provided at each intersection between a plurality of scanning lines and a plurality of signal lines, and driving means for driving said active matrix array, said driving means comprising:

scanning circuits N in number, N being a positive integer, which receive a start pulse, and which produce pulse signals sequentially shifted by one-half of a clock signal cycle for each scanning circuit;

pulse width reducing means, which reduce pulse width of the pulse signals produced by said scanning circuits and produce pulses of reduced width; and third logic gate circuits N×M in number, M being an integer no less than 2, each provided with a first control terminal and a second control terminal, every M adjacent third logic gate circuits being connected together via said first control terminals thereof, which receive a pulse produced by said pulse width reducing means, and every Mth third logic gate circuit being connected together via said second control terminals thereof, which receive one of M kinds of second control signal.

2. The liquid crystal display device set forth in claim 1, wherein: said driving means are a vertical drive circuit which drives said plurality of scanning lines.

3. The liquid crystal display device set forth in claim 1, wherein: said driving means are a horizontal drive circuit which drives said plurality of signal lines; and said horizontal drive circuit includes sample holding switches.

4. The liquid crystal display device set forth in claim 1, wherein: said pulse reducing means are fourth logic gates, each of which receives pulses produced by two adjacent scanning circuits.

5. The liquid crystal display device set forth in claim 4, wherein: said fourth logic gate circuits are AND gate circuits.

6. The liquid crystal display device set forth in claim 1, wherein: said pulse reducing means include an additional scanning circuit before the first or after the last said scanning circuit.

7. The liquid crystal display device set forth in claim 1, wherein: said third logic gate circuits include NAND gate circuits.

8. The liquid crystal display device set forth in claim 1, wherein: said pulse reducing means are fifth logic gates, each of which receives pulses produced by said N scanning circuits and one of two kinds of fourth control signal, each fourth control signal the inverse of the other.

9. The liquid crystal display device set forth in claim 8, wherein: the fourth control signals are the clock signal and an inverted clock signal.

10. The liquid crystal display device set forth in claim 1, wherein M=4.

11. The liquid crystal display device set forth in claim 1, wherein: M=2.

12. The device of claim 1, wherein said driving means are a horizontal drive circuit which drives said plurality of signal lines; and said horizontal drive circuit includes sample holding switches.

13. A liquid crystal display device including an active matrix array made up of switching elements provided at each intersection between a plurality of scanning lines and a plurality of signal lines, and driving means for driving said active matrix array, said driving means comprising:

scanning circuits 2N in number, N being a positive integer, which receive a start pulse, and which produce pulse signals sequentially shifted by one-half of a clock signal cycle for each scanning circuit; and sixth logic gate circuits N×M in number, M being an integer no less than 2, each provided with a first control terminal and a second control terminal, every M adjacent sixth logic gate circuits being connected together via said first control terminals thereof, which receive signals produced by every other scanning circuit of the 2N said scanning circuits, and every Mth sixth logic gate circuit being connected together via said second control terminals thereof, which receive one of M kinds of second control signal.

14. The liquid crystal display device set forth in claim 13, wherein: said driving means are a vertical drive circuit which drives said plurality of scanning lines.

15. The liquid crystal display device set forth in claim 13, wherein: said driving means are a horizontal drive circuit which drives said plurality of signal lines; and said horizontal drive circuit includes sample holding switches.

16. The liquid crystal display device set forth in claim 13, wherein: said sixth logic gate circuits include NAND gate circuits.

17. A driving method for a liquid crystal display device including an active matrix array made up of switching elements provided at each intersection between a plurality of scanning lines and a plurality of signal lines, a vertical drive circuit for driving the scanning lines, and a horizontal drive circuit for driving the signal lines, the vertical drive circuit comprising:

scanning circuits N in number, N being a positive integer, which receive a start pulse, and which produce pulse signals sequentially shifted by one-half of a clock signal cycle for each scanning circuit;

pulse width reducing means, which reduce pulse width of the pulse signals produced by the scanning circuits and produce pulses of reduced width; and third logic gate circuits N×M in number, M being an integer no less than 2, each provided with a first control terminal and a second control terminal, every M adjacent third logic gate circuits being connected together via the first control terminals thereof, which receive a pulse produced by the pulse width reducing means, and every Mth third logic gate circuit being connected together via the second control terminals thereof, which receive one of M kinds of second control signal;

said driving method comprising:

(a) inputting to the scanning circuits of the vertical drive circuit a start pulse having a pulse width of 2×M×T, T being a scanning line selection period, and, using a clock signal having a cycle of 2×M×T, causing the respective scanning circuits to produce pulse signals sequentially shifted by one-half cycle of the clock signal each;

(b) inputting the respective pulse signals sequentially shifted by one-half cycle each to the pulse width reducing means, thereby producing pulses having respective pulse widths of M×T;

(c) inputting the respective pulses produced by the pulse width reducing means to the first control terminals of the respective third logic gate circuits, and inputting to the second control terminal of each third logic gate circuit one of M kinds of second control signal having a cycle of M×T and a pulse width of T, thereby causing the respective third logic gate circuits to produce signals having a pulse width of T; and (d) sequentially inputting the respective signals of pulse width T to the scanning lines.

18. A driving method for a liquid crystal display device including an active matrix array made up of switching elements provided at each intersection between a plurality of scanning lines and a plurality of signal lines, a vertical drive circuit for driving the scanning lines, and a horizontal drive circuit for driving the signal lines, the vertical drive circuit comprising:

scanning circuits 2N in number, N being a positive integer, which receive a start pulse, and which produce pulse signals sequentially shifted by one-half of a clock signal cycle for each scanning circuit; and sixth logic gate circuits N×M in number, M being an integer no less than 2, each provided with a first control terminal and a second control terminal, every M adjacent sixth logic gate circuits being connected together via the first control terminals thereof, which receive signals produced by every other scanning circuit of the 2N scanning circuits, and every Mth sixth logic gate circuit being connected together via the second control terminals thereof, which receive one of M kinds of second control signal;

said driving method comprising the steps of:

(a) inputting to the scanning circuits of the vertical drive circuit a start pulse having a pulse width of M×T, T being a scanning line selection period, and, using a clock signal having a cycle of M×T, causing the respective scanning circuits to produce pulse signals sequentially shifted by one-half cycle of the clock signal each;

(b) inputting to the first control terminals of the respective sixth logic gate circuits signals, sequentially shifted by one cycle each, produced by every other scanning circuit of the 2N scanning circuits, and inputting to the second control terminal of each sixth logic gate circuit one of M kinds of second control signal having a cycle of M×T and a pulse width of T, thereby causing the respective sixth logic gate circuits to produce signals having a pulse width of T; and (d) sequentially inputting the respective signals of pulse width T to the scanning lines.

19. A driving method for a liquid crystal display device including an active matrix array made up of switching elements provided at each intersection between a plurality of scanning lines and a plurality of signal lines, a vertical drive circuit for driving the scanning lines, and a horizontal drive circuit for driving the signal lines, the vertical drive circuit comprising:

scanning circuits N in number, N being a positive integer, which receive a start pulse, and which produce pulse signals sequentially shifted by one-half of a clock signal cycle for each scanning circuit;

pulse width reducing means, which reduce pulse width of the pulse signals produced by the scanning circuits and produce pulses of reduced width; and third logic gate circuits N×M in number, M being an integer no less than 2, each provided with a first control terminal and a second control terminal, every M adjacent third logic gate circuits being connected together via the first control terminals thereof, which receive a pulse produced by the pulse width reducing means, and every Mth third logic gate circuit being connected together via the second control terminals thereof, which receive one of M kinds of second control signal;

said driving method comprising:

(a) inputting to the scanning circuits of the vertical drive circuit a start pulse having a pulse width of M×T, T being a scanning line selection period, and, using a clock signal having a cycle of M×T, causing the respective scanning circuits to produce pulse signals sequentially shifted by one-half cycle of the clock signal each;

(b) inputting to the pulse reducing means the pulse signals sequentially shifted by one-half cycle each, thereby causing the pulse width reducing means to produce pulses having a pulse width of M×T/2;

(c) inputting the respective pulses produced by the pulse width reducing means to the first control terminals of the respective third logic gate circuits, and inputting to the second control terminals of M/2 out of every M adjacent third logic gate circuits a second control signal having a cycle of M×T/2, thereby causing every other third logic gate circuit to produce signals having a pulse width of T; and (d) inputting the respective signals of pulse width T to every other scanning line.

20. A driving method for a liquid crystal display device including an active matrix array made up of switching elements provided at each intersection between a plurality of scanning lines and a plurality of signal lines, a vertical drive circuit for driving the scanning lines, and a horizontal drive circuit for driving the signal lines, the vertical drive circuit comprising:

scanning circuits N in number, N being a positive integer, which receive a start pulse, and which produce pulse signals sequentially shifted by one-half of a clock signal cycle for each scanning circuit;

pulse width reducing means, which reduce pulse width of the pulse signals produced by the scanning circuits and produce pulses of reduced width; and third logic gate circuits N×M in number, M being an integer no less than 2, each provided with a first control terminal and a second control terminal, every M adjacent third logic gate circuits being connected together via the first control terminals thereof, which receive a pulse produced by the pulse width reducing means, and every Mth third logic gate circuit being connected together via the second control terminals thereof, which receive one of M kinds of second control signal;

said driving method comprising:

(a) inputting to the scanning circuits of the vertical drive circuit a start pulse having a pulse width of M×T, T being a scanning line selection period, and, using a clock signal having a cycle of M×T, causing the respective scanning circuits to produce pulse signals sequentially shifted by one-half of the clock signal each;

(b) inputting to the pulse reducing means the pulse signals sequentially shifted by one-half cycle each, thereby causing the pulse width reducing means to produce pulses having a pulse width of M×T/2;

(c) inputting the respective pulses produced by the pulse width reducing means to the first control terminals of the respective third logic gate circuits, and inputting to the second control terminals of every M adjacent third logic gate circuits M/2 kinds of second control signal having a cycle of M×T/2, thereby causing the respective third logic gate circuits to produce signals having a pulse width of T, each pair of adjacent third logic gate circuits producing signals having the same phase; and (d) sequentially inputting the respective signals of pulse width T to two scanning lines each.

21. A driving method for a liquid crystal display device including an active matrix array made up of switching elements provided at each intersection between a plurality of scanning lines and a plurality of signal lines, a vertical drive circuit for driving the scanning lines, and a horizontal drive circuit for driving the signal lines, the vertical drive circuit comprising:

scanning circuits 2N in number, N being a positive integer, which receive a start pulse, and which produce pulse signals sequentially shifted by one-half of a clock signal cycle for each scanning circuit; and sixth logic gate circuits N×M in number, M being an integer no less than 2, each provided with a first control terminal and a second control terminal, every M adjacent sixth logic gate circuits being connected together via the first control terminals thereof, which receive signals produced by every other scanning circuit of the 2N scanning circuits, and every Mth sixth logic gate circuit being connected together via the second control terminals thereof, which receive one of M kinds of second control signal;

said driving method comprising the steps of:

(a) inputting to the scanning circuits of the vertical drive circuit a start pulse having a pulse width of M×T, T being a scanning line selection period, and, using a clock signal having a cycle of M×T, causing the respective scanning circuits to produce pulse signals sequentially shifted by one-half cycle of the clock signal each;

(b) inputting to the first control terminals of the respective sixth logic gate circuits signals, sequentially shifted by one cycle each, produced by every other scanning circuit of the 2N scanning circuits, and inputting to the second control terminals of M/2 out of every M adjacent sixth logic gate circuits a second control signal having a cycle of M×T/2, thereby causing every other sixth logic gate circuit to produce signals having a pulse width of T; and (d) sequentially inputting the respective signals of pulse width T to every other scanning line.

22. A driving method for a liquid crystal display device including an active matrix array made up of switching elements provided at each intersection between a plurality of scanning lines and a plurality of signal lines, a vertical drive circuit for driving the scanning lines, and a horizontal drive circuit for driving the signal lines, the vertical drive circuit comprising:

scanning circuits 2N in number, N being a positive integer, which receive a start pulse, and which produce pulse signals sequentially shifted by one-half of a clock signal cycle for each scanning circuit; and sixth logic gate circuits N×M in number, M being an integer no less than 2, each provided with a first control terminal and a second control terminal, every M adjacent sixth logic gate circuits being connected together via the first control terminals thereof, which receive signals produced by every other scanning circuit of the 2N scanning circuits, and every Mth sixth logic gate circuit being connected together via the second control terminals thereof, which receive one of M kinds of second control signal;

said driving method comprising the steps of:

(a) inputting to the scanning circuits of the vertical drive circuit a start pulse having a pulse width of M×T, T being a scanning line selection period, and, using a clock signal having a cycle of M×T, causing the respective scanning circuits to produce pulse signals sequentially shifted by one-half cycle of the clock signal each;

(b) inputting to the first control terminals of the respective sixth logic gate circuits signals, sequentially shifted by one cycle each, produced by every other scanning circuit of the 2N scanning circuits, and inputting to the second control terminals of every M adjacent sixth logic gate circuits M/2 kinds of second control signal having a cycle of M×T/2, thereby causing the respective sixth logic gate circuits to produce signals having a pulse width of T, each pair of adjacent third logic gate circuits producing signals having the same phase; and (c) sequentially inputting the respective signals of pulse width T to two scanning lines each.

23. A driving method for a liquid crystal display device including an active matrix array made up of switching elements provided at each intersection between a plurality of scanning lines and a plurality of signal lines, a vertical drive circuit for driving the scanning lines, and a horizontal drive circuit for driving the signal lines, the horizontal drive circuit comprising:

scanning circuits N in number, N being a positive integer, which receive a start pulse, and which produce pulse signals sequentially shifted by one-half of a clock signal cycle for each scanning circuit;

first logic gate circuits N×M in number, M being an integer no less than 2, each provided with a first control terminal and a second control terminal, every M adjacent first logic gate circuits being connected together via the first control terminals thereof, which receive a signal produced by one of the N scanning circuits, and every Mth first logic gate circuit being connected together via the second control terminals thereof, which receive one of M kinds of second control signal;

second logic gate circuits, each of which receives an output from one of the first logic gate circuits and, via a third control terminal, one of two kinds of third control signal; and sample holding switches;

said driving method comprising the steps of:

(a) inputting to the scanning circuits of the horizontal drive circuit a start pulse having a pulse width of 2×M×T, T being a period for sampling J signal lines (J≧1), and, using a clock signal having a cycle of 2×M×T, causing the respective scanning circuits to produce pulse signals sequentially shifted by one-half cycle of the clock signal each;

(b) inputting to the first control terminals of the respective first logic gate circuits the pulse signals sequentially shifted by one-half cycle each, and inputting to the second control terminals of the respective first logic gate circuits M kinds of second control signal made up of pulses of pulse width T occurring (M−1)×T apart from each other, thereby causing each first logic gate circuit to produce two pulses of pulse width T, produced (M−1)×T apart from each other;

(c) inputting to each second logic gate circuit the two pulses produced by one of the first logic gate circuits and one of two kinds of third control signal having a cycle of 2×M×T and a pulse width of M×T, each third control signal being the inverse of the other, thereby causing the respective second logic gate circuits to produce signals having a pulse width of T; and (d) sequentially inputting the respective signals of pulse width T to the sample holding switches.

24. The driving method for liquid crystal display device set forth in claim 23, wherein:

among the signals of pulse width T which are sequentially inputted to the sample holding switches, pulses of adjacent signals do not mutually overlap.

25. A driving method for a liquid crystal display device including an active matrix array made up of switching elements provided at each intersection between a plurality of scanning lines and a plurality of signal lines, a vertical drive circuit for driving the scanning lines, and a horizontal drive circuit for driving the signal lines, the horizontal drive circuit comprising:

scanning circuits N in number, N being a positive integer, which receive a start pulse, and which produce pulse signals sequentially shifted by one-half of a clock signal cycle for each scanning circuit;

pulse width reducing means, which reduce pulse width of the pulse signals produced by the scanning circuits and produce pulses of reduced width;

third logic gate circuits N×M in number, M being an integer no less than 2, each provided with a first control terminal and a second control terminal, every M adjacent third logic gate circuits being connected together via the first control terminals thereof, which receive a pulse produced by the pulse width reducing means, and every Mth third logic gate circuit being connected together via the second control terminals thereof, which receive one of M kinds of second control signal; and sample holding switches;

said driving method comprising:

(a) inputting to the scanning circuits of the horizontal drive circuit a start pulse having a pulse width of 2×M×T, T being a period for sampling J signal lines (J≧1), and, using a clock signal having a cycle of 2×M×T, causing the respective scanning circuits to produce pulse signals sequentially shifted by one-half cycle of the clock signal each;

(b) inputting the respective pulse signals sequentially shifted by one-half cycle each to the pulse width reducing means, thereby producing pulses having respective pulse widths of M×T;

(c) inputting the respective pulses produced by the pulse width reducing means to the first control terminals of the respective third logic gate circuits, and inputting to the second control terminal of each third logic gate circuit one of M kinds of second control signal having a cycle of M×T and a pulse width of T, thereby causing the respective third logic gate circuits to produce signals having a pulse width of T; and (d) sequentially inputting the respective signals of pulse width T to the sample holding switches.

26. The driving method for liquid crystal display device set forth in claim 25, wherein: among the signals of pulse width T which are sequentially inputted to the sample holding switches, pulses of adjacent signals do not mutually overlap.

27. A driving method for a liquid crystal display device including an active matrix array made up of switching elements provided at each intersection between a plurality of scanning lines and a plurality of signal lines, a vertical drive circuit for driving the scanning lines, and a horizontal drive circuit for driving the signal lines, the horizontal drive circuit comprising:

scanning circuits 2N in number, N being a positive integer, which receive a start pulse, and which produce pulse signals sequentially shifted by one-half of a clock signal cycle for each scanning circuit;

sixth logic gate circuits N×M in number, M being an integer no less than 2, each provided with a first control terminal and a second control terminal, every M adjacent sixth logic gate circuits being connected together via the first control terminals thereof, which receive signals produced by every other scanning circuit of the 2N scanning circuits, and every Mth sixth logic gate circuit being connected together via the second control terminals thereof, which receive one of M kinds of second control signal; and sample holding switches;

said driving method comprising the steps of:

(a) inputting to the scanning circuits of the horizontal drive circuit a start pulse having a pulse width of M×T, T being a period for sampling J signal lines (J≧1), and, using a clock signal having a cycle of M×T, causing the respective scanning circuits to produce pulse signals sequentially shifted by one-half cycle of the clock signal each;

(b) inputting to the first control terminals of the respective sixth logic gate circuits signals, sequentially shifted by one cycle each, produced by every other scanning circuit of the 2N scanning circuits, and inputting to the second control terminal of each sixth logic gate circuit one of M kinds of second control signal having a cycle of M×T and a pulse width of T, thereby causing the respective sixth logic gate circuits to produce signals having a pulse width of T; and (d) sequentially inputting the respective signals of pulse width T to the sampling switches.

28. The driving method for liquid crystal display device set forth in claim 27, wherein: among the signals of pulse width T which are sequentially inputted to the sample holding switches, pulses of adjacent signals do not mutually overlap.

* * * * *